US009819125B2

(12) United States Patent
Regnier et al.

(10) Patent No.: US 9,819,125 B2
(45) Date of Patent: Nov. 14, 2017

(54) LOW PROFILE CONNECTOR SYSTEM

(71) Applicant: Molex, LLC, Lisle, IL (US)

(72) Inventors: Kent E. Regnier, Lombard, IL (US); Steven George Sutter, Maumelle, AR (US); Darian Schulz, Little Rock, AR (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/355,881

(22) Filed: Nov. 18, 2016

(65) Prior Publication Data

US 2017/0070006 A1 Mar. 9, 2017

Related U.S. Application Data

(63) Continuation of application No. 14/744,619, filed on Jun. 19, 2015, which is a continuation of application No. 14/653,905, filed as application No. PCT/US2014/011838 on Jan. 16, 2014.

(60) Provisional application No. 61/753,029, filed on Jan. 16, 2013, provisional application No. 61/757,299, filed on Jan. 28, 2013, provisional application No.
(Continued)

(51) Int. Cl.

| | |
|---|---|
| ***H01R 12/72*** | (2011.01) |
| ***H01R 13/646*** | (2011.01) |
| ***H01R 13/648*** | (2006.01) |
| ***H01R 13/6473*** | (2011.01) |
| ***H01R 24/62*** | (2011.01) |
| ***H01R 12/70*** | (2011.01) |
| ***H01R 13/6471*** | (2011.01) |
| ***H01R 24/60*** | (2011.01) |
| ***H01R 13/627*** | (2006.01) |
| ***H01R 13/6582*** | (2011.01) |
| *H01R 107/00* | (2006.01) |

(52) U.S. Cl.
CPC ..... *H01R 13/6473* (2013.01); *H01R 12/7076* (2013.01); *H01R 13/6272* (2013.01); *H01R 13/6273* (2013.01); *H01R 13/6471* (2013.01); *H01R 13/6582* (2013.01); *H01R 24/60* (2013.01); *H01R 24/62* (2013.01); *H01R 2107/00* (2013.01)

(58) Field of Classification Search
CPC .... H01R 23/7073; H01R 23/02; H01R 12/72; H01R 13/646; H01R 13/648
See application file for complete search history.

(56) References Cited

U.S. PATENT DOCUMENTS 5,066,236 A * 11/1991 Broeksteeg ..... H01R 23/688 439/108
5,622,522 A 4/1997 Tan et al.
(Continued)

FOREIGN PATENT DOCUMENTS

CN 1494752 A 5/2004
CN 200950492 Y 9/2007
(Continued)

*Primary Examiner* — Gary Paumen
(74) *Attorney, Agent, or Firm* — Jeffrey K. Jacobs

(57) ABSTRACT

A connector system is disclosed that can support high data rates over a connector with terminals on a 0.5 mm pitch. A plug connector can include a termination module that has a paddle card and a plug module that includes rows of terminals. The termination module and the plug module can be aligned via the row of terminals and pads on the paddle card.

13 Claims, 48 Drawing Sheets

Related U.S. Application Data

61/760,433, filed on Feb. 4, 2013, provisional application No. 61/868,704, filed on Aug. 22, 2013.

(56) References Cited

U.S. PATENT DOCUMENTS 5,934,942 A 8/1999 Patel et al.
5,959,848 A * 9/1999 Groves ..... G06F 1/188 361/760
6,352,444 B1 * 3/2002 Yuzawa ..... H01R 13/514 385/56
6,659,796 B1 * 12/2003 Waddell ..... H01R 12/7047 439/352
6,854,992 B2 * 2/2005 Martin ..... H01R 13/62944 439/157
6,948,965 B2 * 9/2005 Kumamoto ..... H01R 13/6275 439/358
7,175,465 B1 * 2/2007 Tsai ..... H01R 13/6275 439/352
7,192,297 B1 * 3/2007 Wu ..... H01R 12/592 439/353
7,252,540 B2 * 8/2007 Tanaka ..... H01B 12/592 439/497
7,322,845 B2 * 1/2008 Regnier ..... H01R 13/6335 439/352
7,351,103 B1 4/2008 Peng et al.
7,354,292 B1 * 4/2008 Lloyd ..... H01R 13/6272 439/352
7,438,565 B2 * 10/2008 Hamazaki ..... H01R 13/6658 439/108
7,654,846 B2 * 2/2010 Kimura ..... H01R 12/88 439/326
7,766,680 B2 * 8/2010 Suzuki ..... H01R 12/79 439/260
7,824,222 B2 * 11/2010 Miyoshi ..... H01R 13/5845 439/607.41
7,845,982 B1 * 12/2010 Wang ..... H01R 13/506 439/607.25
8,011,969 B2 * 9/2011 Wang ..... H01R 13/65802 439/607.35
8,038,480 B2 * 10/2011 Wei ..... H01R 13/502 439/607.01
8,100,709 B2 * 1/2012 Zhang ..... H01R 13/6275 439/353
8,478,536 B2 7/2013 Wang et al.
8,622,767 B2 * 1/2014 Nakazura ..... H01R 12/79 439/499
8,668,515 B2 * 3/2014 Wu ..... H01R 13/633 439/352
8,961,235 B2 * 2/2015 Little ..... H01R 13/64 439/374
8,992,262 B2 * 3/2015 Pang ..... H01R 13/6471 439/626
9,397,442 B2 7/2016 Sutter et al.
2003/0134529 A1 * 7/2003 Murr ..... H01R 23/688 439/79
2003/0162446 A1 * 8/2003 Ho ..... H01R 13/6477 439/660
2004/0077196 A1 * 4/2004 Martin ..... H01R 13/62944 439/152
2006/0148300 A1 7/2006 Huang et al.
2007/0049100 A1 * 3/2007 Tsai ..... H01R 13/6275 439/352
2007/0054553 A1 * 3/2007 Nishio ..... H01R 13/64 439/607.55
2007/0072457 A1 * 3/2007 Hamazaki ..... H01R 13/6658 439/108
2009/0004916 A1 * 1/2009 Miyoshi ..... H01R 13/5845 439/607.41
2009/0011624 A1 * 1/2009 Yamazaki ..... H01R 9/034 439/99
2010/0081303 A1 * 4/2010 Roth ..... G02B 6/3817 439/140
2010/0087084 A1 * 4/2010 George ..... H01R 13/6275 439/352
2010/0158449 A1 * 6/2010 Yi ..... G02B 6/3817 385/75
2011/0159744 A1 * 6/2011 Buck ..... H01R 12/73 439/660
2011/0269346 A1 * 11/2011 Casher ..... H01R 29/00 439/626
2011/0294334 A1 * 12/2011 Phillips ..... G02B 6/4201 439/357
2012/0077365 A1 * 3/2012 Kobayashi ..... H01R 13/4223 439/345
2012/0156941 A1 * 6/2012 Wu ..... H01R 13/6585 439/660
2012/0190223 A1 * 7/2012 Wu ..... H01R 13/633 439/152
2012/0225583 A1 * 9/2012 Kamarauskas ..... H01R 13/41 439/607.01
2012/0238146 A1 * 9/2012 Liao ..... H01R 31/06 439/660
2012/0322306 A1 * 12/2012 Tai ..... H01R 13/6477 439/607.01
2013/0286540 A1 * 10/2013 Farcy ..... H01G 4/005 361/303
2013/0288540 A1 10/2013 Cheng
2014/0030899 A1 * 1/2014 Crighton ..... H01R 24/20 439/176

FOREIGN PATENT DOCUMENTS

CN 201402882 Y 2/2010
CN 202145500 U 2/2012
JP 10-302893 A 11/1998
JP 2000-068007 A 3/2000
JP 2009-059853 A 3/2009
TW M349108 U 1/2009
TW M364338 U 9/2009
WO WO 2004/030158 A2 4/2004
WO WO 2007-039039 A1 4/2007
WO WO 2014-113563 A1 7/2014

* cited by examiner

LOW PROFILE CONNECTOR SYSTEM

RELATED APPLICATIONS

This application is a continuation of U.S. application Ser. No. 14/744,619, filed Jun. 19, 2015, which is a continuation of U.S. Ser. No. 14/653,905, filed Jun. 19, 2015, which is a national phase of PCT Application No. PCT/US2014/011838, filed Jan. 16, 2014, which in turn claims priority to U.S. Provisional Application No. 61/753,029, filed Jan. 16, 2013, to U.S. Provisional Application No. 61/757,299, filed Jan. 28, 2013, to U.S. Provisional Application No. 61/760,433, filed Feb. 4, 2013, and to U.S. Provisional Application No. 61/868,704, filed Aug. 22, 2013, all of which are incorporated herein by reference in their entirety.

FIELD OF THE INVENTION

The present invention relates to the field of systems that use I/O connectors and could benefit from low profile connectors.

DESCRIPTION OF RELATED ART

While connectors exist that can provide substantial amounts of bandwidth (e.g., the CXP connector can provide 12 two-way sub-channels of 10 Gbps), existing connectors often have to deal with competing requirements and thus there hasn't been a single solution that works ideally for all applications. One issue with existing high performance connectors, for example, is that the ports are not particularly small. Thus, while the port density is reasonable, a limited number of devices can be connected. One attempt to mitigate this with CXP style connectors has been to split the far end of the cable assembly into three connectors that each support a 4× connection (e.g., one 12× connector to three 4× connectors). Such attempts, however, tend to create a spaghetti type wiring that makes it more difficult to manage the servers. Other attempts to provide more channels have been to design a smaller interface, such as the RJpoint5 system provided by TE CONNECTIVITY. While such a system provides high port density, it fails to provide a design that can provide a large number of ports in a 1U chassis where each port is capable of providing two or more channels, each channel configured to provide a high data rate so that each channel could support something like PCIe Gen 3 or PCIe Gen 4 data rates.

Certain small connectors with a pitch of about 0.5 mm exist. For example, micro USB connectors can provide up to about 2.5 Gbps over a differential pair of terminals and the micro USB connector is at 0.4 pitch. But these existing design cannot provide what can be considered high data rates (e.g., greater than 5 Gbps and more preferably 8 or more Gbps) with a pitch of less than 0.6 mm. Thus certain individuals would appreciate further improvements in connector systems.

BRIEF SUMMARY

A receptacle connector is disclosed that can provide 5 Gbps data rate on a 0.5 mm pitch. The receptacle connector can offer a 4× connector in a space that typically could only provide much lower data rates (e.g., a space that is less than 14 mm wide by less than 4 mm tall). A plug connector can also be provided that mates to the receptacle. The plug connector can include an active or passive latch. In an embodiment, the spacing and/or material between terminals can be adjusted so as to provide preferential coupling. A plug connector can include a plug module and a termination module so as to allow the use of paddle card in a 0.5 mm pitch connector.

BRIEF DESCRIPTION OF THE DRAWINGS

The present invention is illustrated by way of example and not limited in the accompanying figures in which like reference numerals indicate similar elements and in which.

DETAILED DESCRIPTION

Figure 1A:
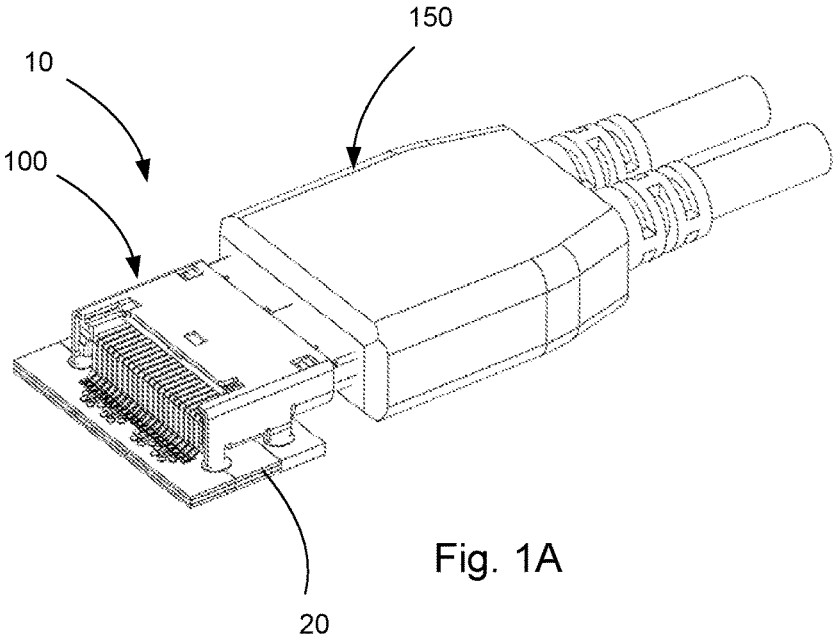
FIG. 1A illustrates a perspective view of an embodiment of a connector system.
Figure 1B:
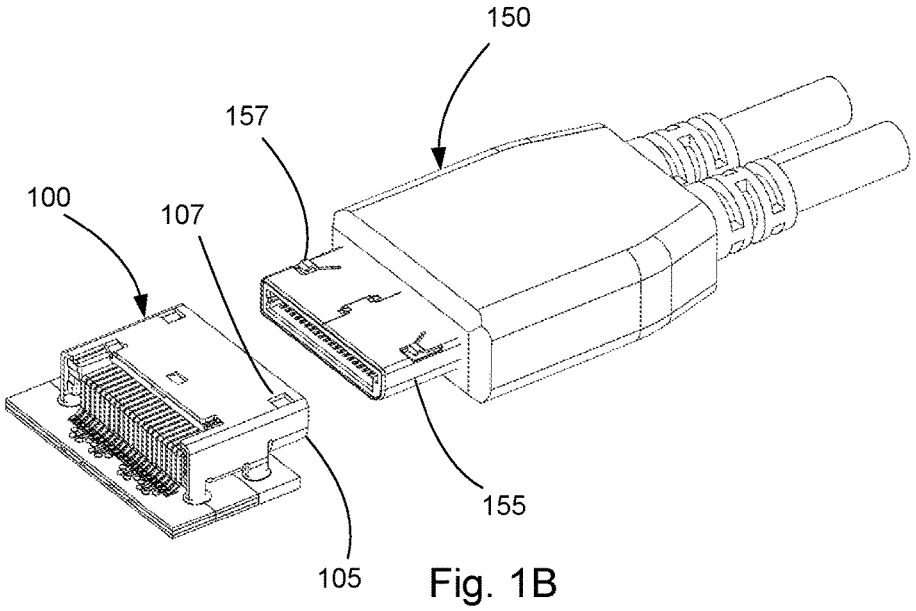
FIG. 1B illustrates a perspective view of the embodiment depicted in FIG. 1 with the plug and receptacle not connected.
Figure 2A:
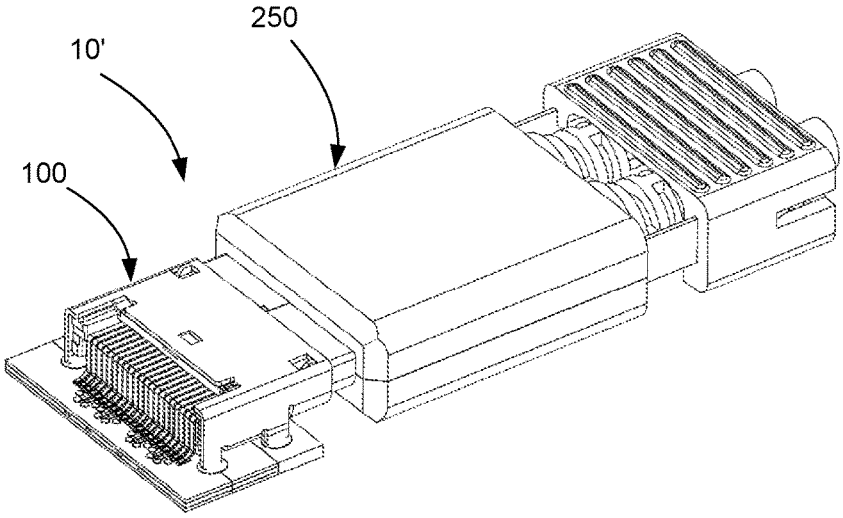
FIG. 2A illustrates a perspective view of another embodiment of a connector system.
Figure 2B:
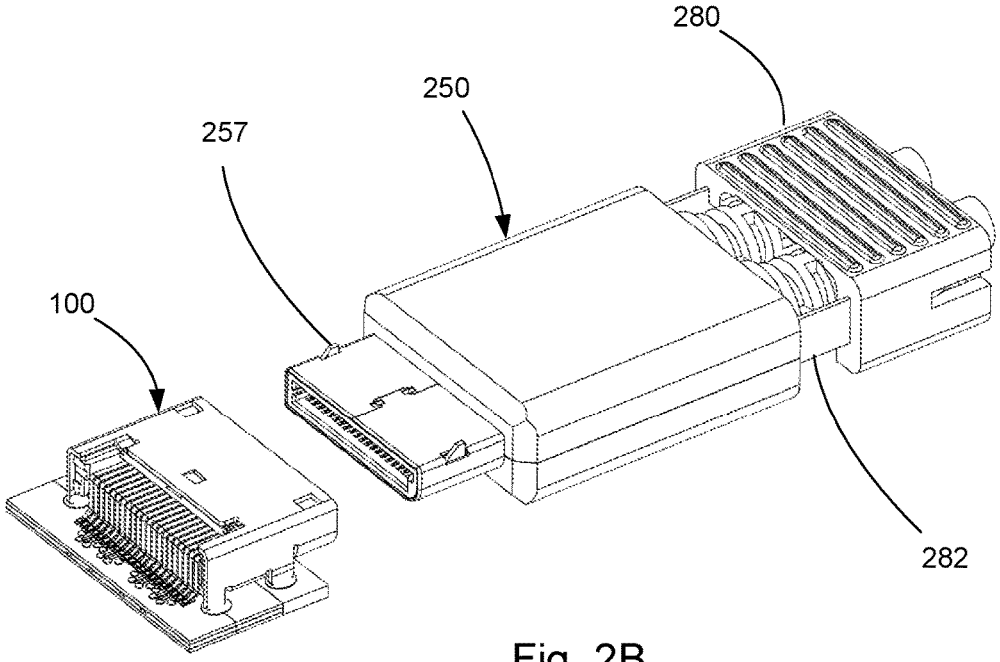
FIG. 2B illustrates a perspective view of the embodiment depicted in FIG. 2A with the plug and receptacle not connected.
Figure 3A:
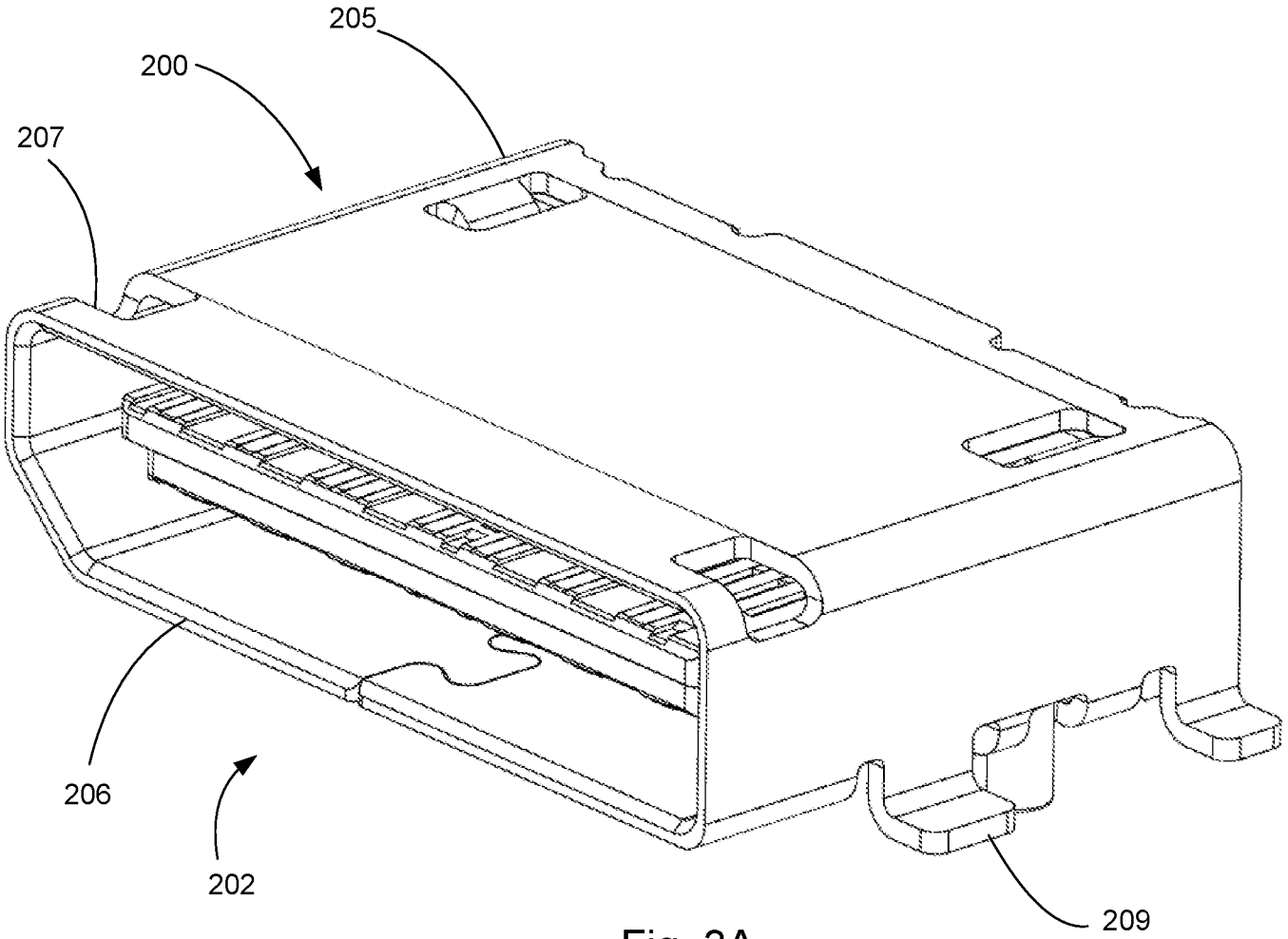
FIG. 3A illustrates a perspective view of an embodiment of a receptacle.
Figure 3B:
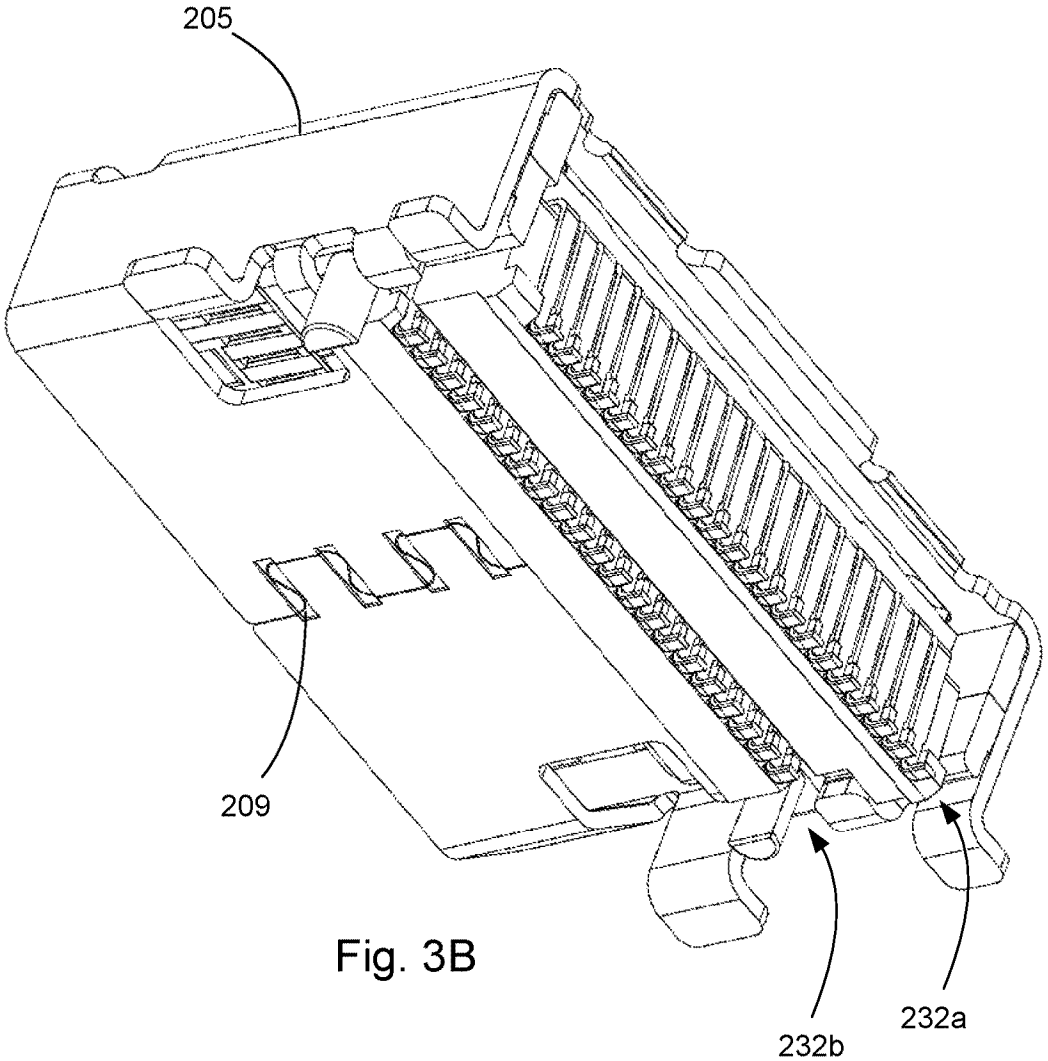
FIG. 3B another perspective view of the receptacle depicted in FIG. 3A.
Figure 4:
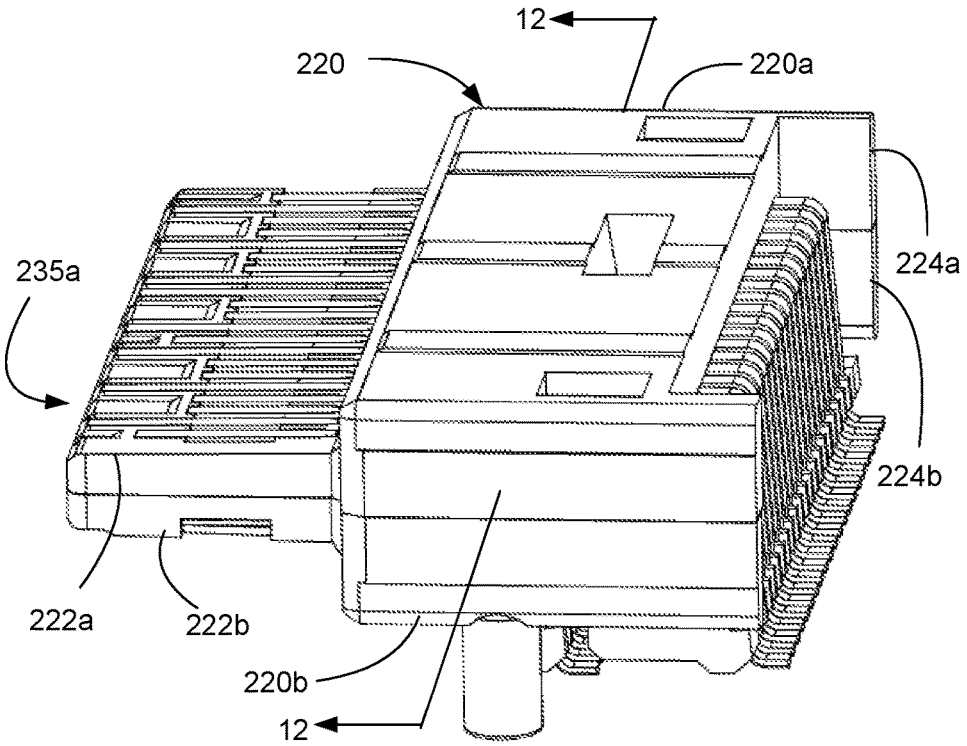
FIG. 4 illustrates a perspective view of a housing assembly suitable for use in the receptacle depicted in FIG. 3A.
Figure 5A:
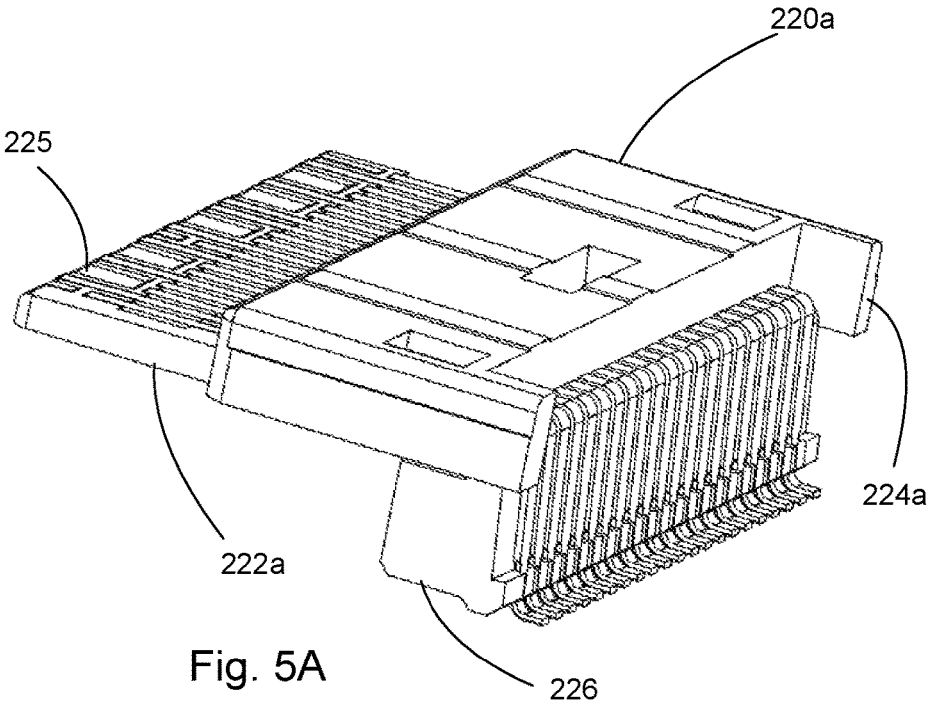
FIG. 5A illustrates a partial perspective view of the embodiment depicted in FIG. 4.
Figure 5B:
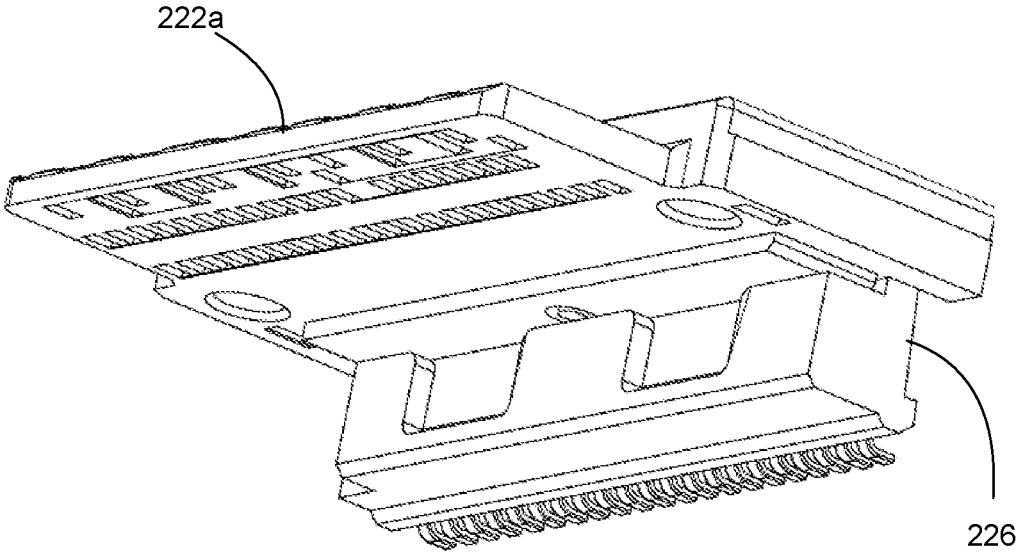
FIG. 5B illustrates another perspective view of the embodiment depicted in FIG. 5A.
Figure 6:
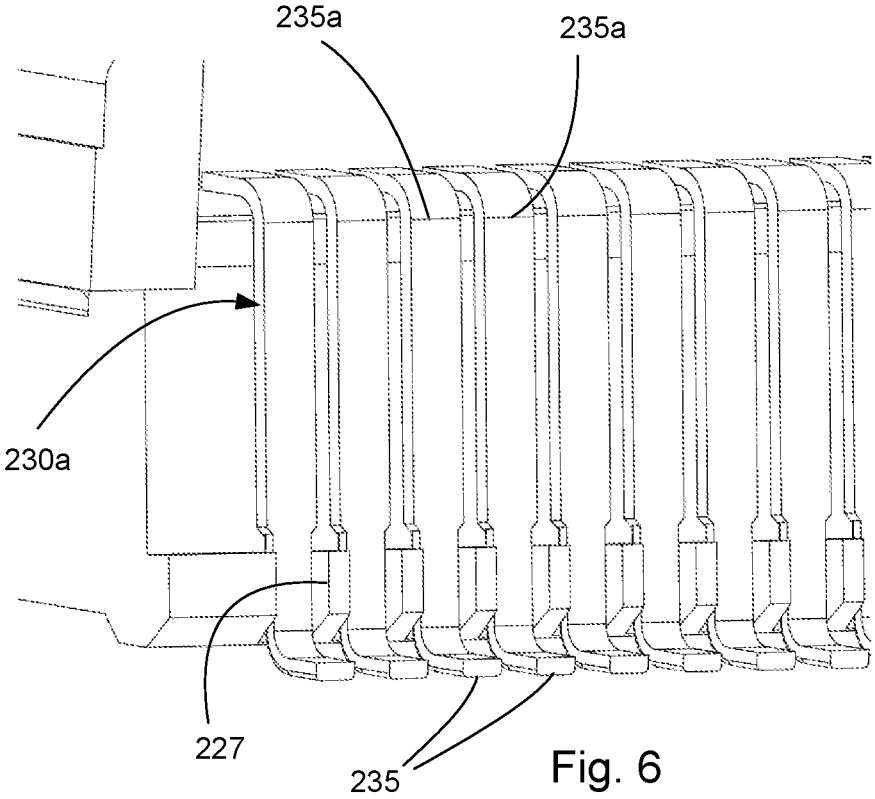
FIG. 6 illustrates an enlarged perspective view of the embodiment depicted in FIG. 5A.
Figure 7:
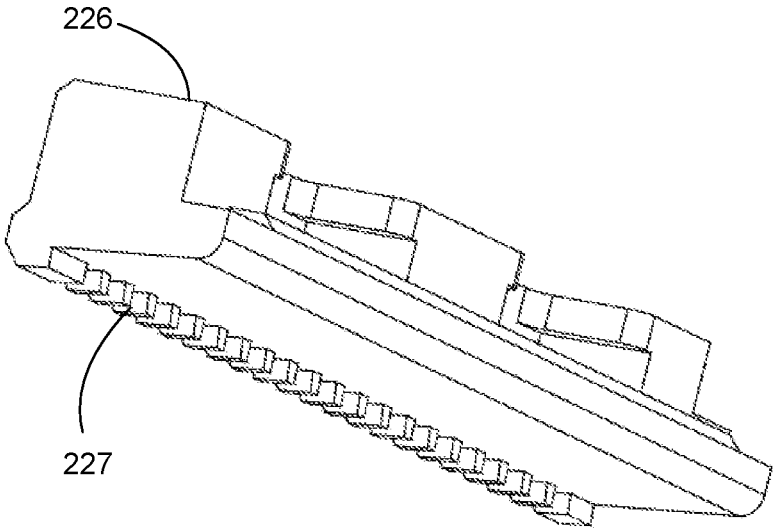
FIG. 7 illustrates a perspective view of an embodiment of a terminal comb.
Figure 8:
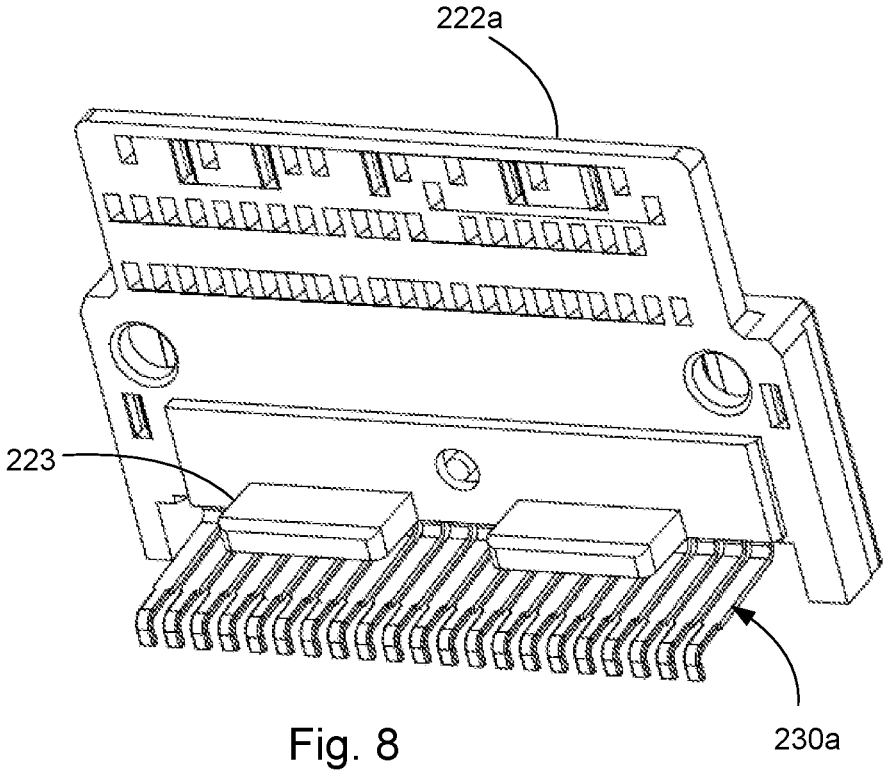
FIG. 8 illustrates a perspective view of an embodiment of a terminal frame.
Figure 9:
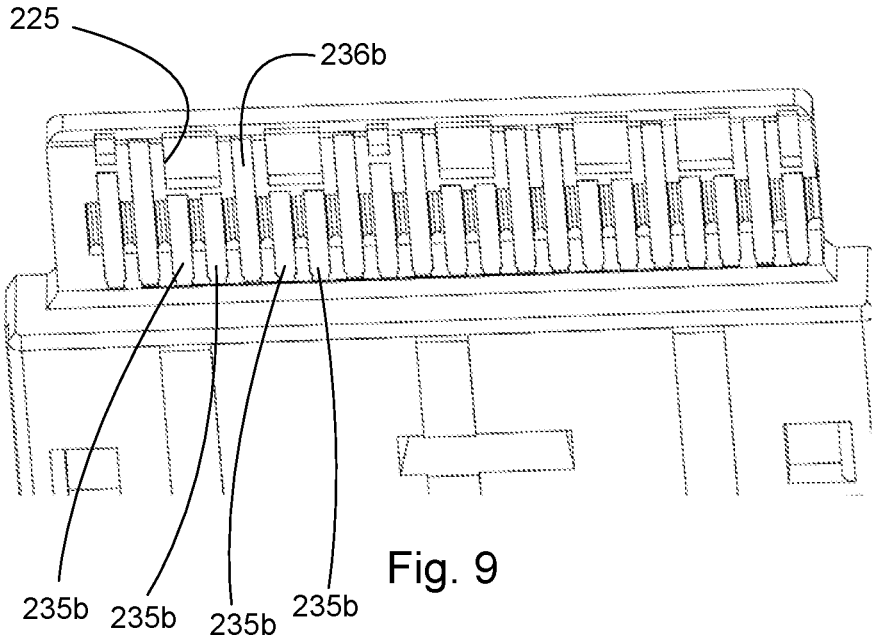
FIG. 9 illustrates a perspective view of a tongue on a terminal frame.
Figure 10:
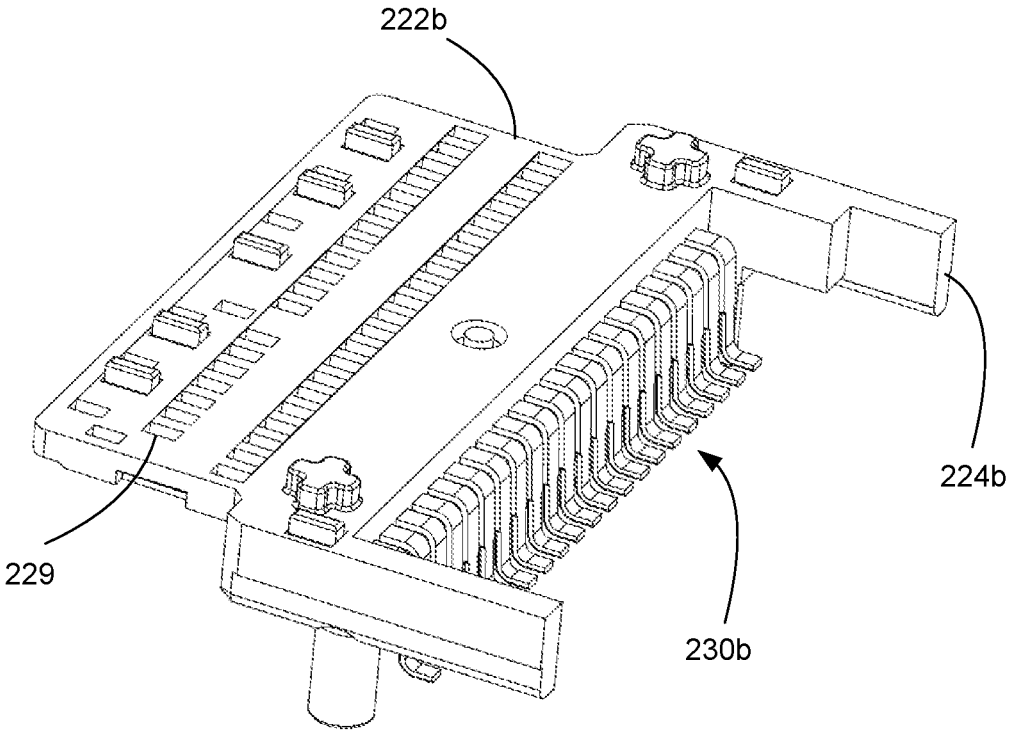
FIG. 10 illustrates a perspective view of another embodiment of a terminal frame.
Figure 11:
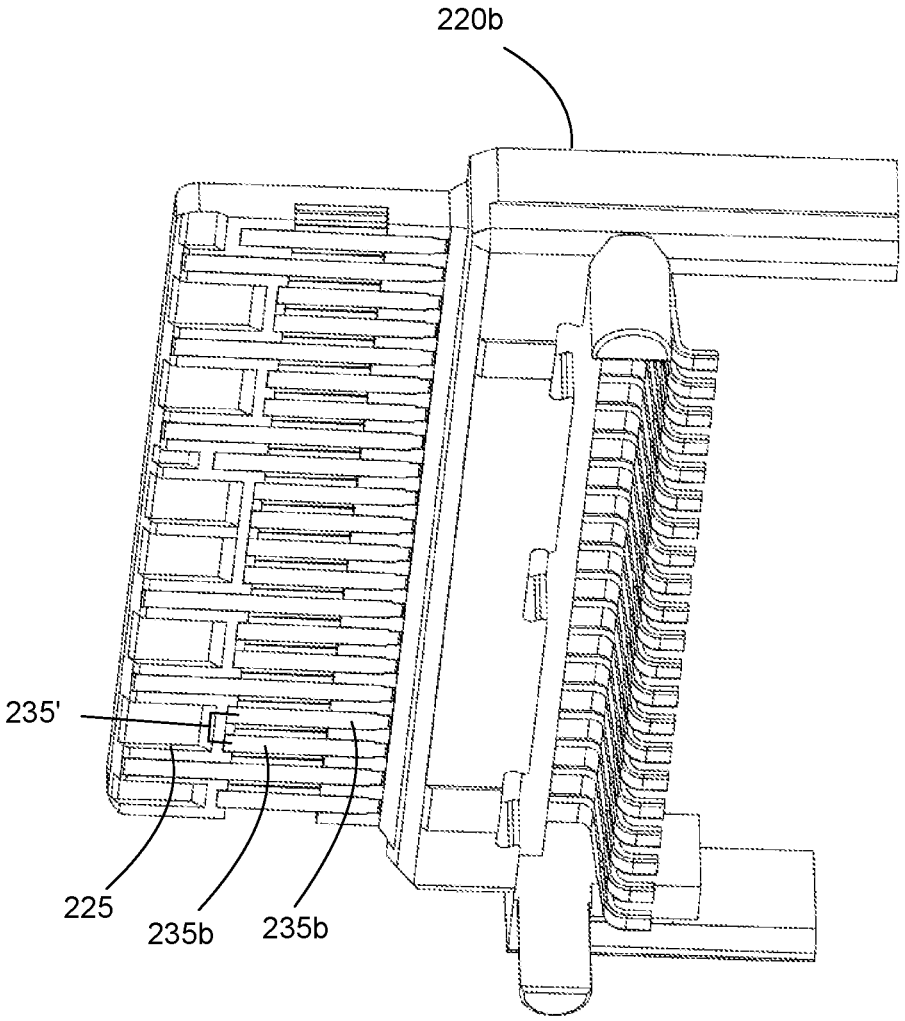
FIG. 11 illustrates another perspective view of the embodiment depicted in FIG. 10.
Figure 12:
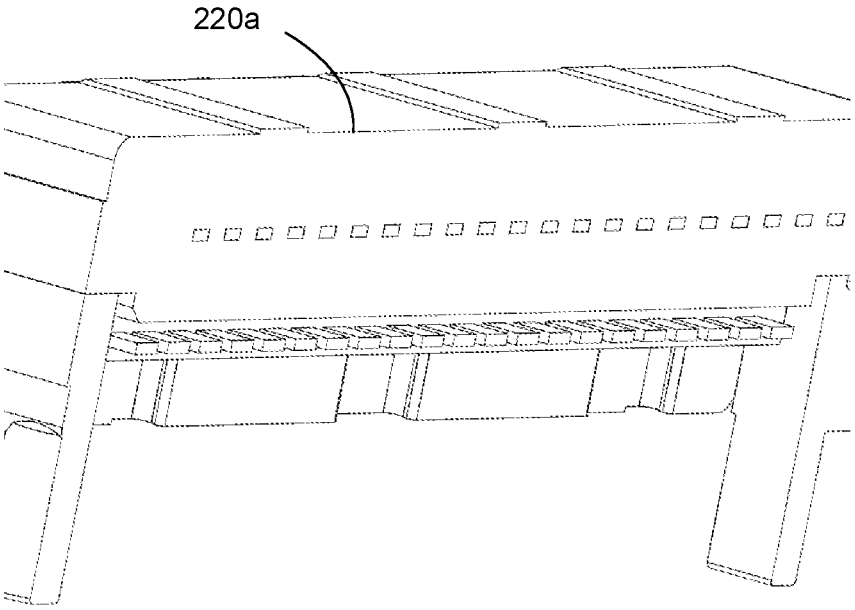
FIG. 12 illustrates a perspective cross section view of a housing assembly taken along line 12-12 in FIG. 4.
Figure 13:
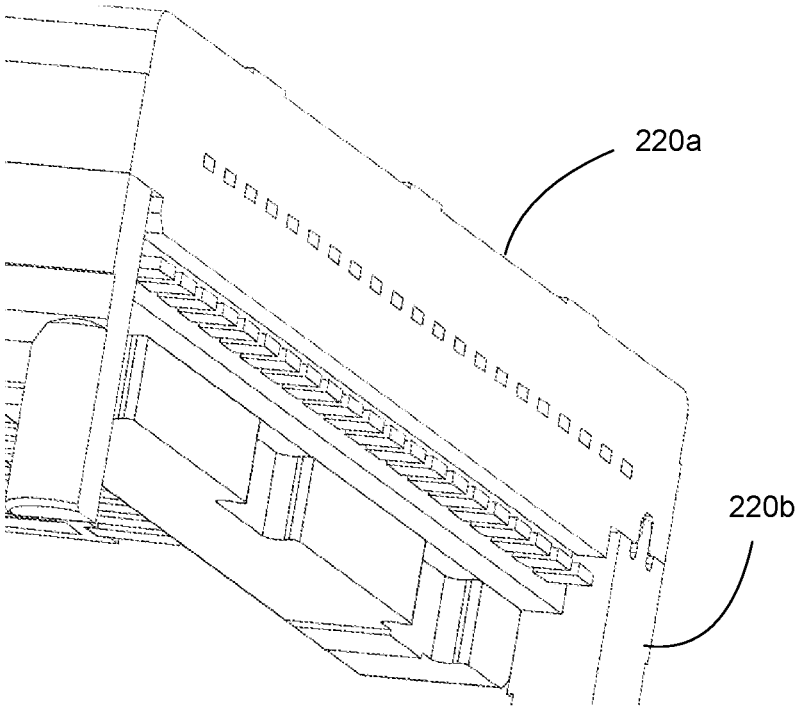
FIG. 13 illustrates another perspective view of the embodiment depicted in FIG. 12.
Figure 14:
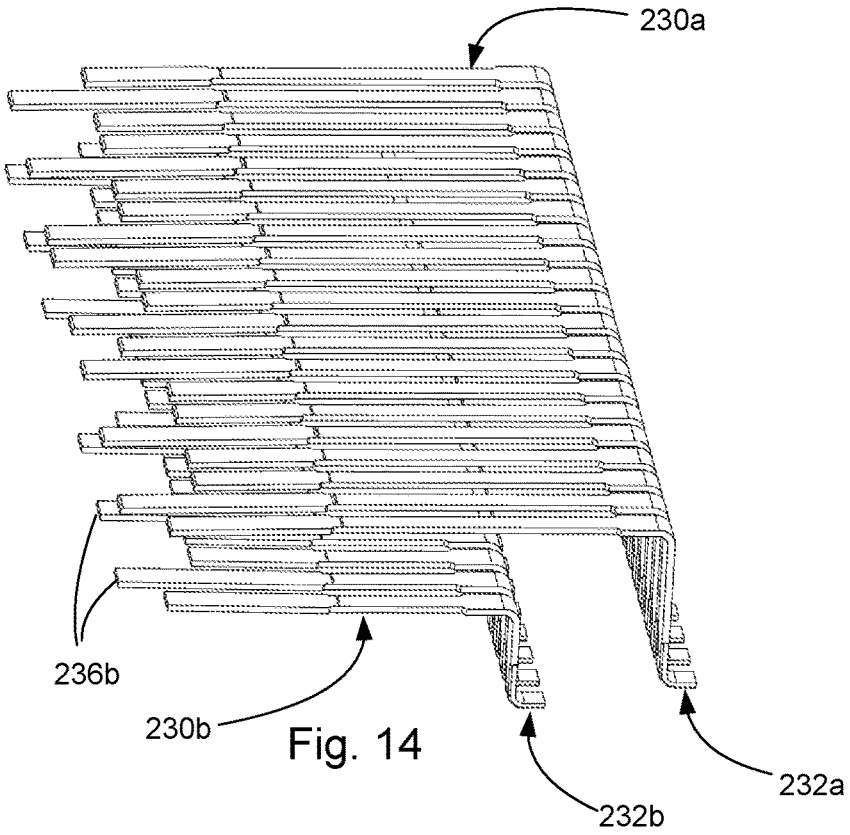
FIG. 14 illustrates a perspective view of an embodiment of two rows of terminals.
Figure 15:
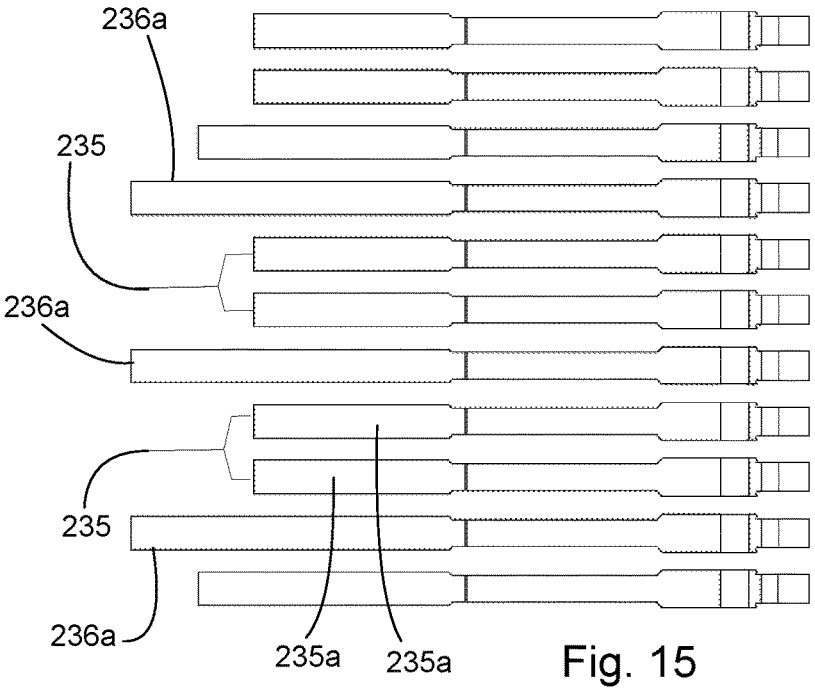
FIG. 15 illustrates a plan view of an embodiment of a row of terminals.
Figure 16:
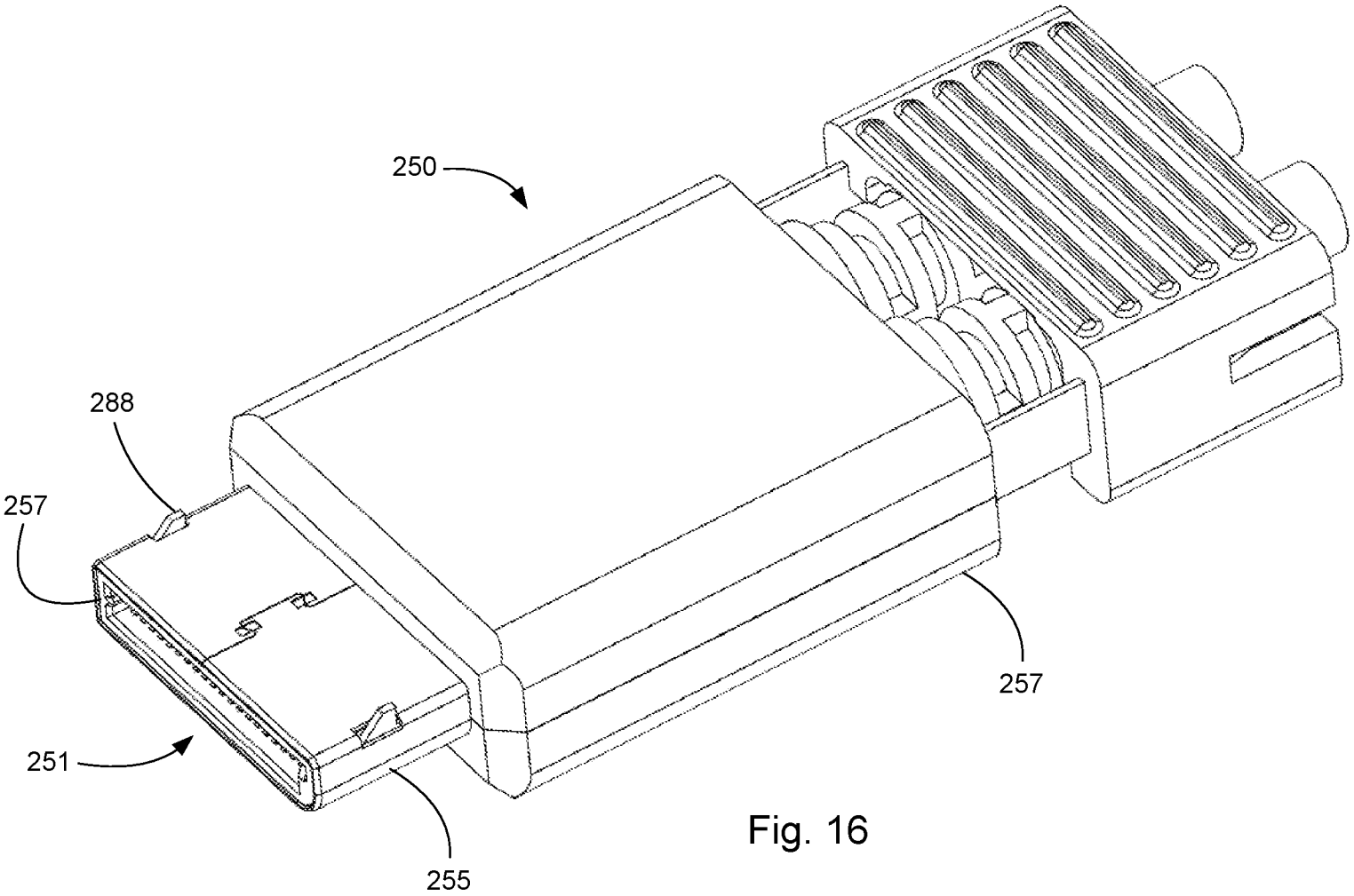
FIG. 16 illustrates a perspective view of an embodiment of a plug connector.
Figure 17:
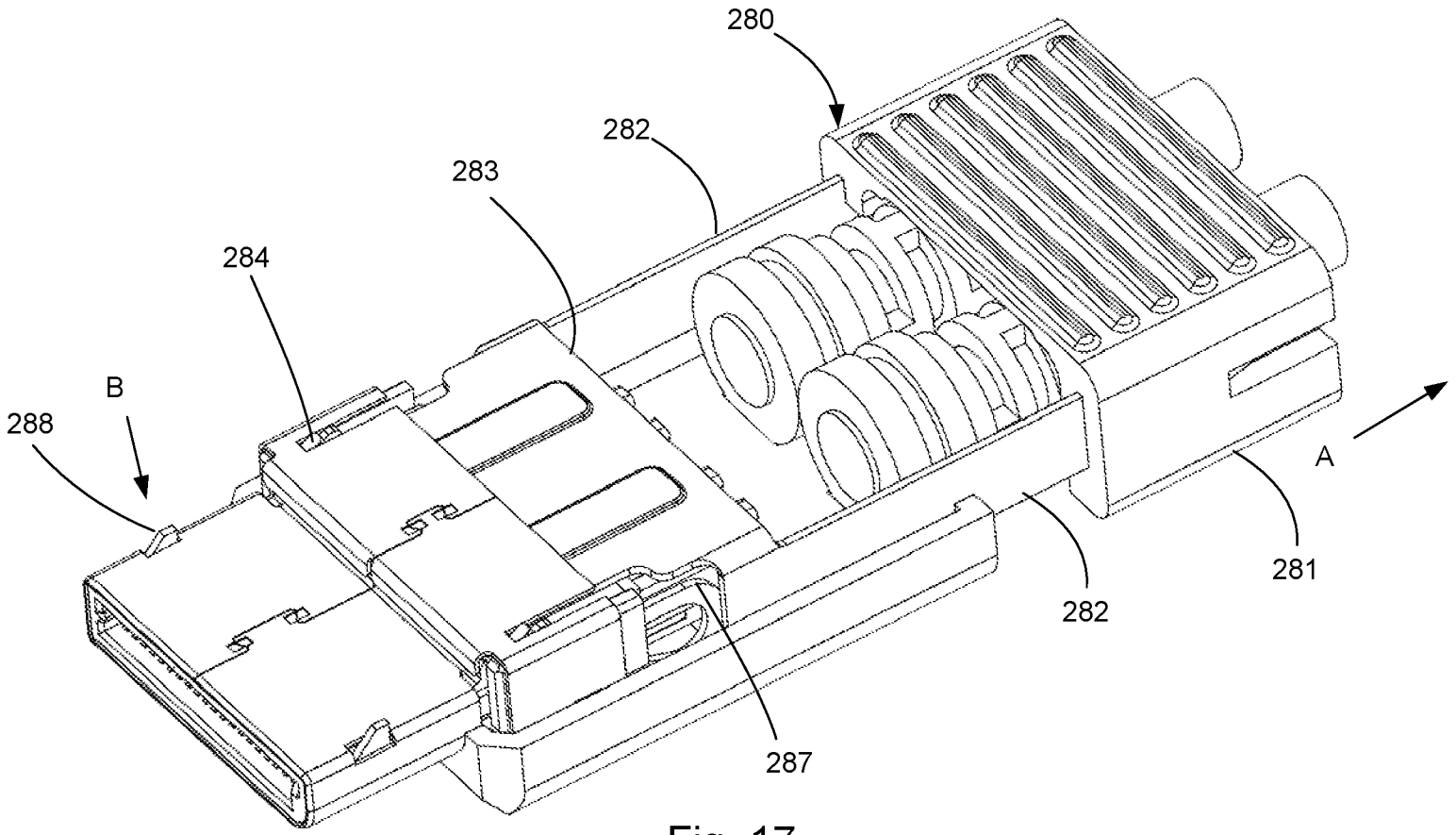
FIG. 17 illustrates a simplified perspective view the embodiment depicted in FIG. 16.
Figure 18:
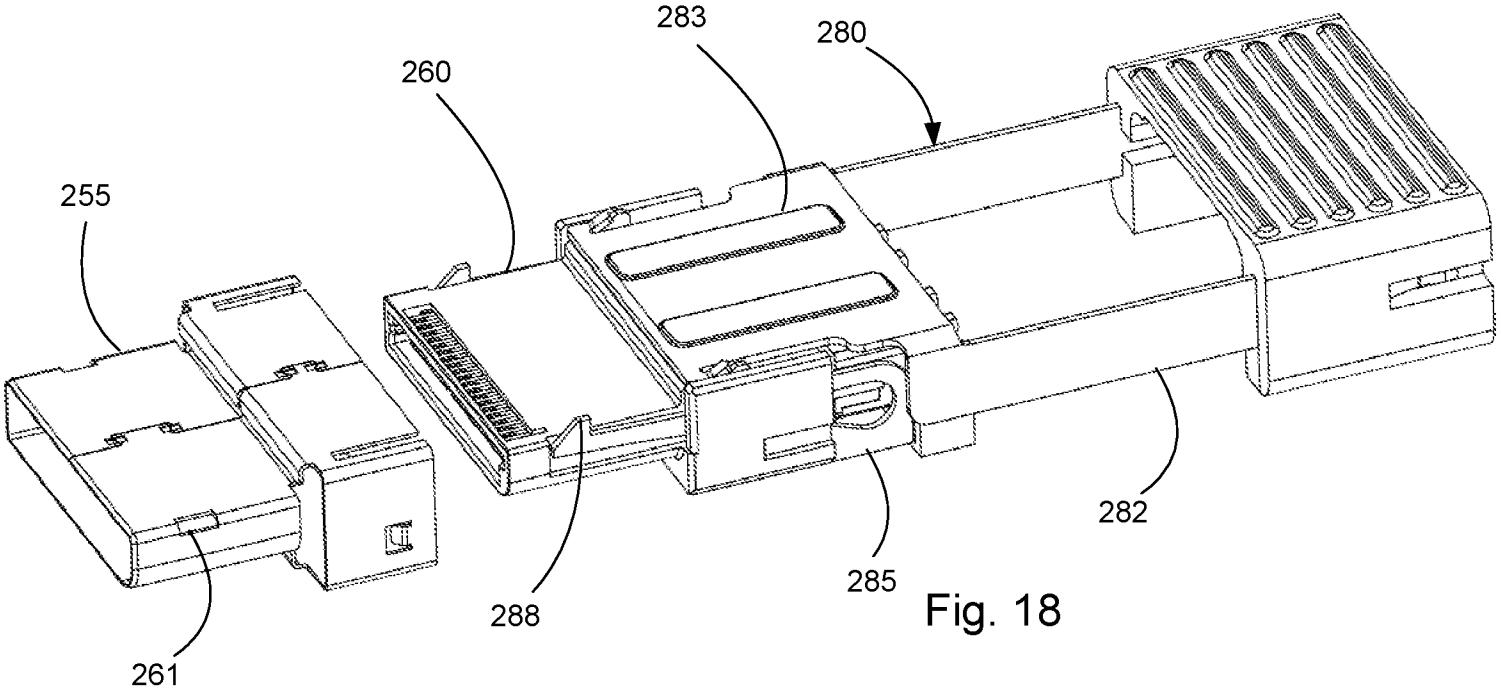
FIG. 18 illustrates a partially exploded perspective view of the embodiment depicted in FIG. 17.
Figure 19:
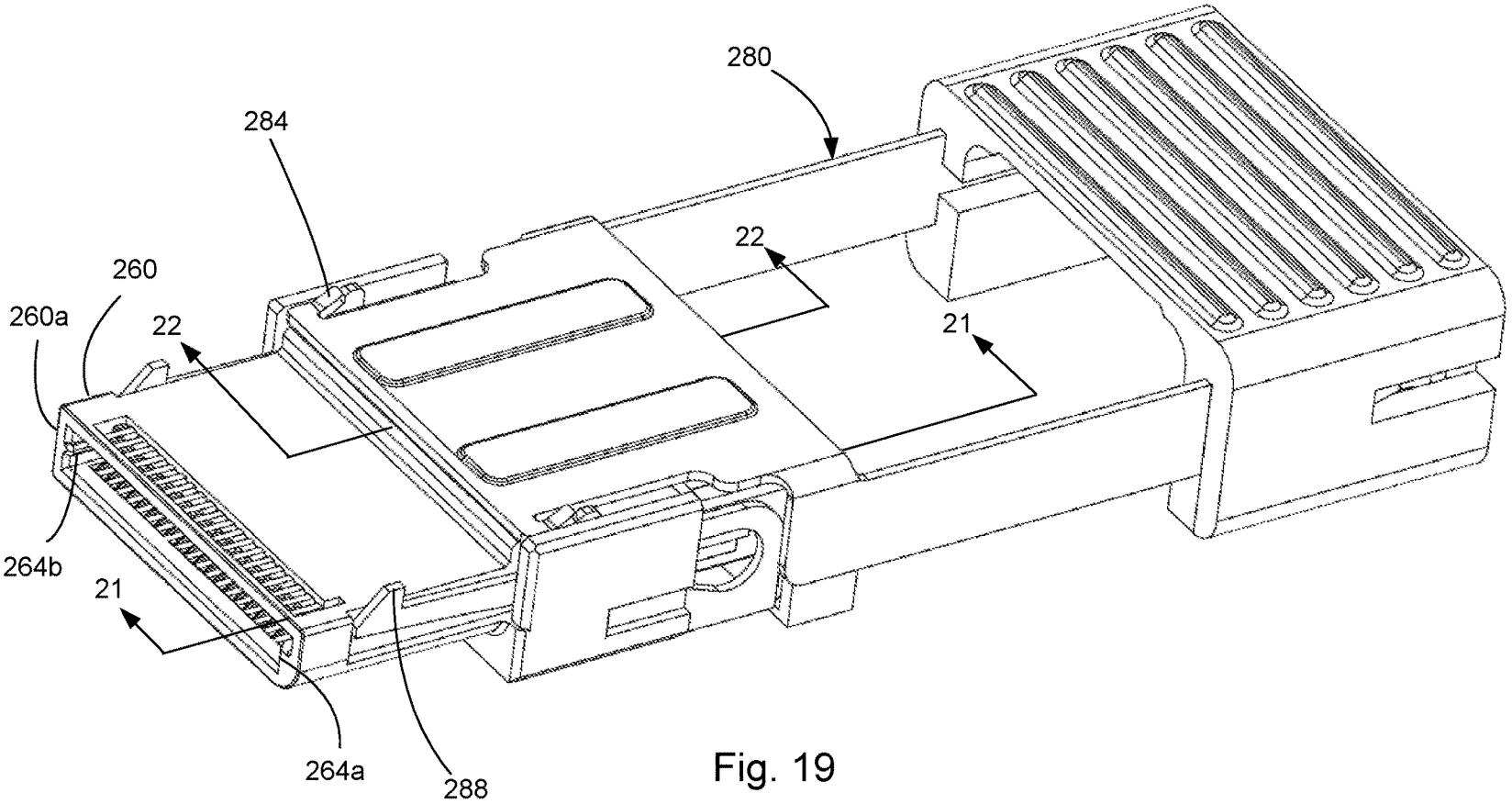
FIG. 19 illustrates a further simplified perspective view of the embodiment depicted in FIG. 17.
Figure 20:
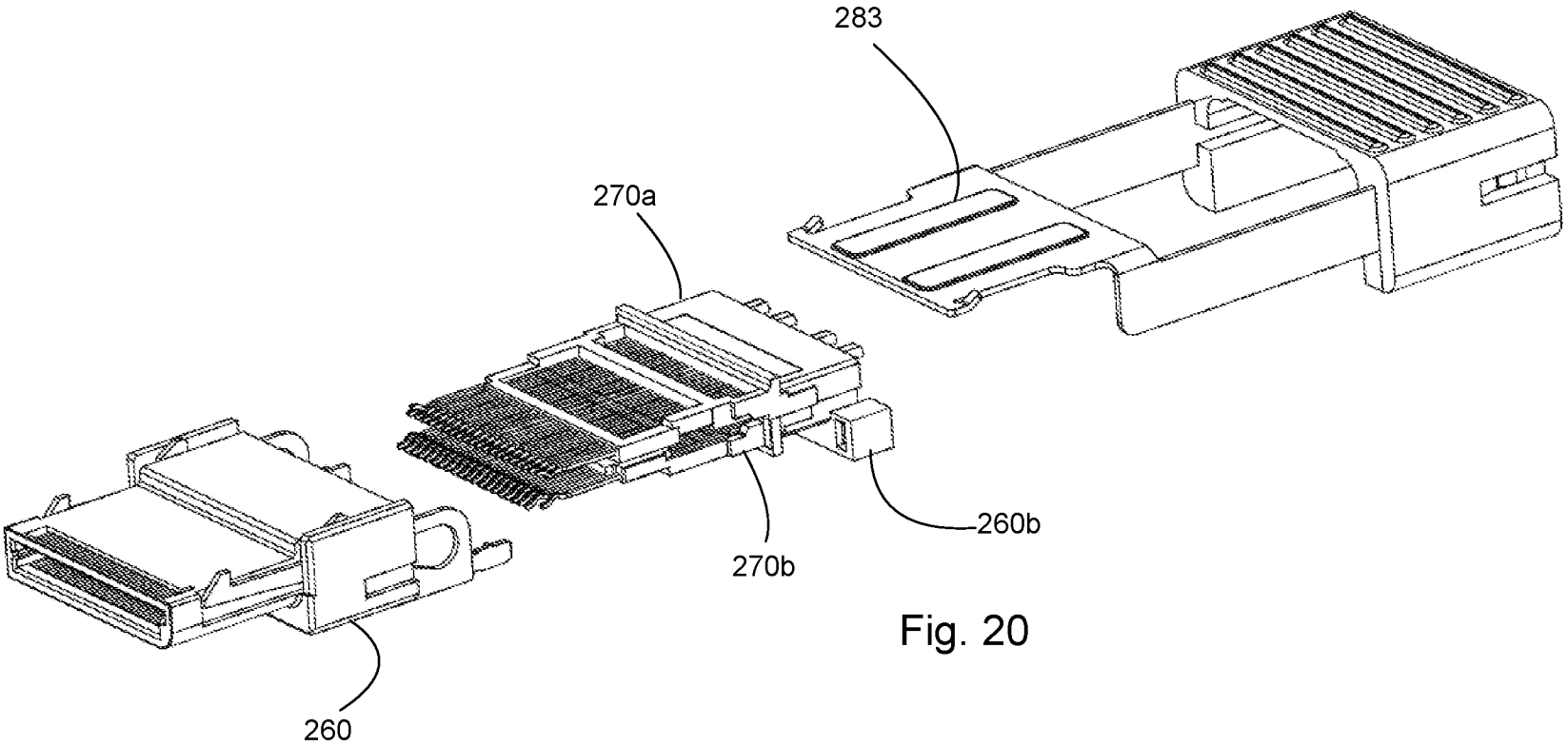
FIG. 20 illustrates an exploded perspective view of the embodiment depicted in FIG. 19.
Figure 21:
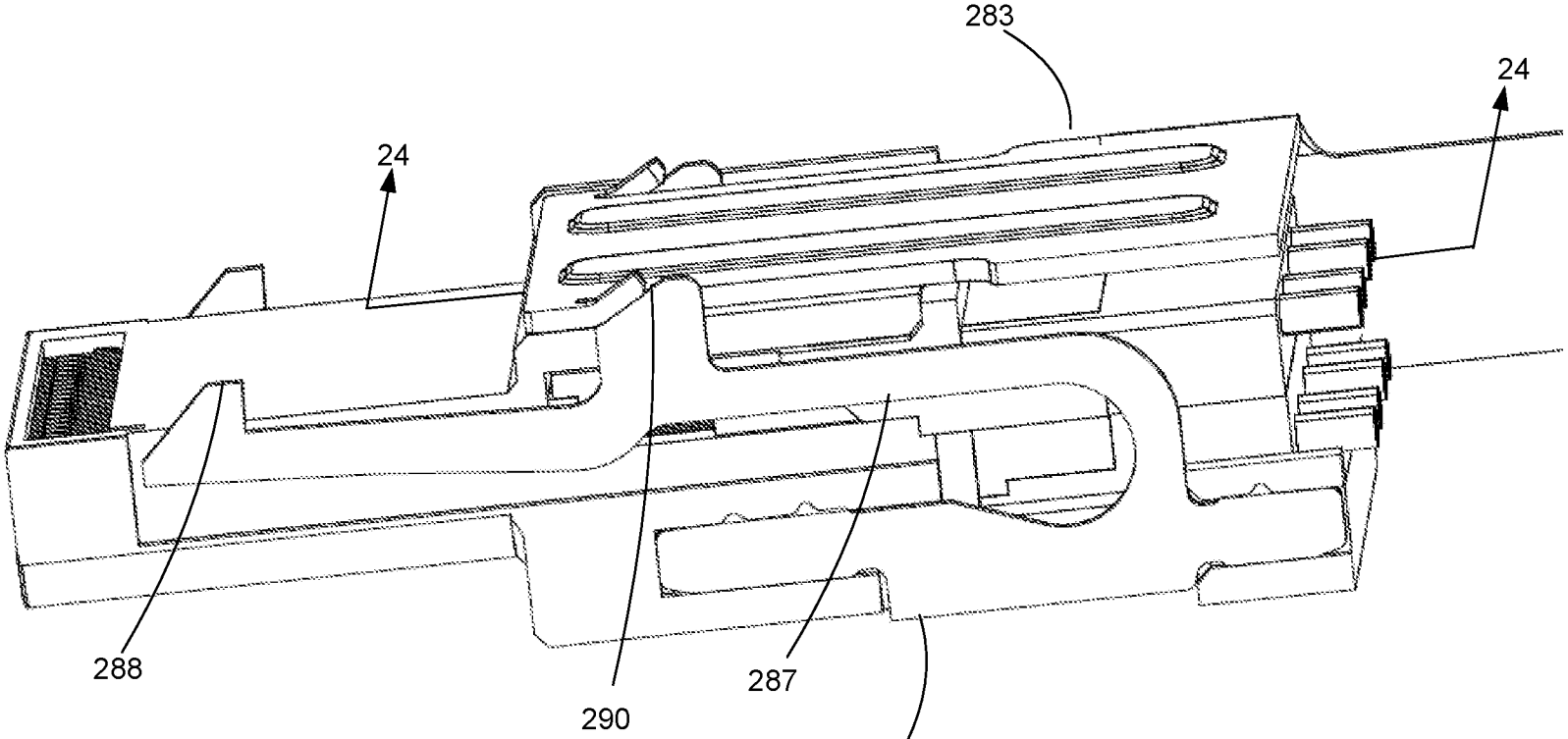
FIG. 21 illustrates a simplified perspective cross-section view taken along line 21-21 in FIG. 19.
Figure 22:
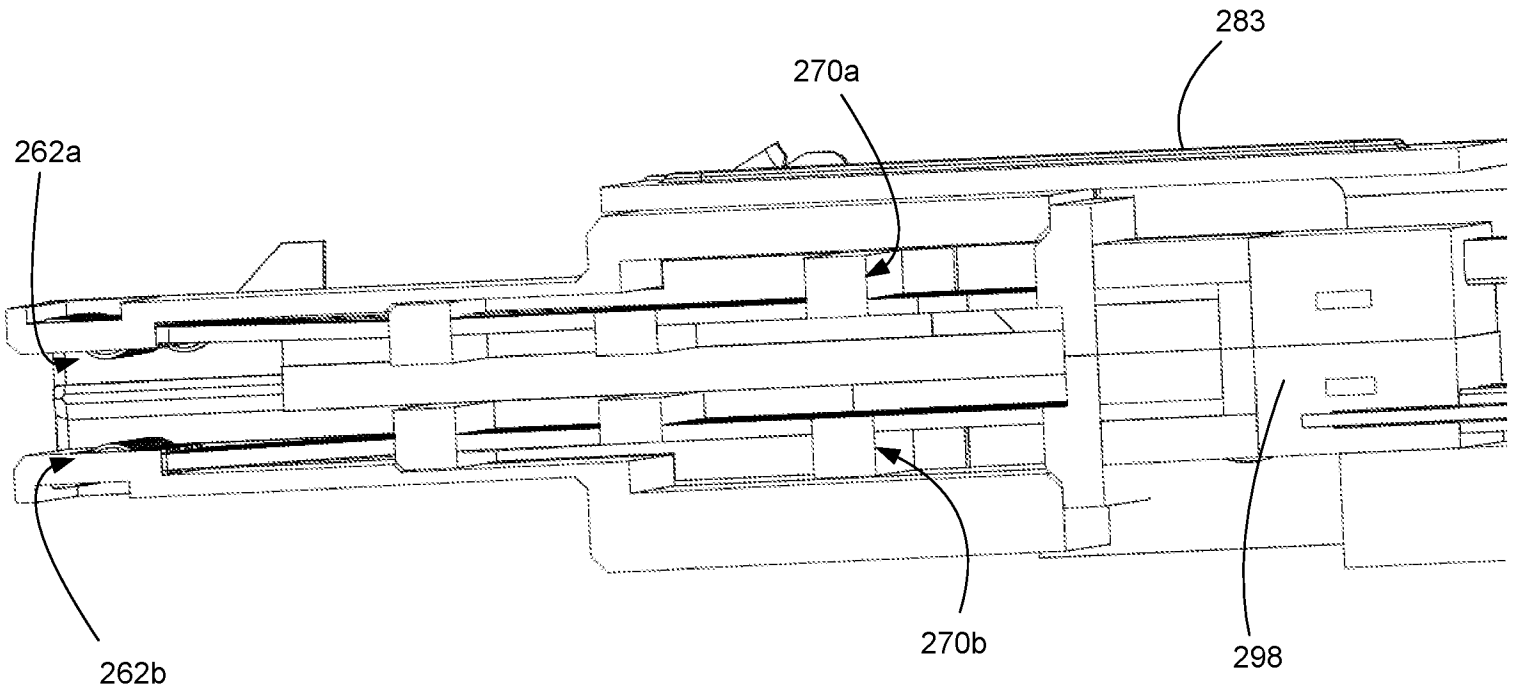
FIG. 22 illustrates a perspective cross-section view taken along line 22-22 in FIG. 19
Figure 23:
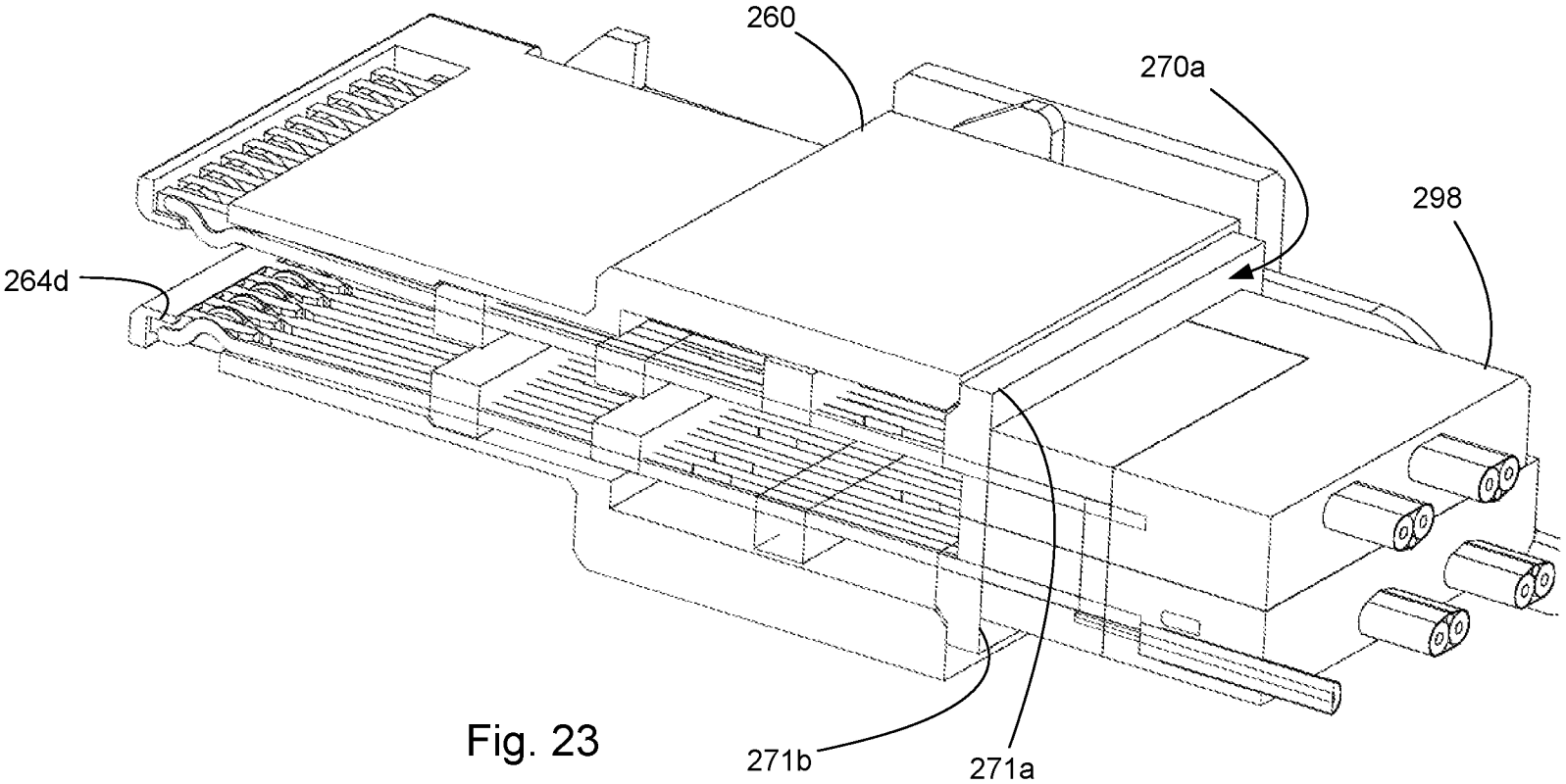
FIG. 23 illustrates another perspective view, further simplified, of the embodiment depicted in FIG. 22.
Figure 24:
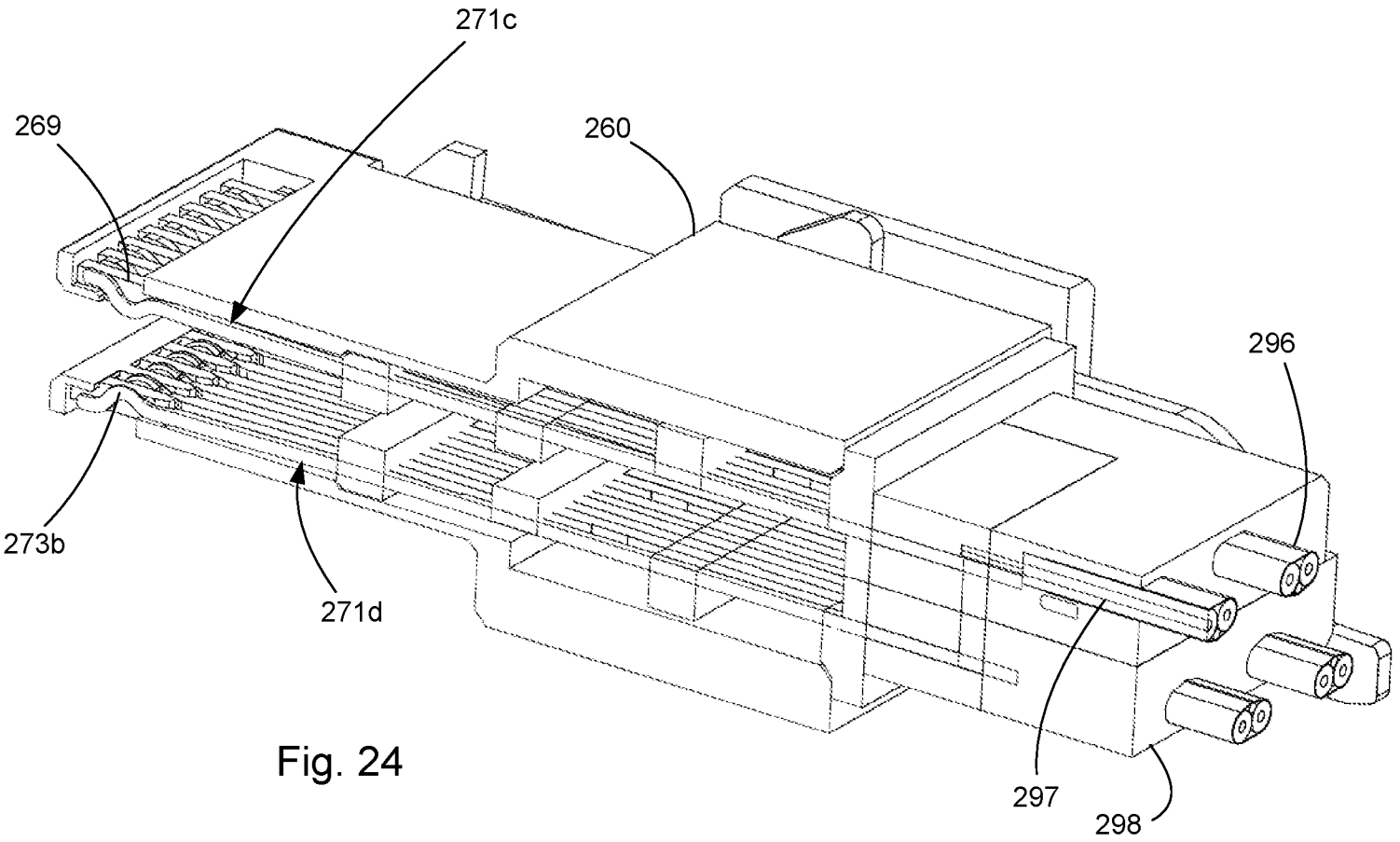
FIG. 24 illustrates a simplified perspective view of the embodiment depicted in FIG. 21.
Figure 25:
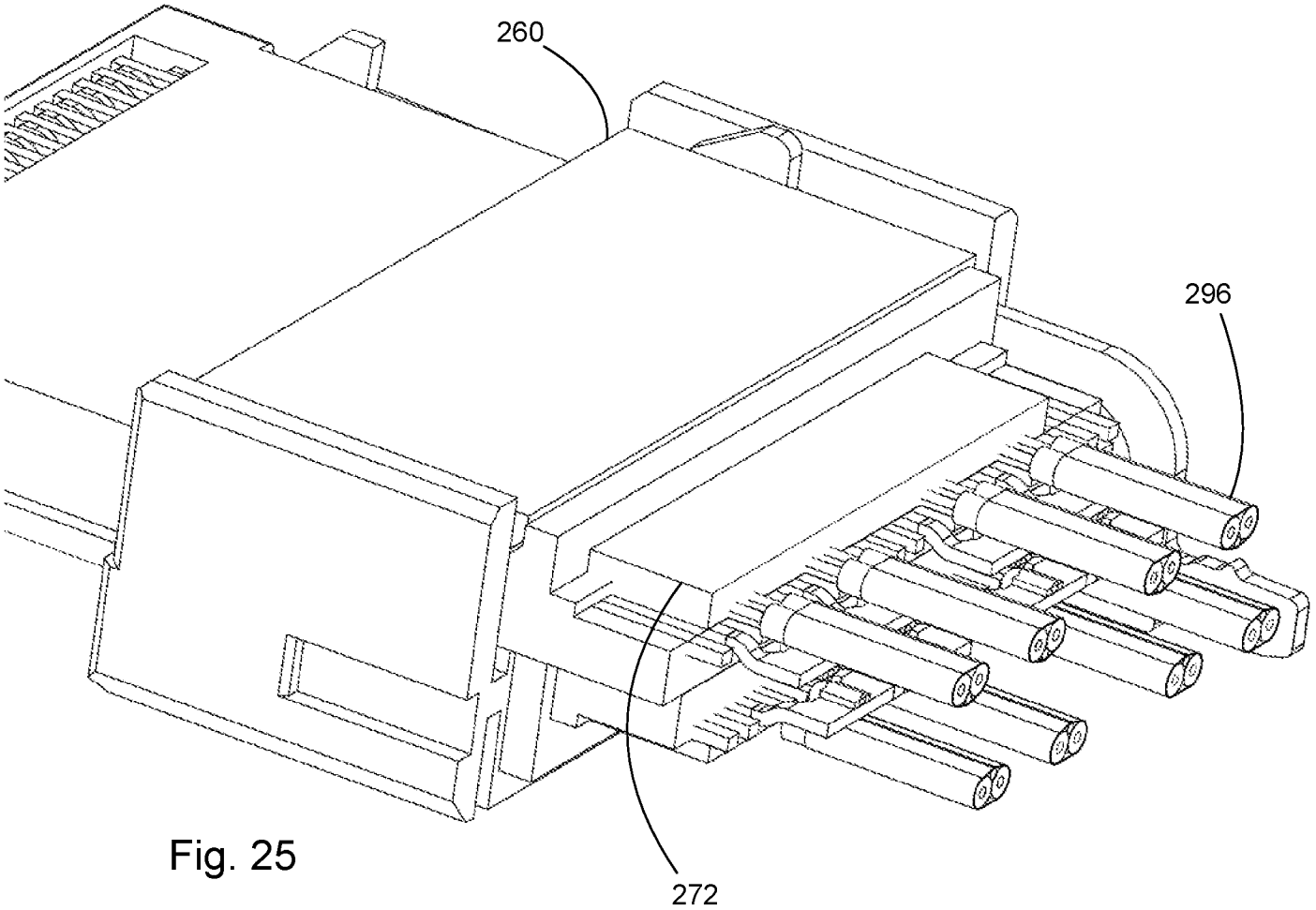
FIG. 25 illustrates a perspective simplified view of the embodiment depicted in FIG. 19.
Figure 26:
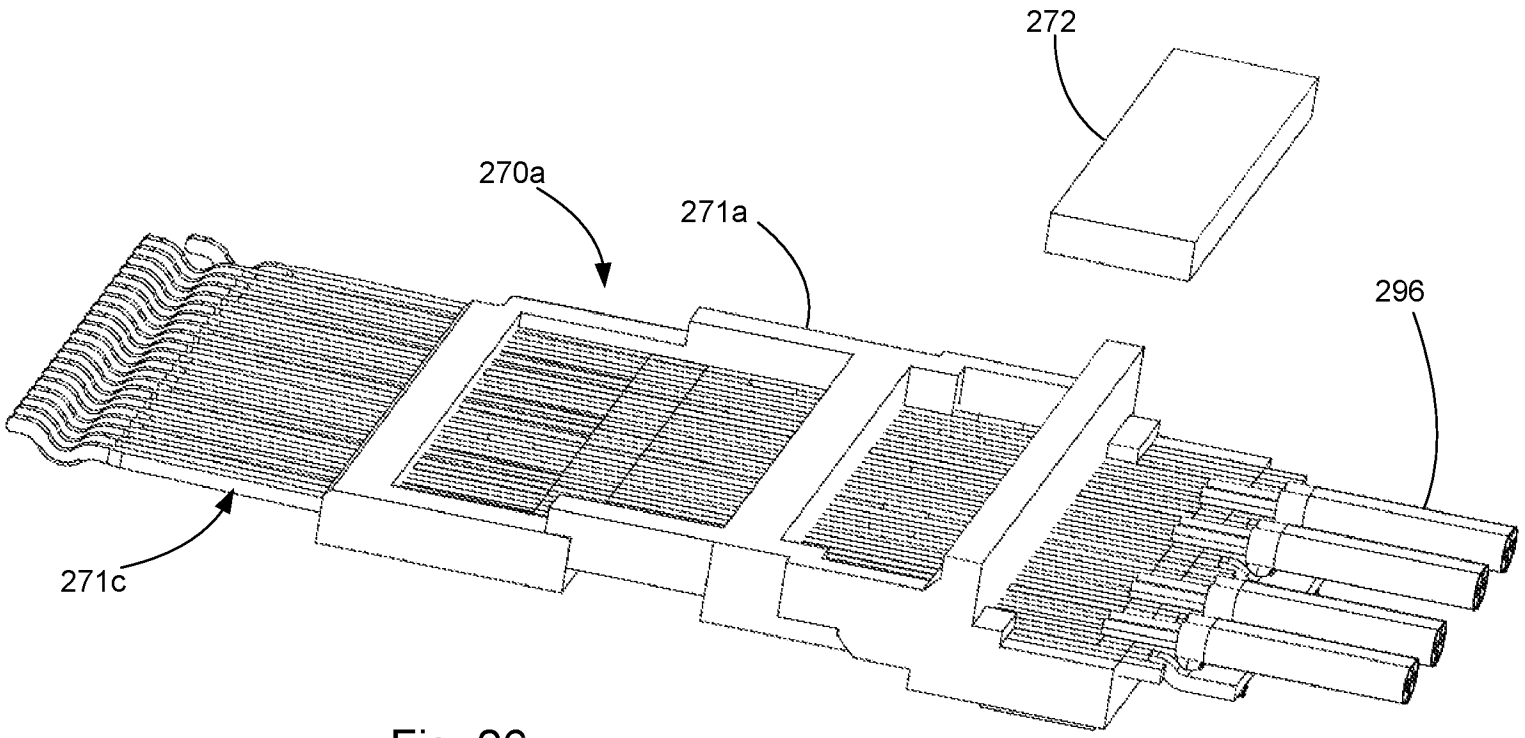
FIG. 26 illustrates a perspective view of an embodiment of a terminal frame.
Figure 27:
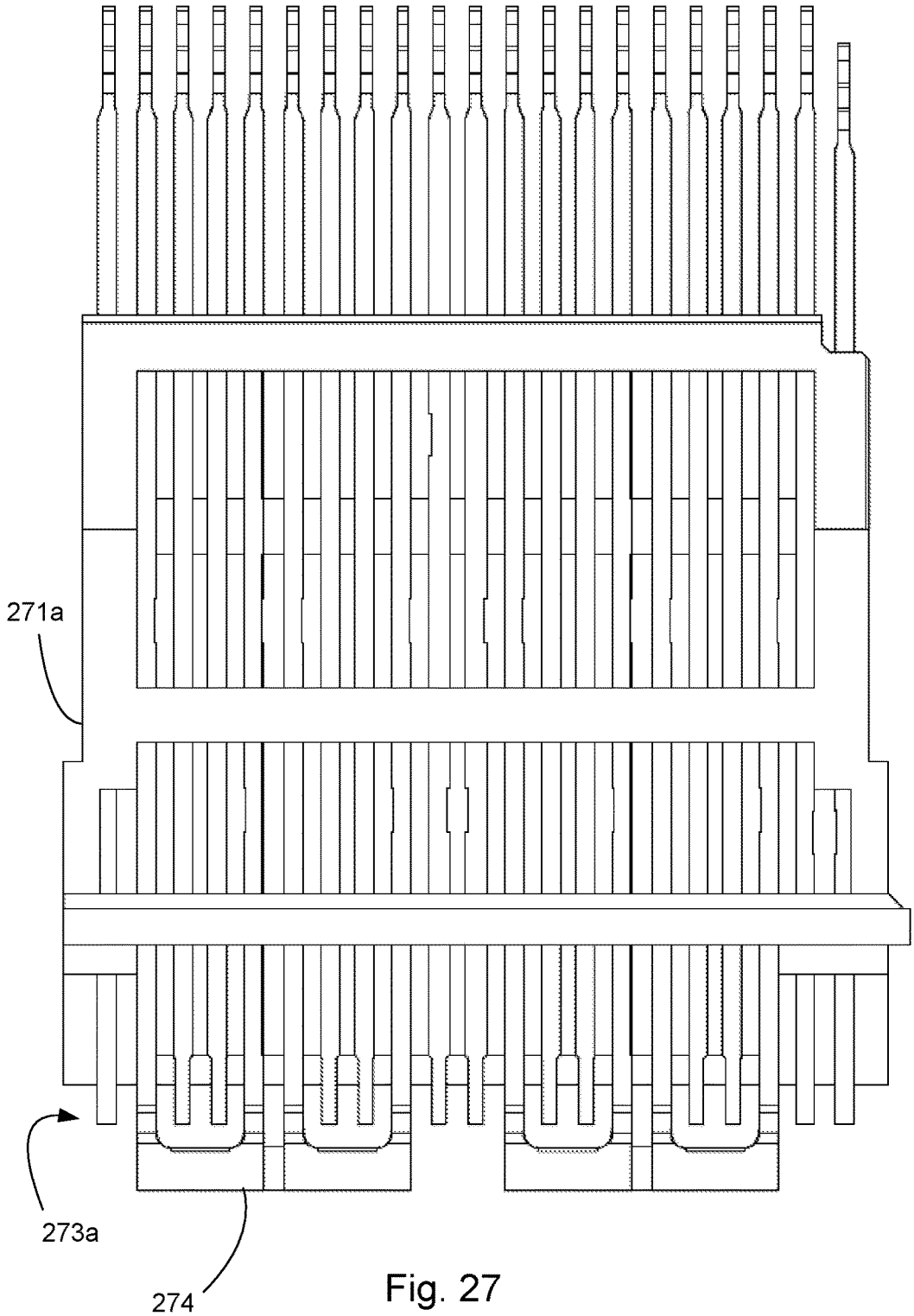
FIG. 27 illustrates a top view of an embodiment of a terminal frame.
Figure 28:
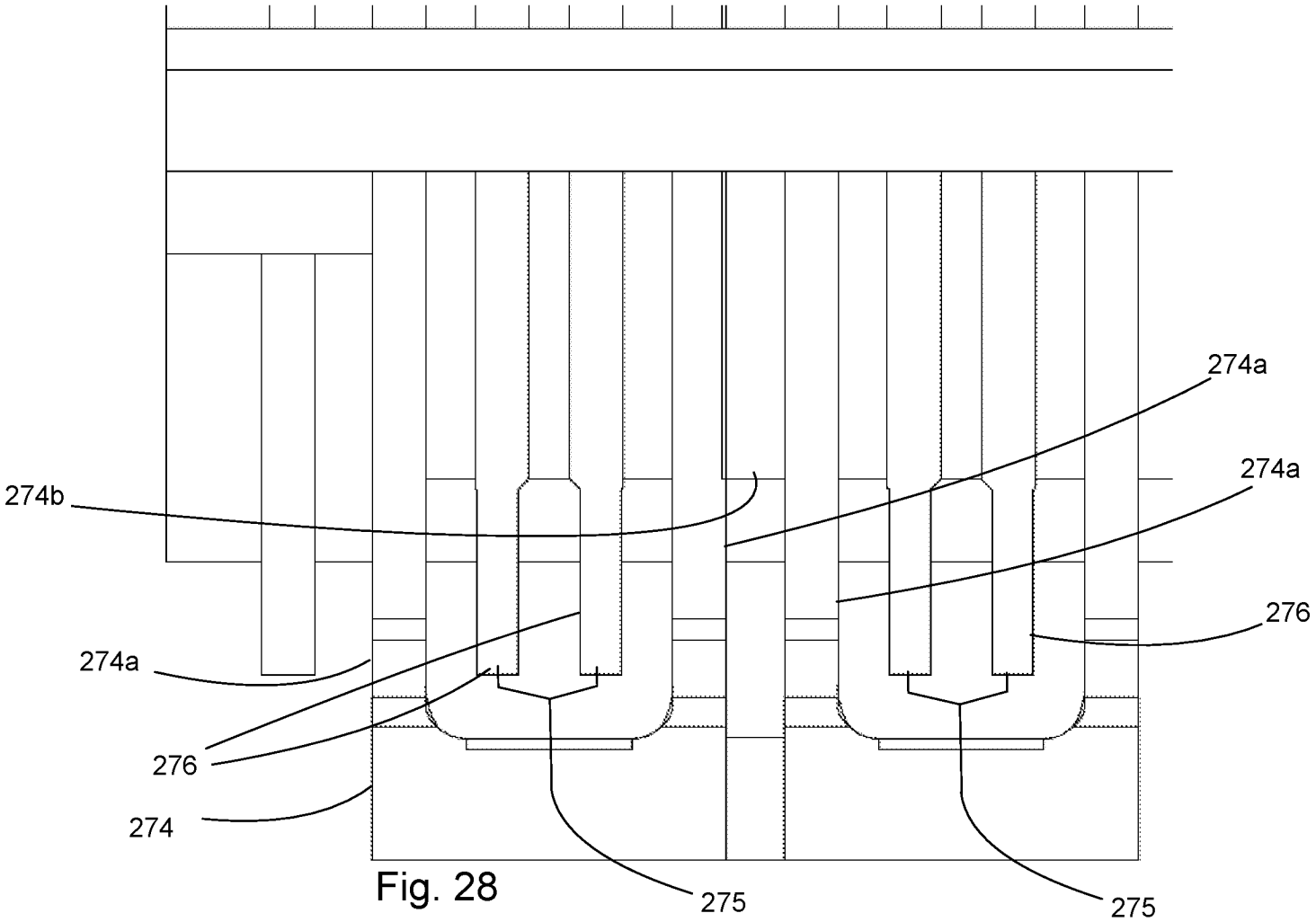
FIG. 28 illustrates an enlarged view of the embodiment depicted in FIG. 27.
Figure 29A:
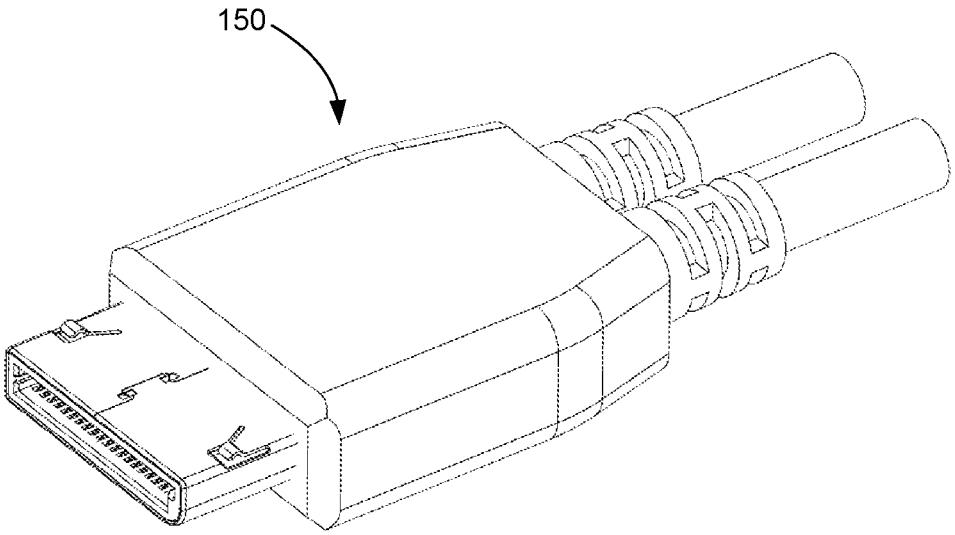
FIG. 29A illustrates a perspective view of an embodiment of a plug connector.
Figure 29B:
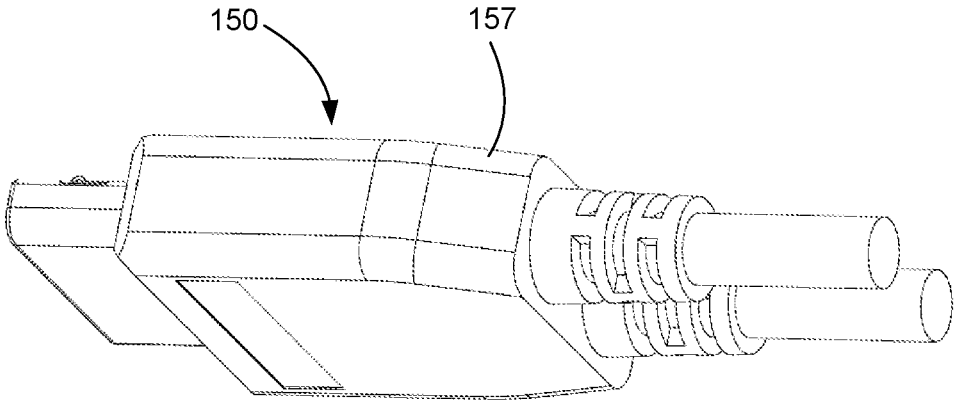
FIG. 29B illustrates another perspective view of the embodiment depicted in FIG. 29A.
Figure 30:
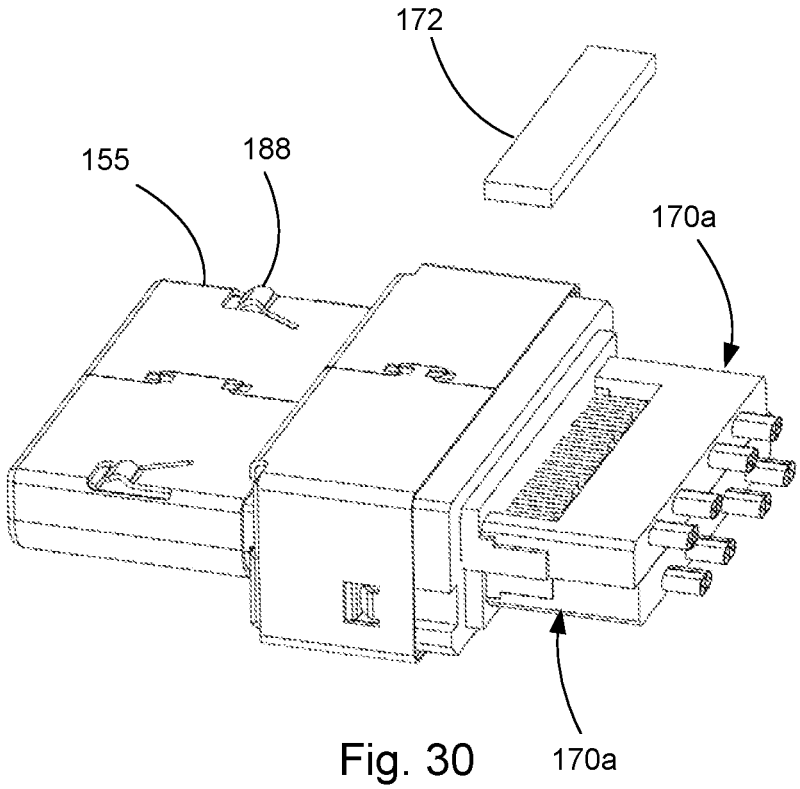
FIG. 30 illustrates a simplified perspective view of the embodiment depicted in FIG. 29A.
Figure 31:
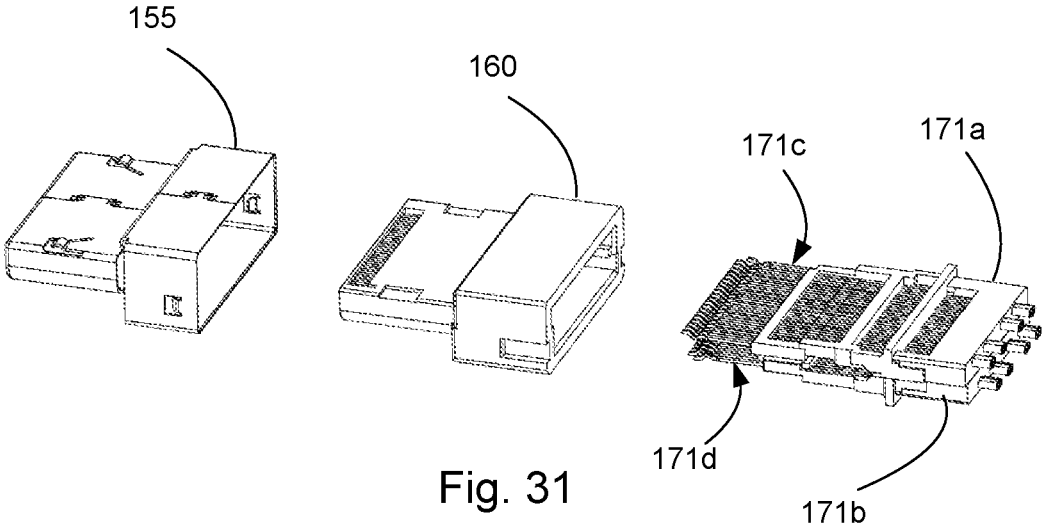
FIG. 31 illustrates a partially exploded perspective view of the embodiment depicted in FIG. 30.
Figure 32:
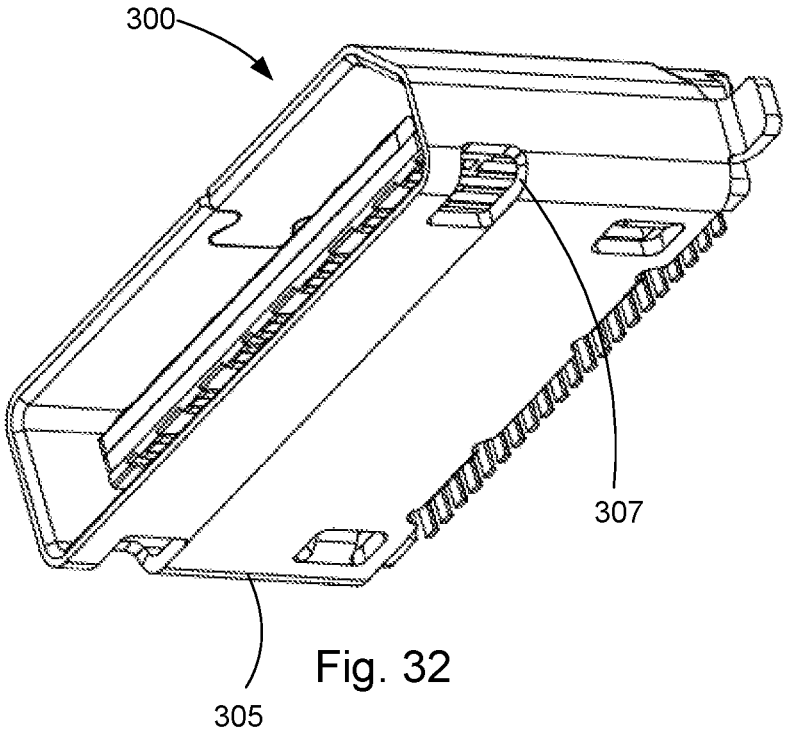
FIG. 32 illustrates a perspective view of an embodiment of a receptacle.
Figure 33:
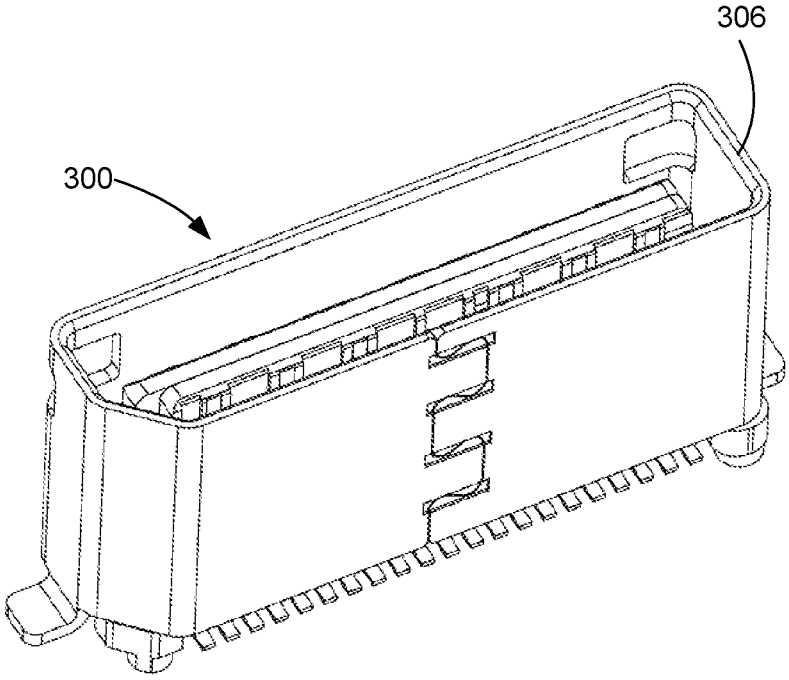
FIG. 33 illustrates another perspective view of the embodiment depicted in FIG. 32.
Figure 34:
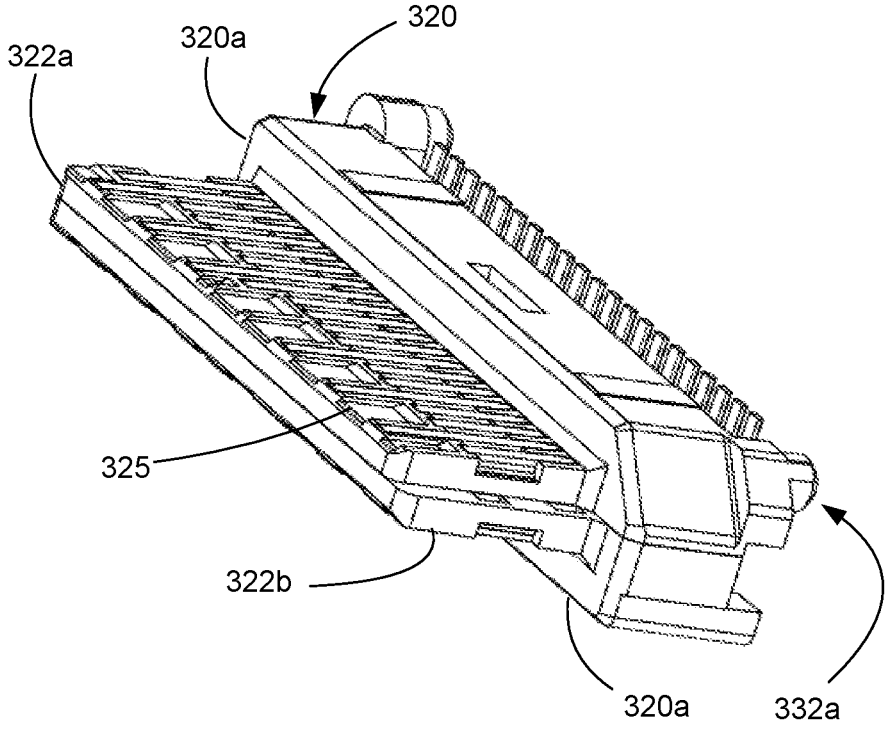
FIG. 34 illustrates a perspective view of an embodiment of a housing assembly suitable for use in the receptacle depicted in FIG. 32.
Figure 35:
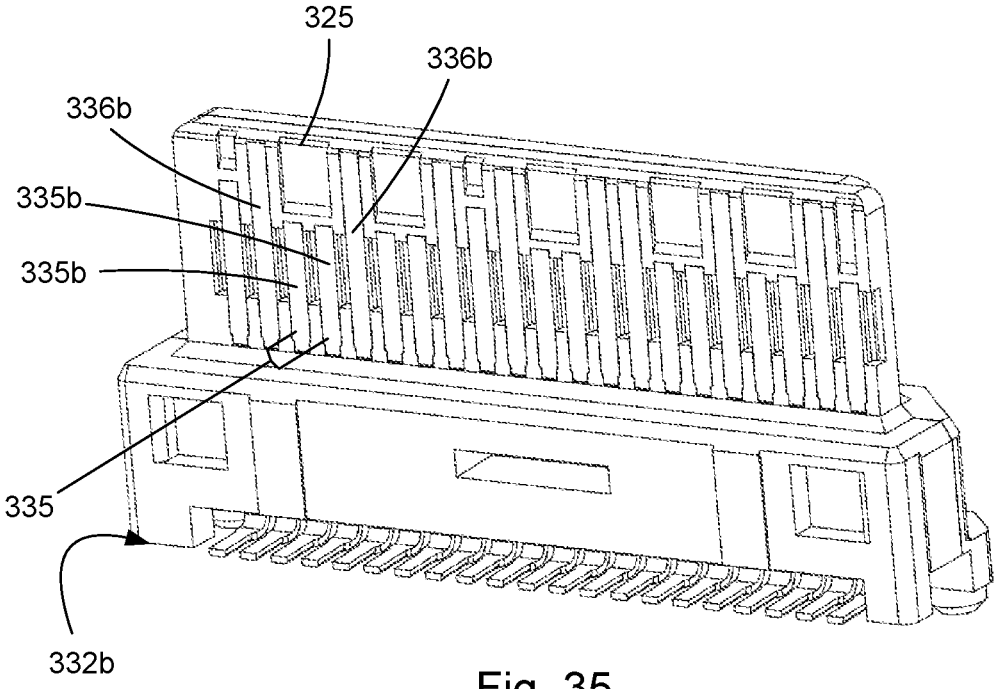
FIG. 35 illustrates another perspective view of the embodiment depicted in FIG. 35.
Figure 36:
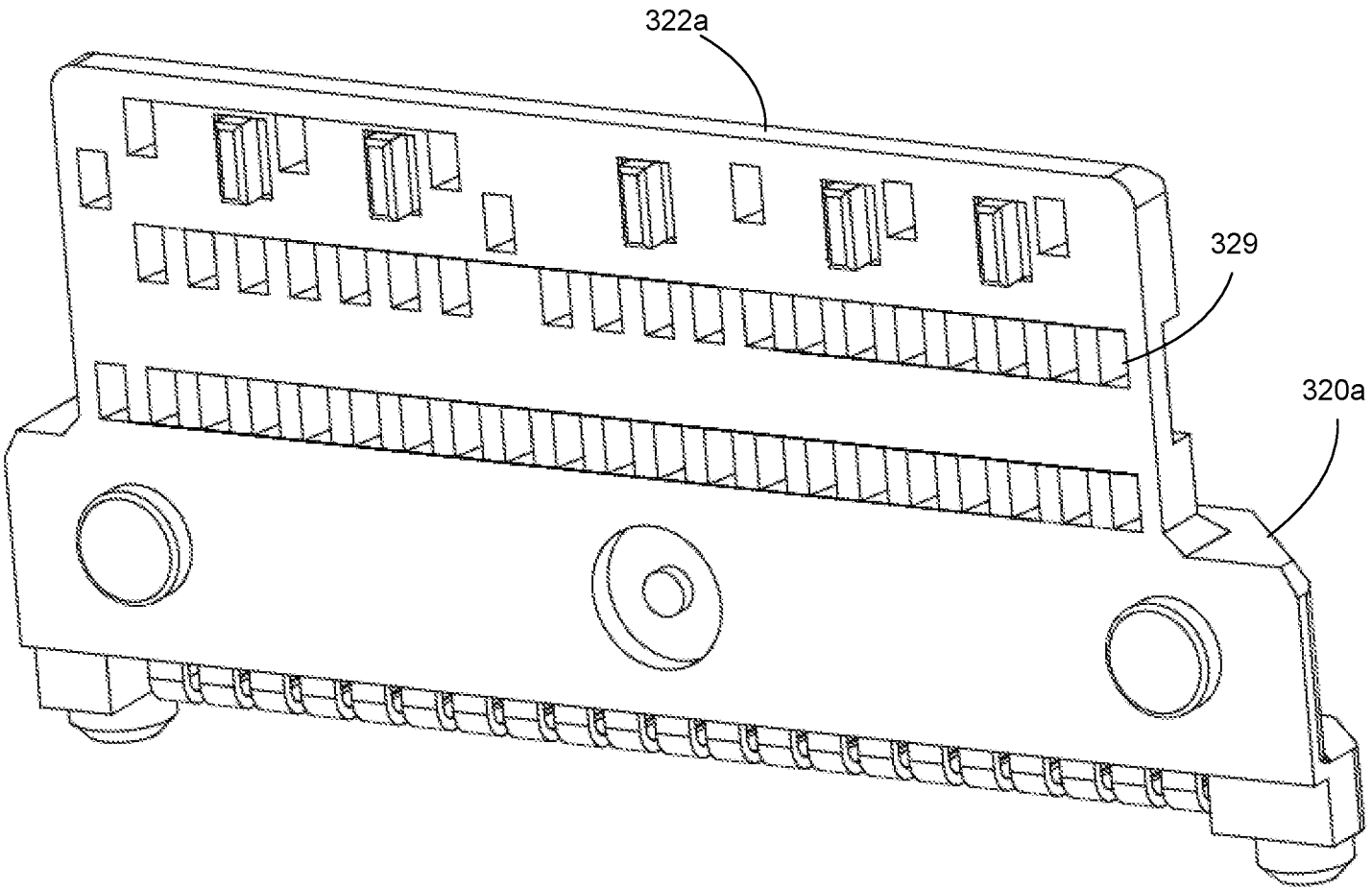
FIG. 36 illustrates a perspective view of an embodiment of a terminal frame.
Figure 37:
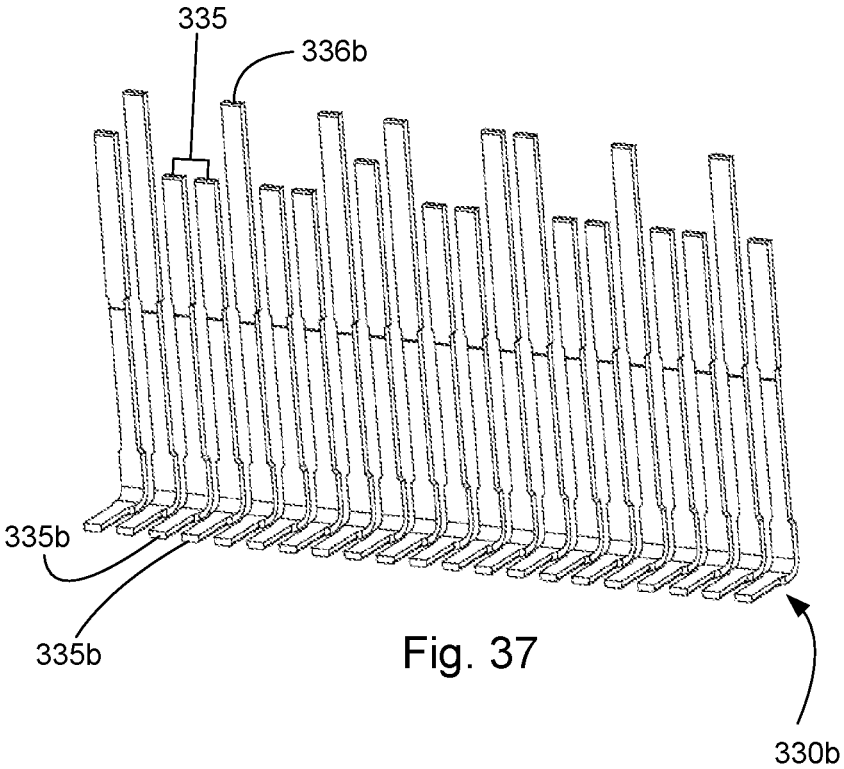
FIG. 37 illustrates a perspective view of an embodiment of a row of terminals suitable for use in a terminal frame.
Figure 38:
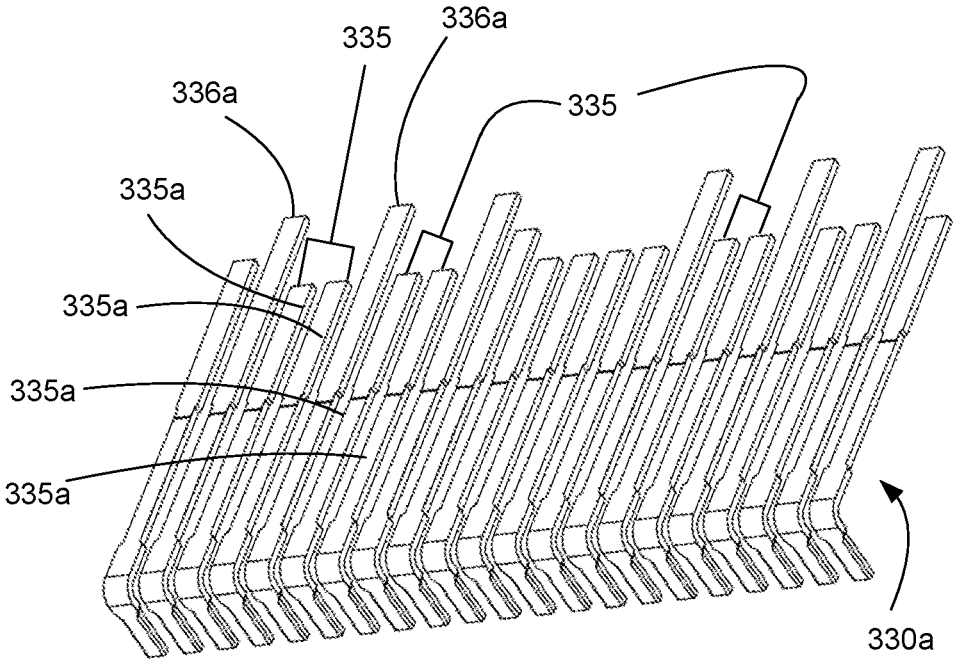
FIG. 38 illustrates a perspective view of another embodiment of a row of terminals.
Figure 39:
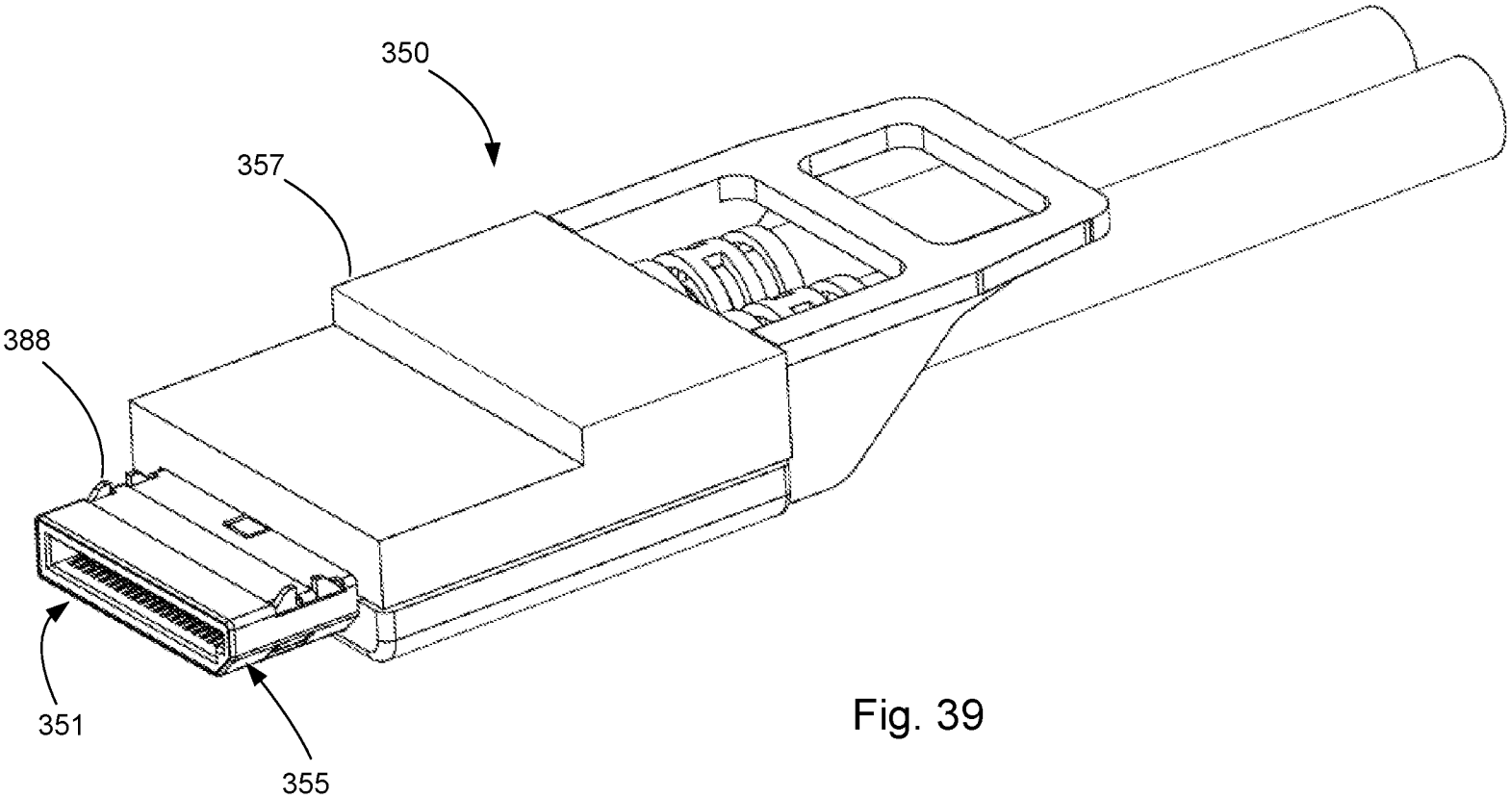
FIG. 39 illustrates a perspective view of an embodiment of a plug connector.
Figure 40:
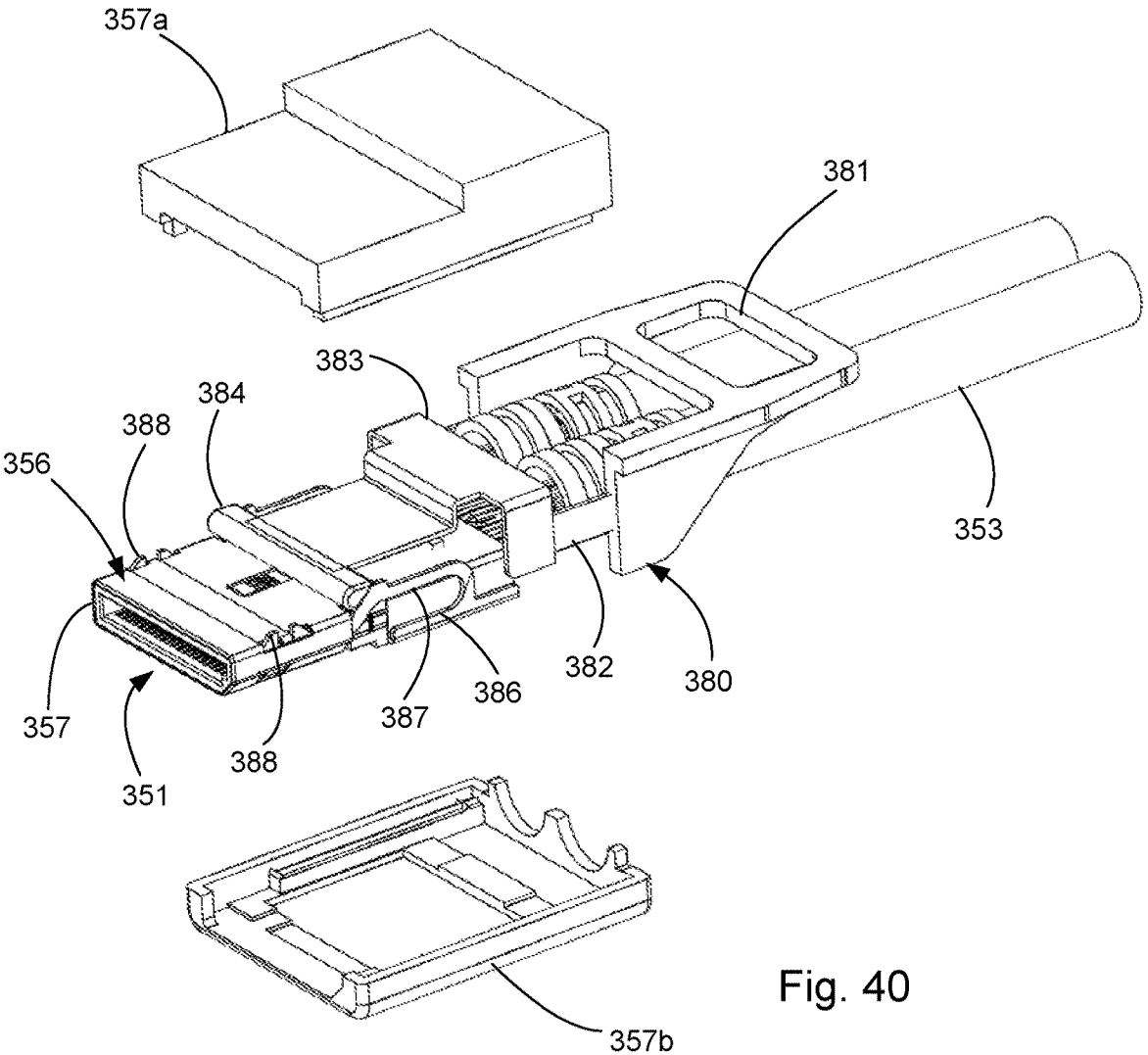
FIG. 40 illustrates an exploded perspective view of the embodiment depicted in FIG. 39.
Figure 41:
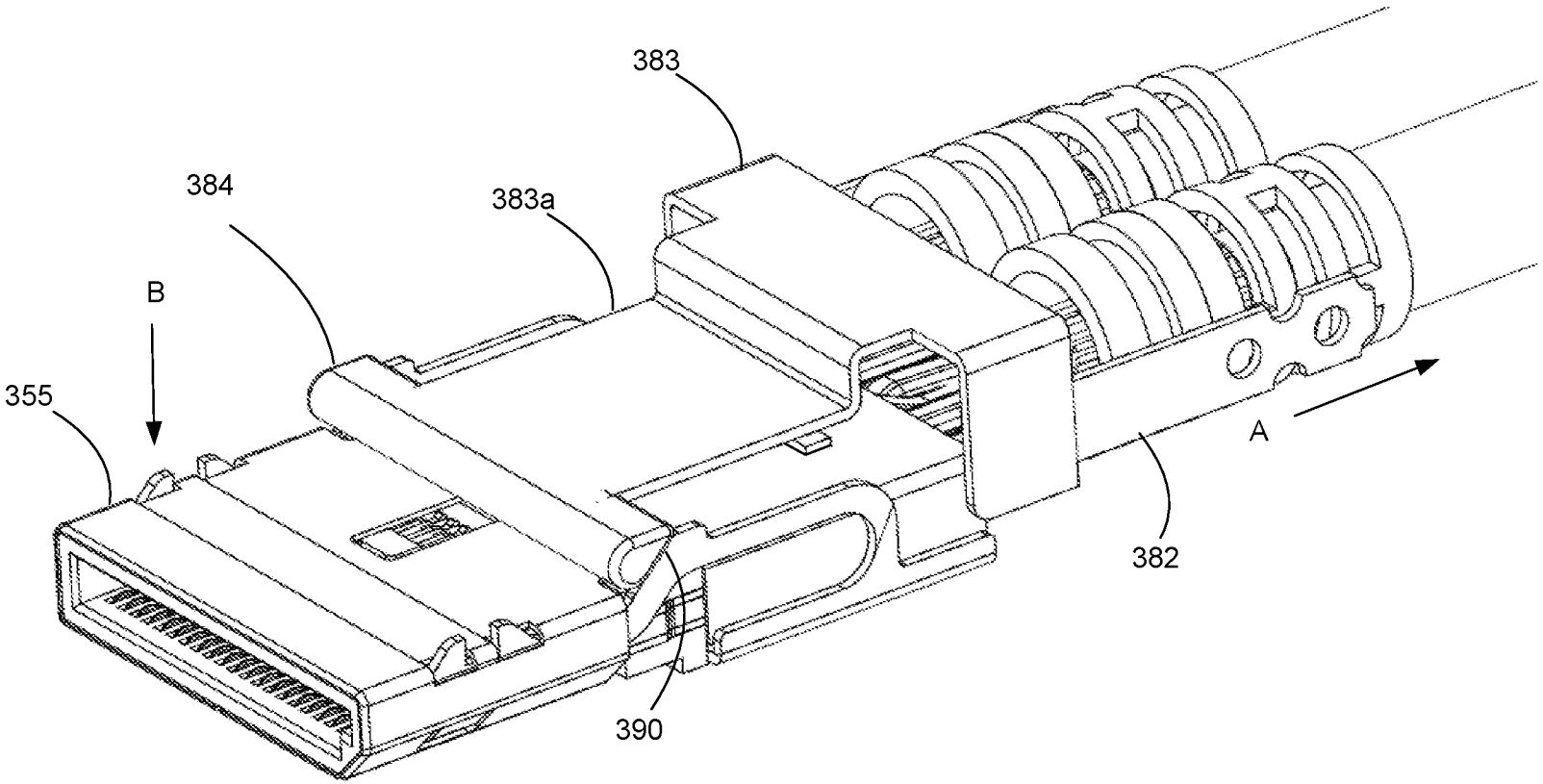
FIG. 41 illustrates a simplified perspective view of the embodiment depicted in FIG. 39.
Figure 42:
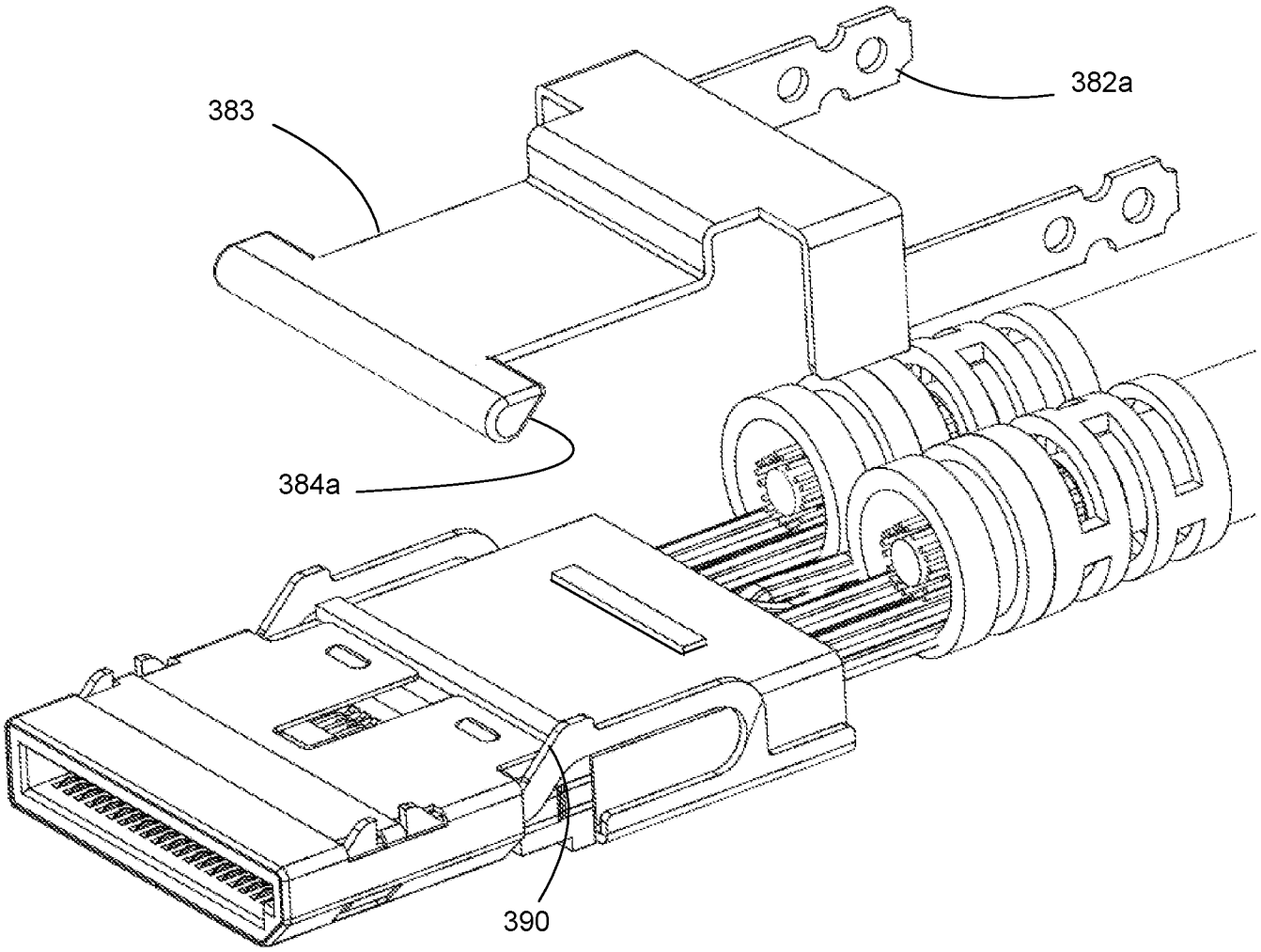
FIG. 42 illustrates a partially exploded perspective view of the embodiment depicted in FIG. 41.
Figure 43:
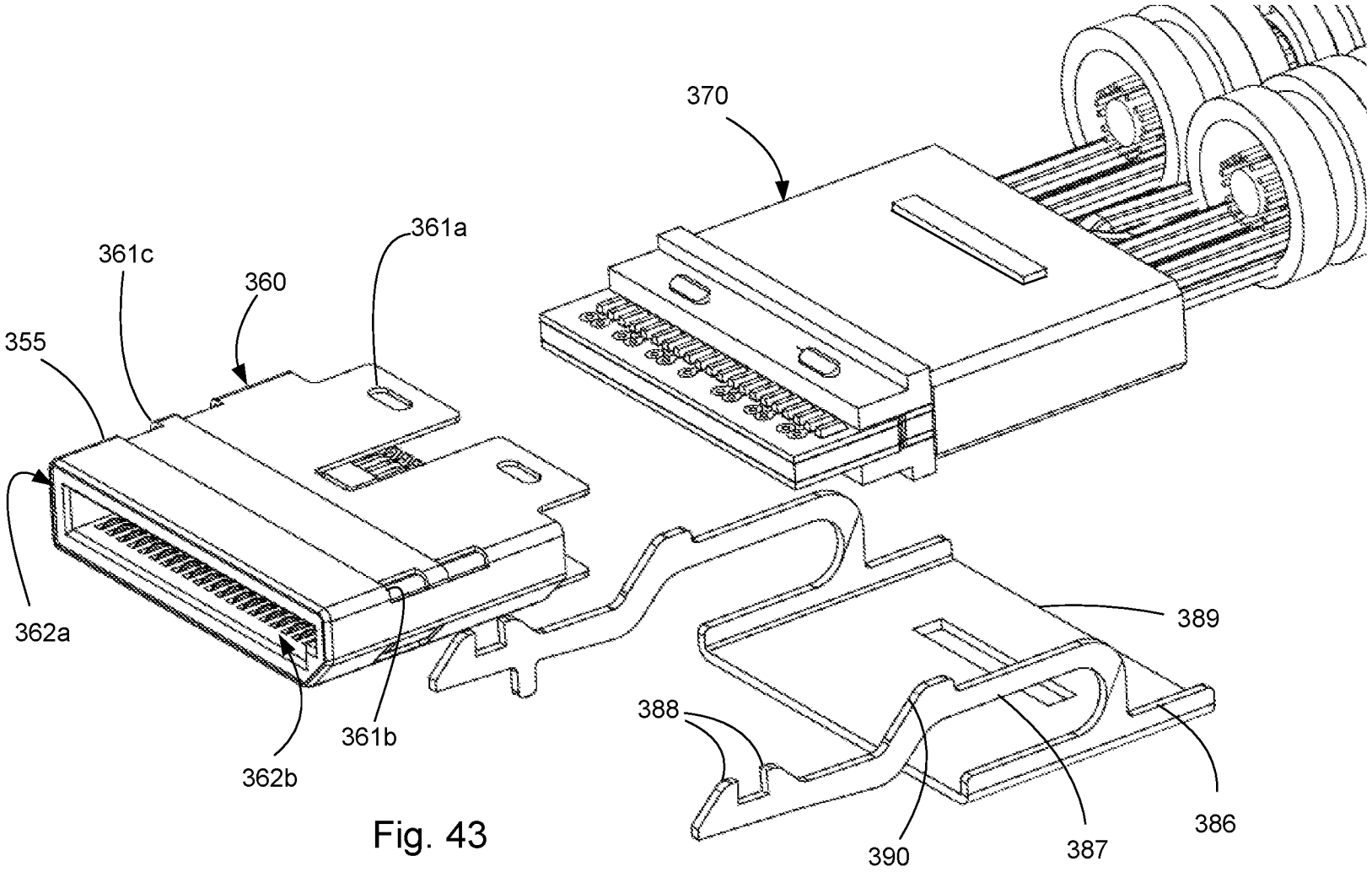
FIG. 43 illustrates a simplified partially exploded perspective view of the embodiment depicted in FIG. 42.
Figure 44:
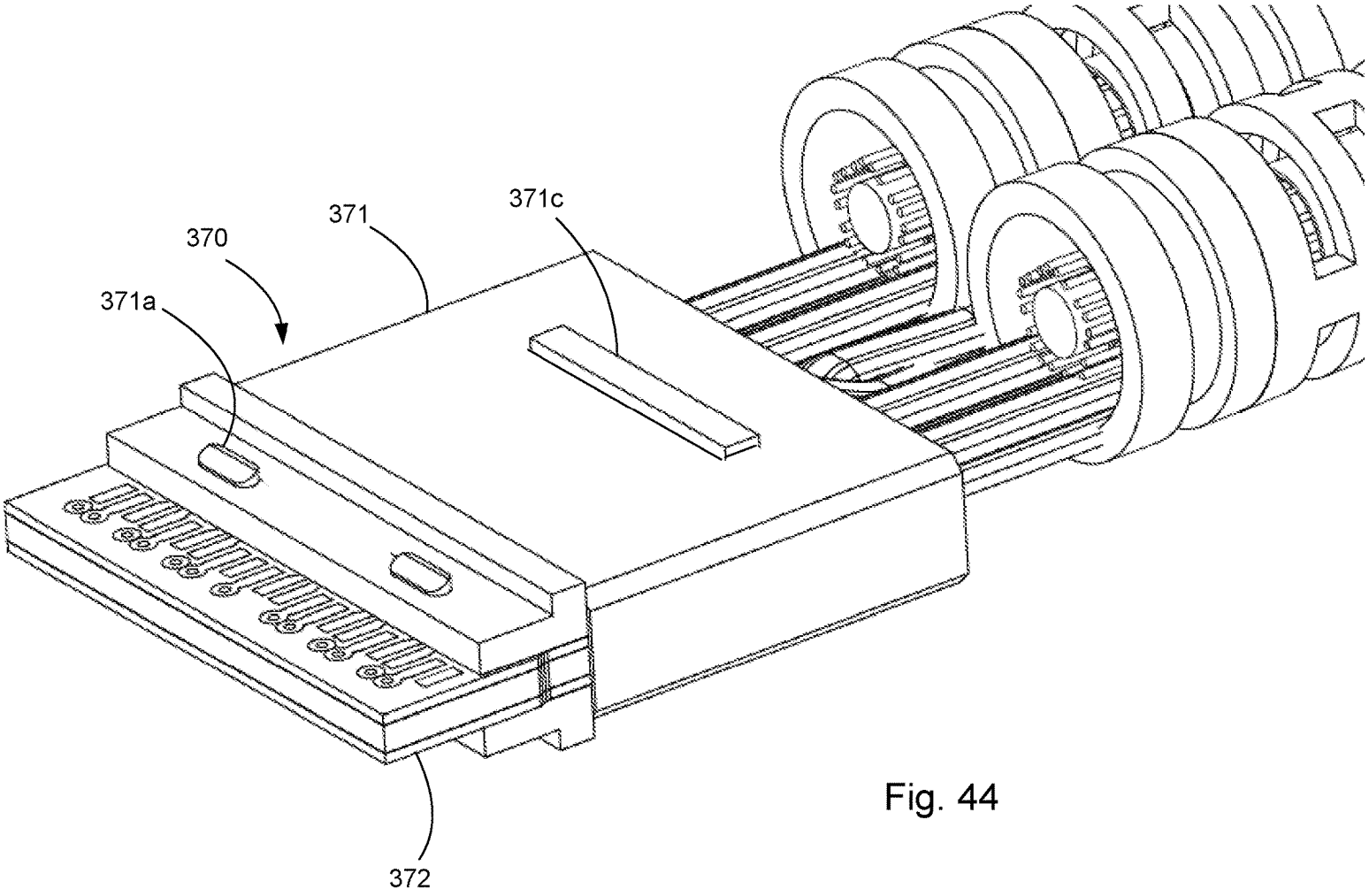
FIG. 44 illustrates a simplified perspective view of the embodiment depicted in FIG. 43.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

The enclosed Figs. illustrate various embodiments of connector systems. One embodiment is a connector system that provides a 4× connector. As used herein, the aggregate bandwidth of the port will be referred to as a channel. Thus, for a 4× connector, each port provides a channel with four transmit sub-channels (provided by four differential pair) and four receive sub-channels (provided by four differential pair). The connectors can be configured so that each pair can support 4 GHz signaling (PCIe Gen 3-8 Gbps), 8 GHz signaling (PCIe Gen 4-16 Gbps) and potentially even 12.5 GHz frequency signaling (which would be equivalent to a 25 Gbps data rate). Thus, each 4× connector can provide at least 32 Gbps channel (e.g., 32 Gbps transmitting and 32 Gbps receiving) using NRZ encoding. As can be appreciated, if the system uses PCIe Gen 4 signaling, the connector system can support 64 Gbps channels.

It should be noted that one issue with higher data rates is that the insertion loss over a meter of conductor increases as the frequency increases. There is, however, only a limited loss budget for each sub-channel (or the signal to noise ratio will be too small and signal will become unintelligible). Thus, a 25 Gbps stream, which would need to signal at a minimum frequency of about 12.5 GHz (the Nyquist frequency) and would tend to be evaluated at up to about 19 GHz in a NRZ encoding scheme is likely to be shorter than a communication channel that supports low frequency signaling, such as 16 Gbps (which would operate at about 8 GHz with NRZ encoding). It is expected that upper limit for conductor length at 25 Gbps will be about 7 meters and to ensure sufficient loss budget, probably will be capped at 5 meters. A 16 Gbps communication channel would tend to be okay at lengths up to between 7-10 meters and an 8 Gbps channel (which would operate at about 4 GHz in a NRZ encoding scheme) might be suitable for use in conductors that are 12 meters long. Of course, the above rough estimates depend on the gauge of wire being used and the type of conductor and is typical of copper based wires. Systems with better conductors (such as superconducting materials or graphene materials) would be more capable but tend to be more expensive. Thus, the competing demands for loss budget and data rate will tend to limit the system to using data rates not much more than 25 Gbps without either increasing the amount of encoding (so that lower frequencies can be used), using shorter cables or providing conducting medium that have substantially less loss per unit of length.

In an embodiment, the depicted system is intended to function at up to about 8 GHz (depending on the configuration) and the data rate will be limited by the encoding scheme used. For an NRZ encoding scheme, the depicted connectors are suited to provide sub-channels that can carry 16 Gbps of data. If other encoding schemes are used then some other data rate would be possible. For ease of discussion, however, it will be assumed that NRZ encoding is being used unless otherwise noted (it being understood that the type of encoding is not intended to be limiting unless otherwise noted).

It should be noted that conventional receptacle connectors include terminals that can deflect. As depicted herein, however, the receptacle connector refers to a connector that is configured to be mounted to circuit board but does not include terminals that need to substantially deflect. A plug connector could mate to the receptacle connector and would include terminals that deflect when mating with the receptacle connector. Naturally, it would also be possible to place terminals that deflect in the receptacle and provide stationary terminals in the plug connector. Thus, the ability of the terminal contacts to deflect or not deflect is not intended to be limiting unless otherwise noted.

The connector systems depicted herein, as noted elsewhere, include the ability to be scaled down to a 0.5 mm pitch. Prior connectors, such as micro-HDMI or micro-USB connectors, have provided terminals at such a pitch (or at 0.4 mm) but were unable to provide high data rates in a system that can function in a passive manner (e.g., they could not function without some kind of active components that could amplify/repeat the signal). For example, the above two referenced designs can offer data rates of up to about 2.5 Gbps per sub-channel. The depicted designs, however, can readily provide data rates of greater than 5 Gbps per sub-channel. Specifically, the depicted connector designs can support 8 Gbps or 16 Gbps in a PCIe system using NRZ encoding in a passive manner and the embodiments depicted in FIGS. 16-28, due to the use of the double ground terminals, between adjacent differential pairs, could support a data rate of 25 Gbps using NRZ encoding in a passive manner. As can be appreciated, the depicted designs can be configured to include at least 8 sub-channels (four on each side) but could be made smaller or larger, depending on the application.

It also has been determined that to enable the desired impedance in the terminals, the terminal stock preferably should be less than 0.13 mm thick (e.g., 5 mil or thinner stock). Otherwise it becomes problematic to provide the desired impedance in a terminal that can be reliably mated to another 0.5 mm pitch terminal. Thus, the depicted terminal designs are preferably formed with stock that is less than 0.13 mm thick.

Turning to the Figs., a connector system 10 includes a receptacle connector 100 that is mounted to a circuit board 20 and can receive a plug connector with an active or passive latch. Specifically the shell 105 includes a locking aperture 107 that can engage an active latch or a passive latch. The receptacle 100 is configured to provide a 4× connector (e.g., 4 transmit channels and 4 receive channels) and as can be appreciated from the disclosure that follows, variations in the design of the receptacle are possible. A plug connector 150 illustrates an embodiment of a plug connector with a passive latch, specifically a plug shell 155 with a passive latch finger while plug connector 250 illustrates an embodiment of a plug connector with an active latch, specifically a plug shell 255 with an active latch finger 257 that is actuated by translation of latch arm 282, which is part of an actuation assembly 280.

One substantial benefit of the depicted design, as noted above, is that it can be made much smaller than existing designs. More specifically, the terminals can be arranged at 0.5 mm pitch while still providing up to 16 Gbps per sub-channel. Thus, the depicted connector designs can simultaneously transmit and receive up to 64 Gbps of data while providing a cage that is less than 14 mm wide by 4 mm tall. The terminals can be configured to be about 0.2 mm to more than half the pitch (e.g., greater than 0.25 mm) wide so as to provide sufficient landing space (thus making the issue of stack-up and tolerances more manageable). In that regard, it has been determined that a smaller terminal would make the electrical performance much easier to manage on a pitch of less than 0.6 mm. Smaller terminals, however, provide an undesirable mechanical interface. Therefore, it was determined beneficial to keep the larger terminals even though the electrical performance was less easily obtained. To manage impedance, it was further determined that a thin stock would be helpful and thus it was determined that it would be preferred to use a thin stock (something less than 0.13 mm). By adjusting the terminal size and the plastic it was determined that the connector terminals can be tuned so that return loss is less that 12.5 dB up to the Nyquist frequency of 4 GHz and potentially 8 GHz while cross talk is at least 36 dB down over the same frequency(ies). Further details can be appreciated from a review of the Figures.

FIGS. 3A-15 illustrate features of an embodiment of a receptacle 200 that can be provided with terminals at a 0.5 mm pitch while supporting 8 Gbps and 16 Gbps data rates for each sub channel using NRZ encoding. The receptacle 200 includes a shell 205 with a front edge 206 that defines a port 202 and includes a locking aperture 207 and a plurality of feet 209. It should be noted that the number of feet provided can vary but it is desirable to have at least one foot 209 so as to have a means of grounding the shell 205. The shell 205 can include a joining line 209 that helps secure the shell 205 to a housing assembly 220. The receptacle 200 includes a first row of tails 232*a* and a second row of tails 232*b* and both rows of tails can be on a 0.5 mm pitch.

The housing assembly 220 includes a first terminal frame 220*a* and a second terminal frame 220*b* that are configured to be secured together. The two frames can include interlocking features or can be aligned and adhered together with an adhesive or any other desirable mechanism for securing the terminal frames 220*a*, 220*b* together can be used.

The first terminal frame 220*a* includes a first tongue 222*a* and can include optional side wings 224*a* that can help protect terminal array 230*a* supported by the first terminal frame 220*a*. The first tongue 222*a* includes impedance notches 225 provided on the tongue 222*a* adjacent differential pairs 235 that are formed by first signal terminals 235*a*. The terminals array 230*a* can be partially supported by terminal support 226 that includes comb fingers 227. If a terminal support 226 is used, then flanges 223 can be used to secure the terminal support 226 to the first terminal frame 220*a*. Because of the short distance the terminals travel, it is generally not necessary for the terminal support 226 to vary the material in an attempt to selectively adjust the impedance of the terminals in the terminal array 230*a*. Instead, tuning can be accomplished in the tongue 222*a* with the impedance notch 225 and cutouts 229.

A second terminal frame 220*b*, which is configured to mate to the first frame 220*a*, includes a second tongue 222*b* with impedance notches 225 adjacent second signal terminals 235*b*. As can be appreciated, the terminal frames can include features that allow the first and second terminal frames 220*a*, 220*b* to be married so as to form the housing assembly 220 or they can be coupled together with adhesives or heat staking or the like. The second frame 220*a* includes signal terminals 235*b* that form differential pairs 235'. Both terminal frames 220*a*, 220*b* are insert-molded around the terminals arrays, as can be appreciated from FIGS. 12-13, and can include features such as a tongue and groove that allow the terminal frames 220*a*, 220*b* to be held together. This allows the terminal array 230*a* to provide the row of tails 232*a* and the terminal array 230*b* to provide the row of tails 232*b* and both terminal arrays 230*a*, 230*b* include shorter signal terminals 235*a*, 235*b* that are separated by longer ground terminals 236*a*, 236*b*. As can be appreciated, the longer ground terminals extend along both sides of the impedance notch 225.

FIGS. 16-28 illustrate an embodiment of a plug connector 250 with an active latch 280 and with terminals at a 0.5 mm pitch while supporting 8 Gbps and 16 Gbps data rates for each sub channel using NRZ encoding. The plug connector 250 includes a body 257 that can be overmolded and includes a plug shell 255 with a front edge 257 that defines an engaging port 251. The active latch 280 includes a latch finger 288. When a grip 281 moving in a first direction A (which can be a substantially horizontal), the latch finger 288 moves in a second direction B (which can be a substantially vertical direction). It should be noted that the depicted design shows the grip moving in the A direction but the active latch 280 could also be configured to move in the opposite direction.

The active latch 280 functions by having the grip 281 coupled to legs 282 that are mechanically linked to plate 283. Plate 283 has fingers 284 that engage arm 287 and cause the arm 287 to deflect, thus causing the latch finger 288 to translate. To help provide a reliable latching mechanism, the arms 287 are supported by a base 285, which can have flanges that are press fit into the plug housing 260. The active latch 280 is configured so that it is partially contained within plug shell 255 and the latch finger 288 extends out of a latch aperture 261. As can be appreciated, the fingers 284 are configured to engage surface 290 so that translation of the plate 283 relative to the arm 287 causes the arm 287 to translate. Thus, the depicted configuration is not required.

The arm 287 is supported by plug housing 260, which includes a front opening 260*a* with sides 264*a*, 264*b*. The sides 264*a*, 264*b* can include features that provide orientation and alignment control and help ensure the plug connector is inserted in the proper orientation. The plug housing 260 also supports terminal frames 270*a*, 270*b* and can include a collar 260*b* that helps secure the terminal frames in position.

The terminal frame 270*a*, which includes frame 271*a* that supports terminal array 271*c* and terminal frame 270*b*, which includes frame 271*b* that supports terminal array 271*d*, are configured to be inserted into the plug housing 260 so as to provide a row of contacts 262*a*, 262*b* adjacent the front opening 260*a*. Thus, the contacts 273*b* of the terminal arrays 271*c*, 271*d* are position in terminal grooves 269 and are retained by groove lip 264*d* while the tails 273*a* are configured to be used to terminate the cables. The frame 271*a* that supports a terminal array 271*c* and includes an impedance block 272 that acts to lowers the dielectric constant. The impedance block 272 can, for example, be provided by using a foam-like material that offers a lower dielectric than conventional resins used for insert molding as it is not required to have a structural functionality and is placed adjacent the termination between the cables and the terminals. Cables 296, which include conductors 297, are secured to the tails 273*a* of the corresponding terminals. Specifically, signal carrying conductors 297 can be soldered to signal terminals 276 of the terminal frames 270*a*, 270*b* so as to provide differential pairs 275 while the shield (and any drain wires provided in the cable) can be connected to the ground terminal 274. As depicted, the ground terminal 274 includes two terminals 274*a* that are joined together at the point where the cable is terminated to the ground terminal 274. This provides a more balanced signal propagation and transition from the cable to the terminals. Terminals 274*a* that are positioned side by side between differential pairs 275 can be further joined together by bridge 274*b* if desired. It should be noted that the use of double grounds, which is depicted but is optional, allows for higher data rates such as 20 Gbps or 25 Gbps.

While terminal frame 270*a* is depicted, terminal frame 270*b* can be configured similarly to terminal frame 270*a* and can include an impedance block as well, but can be orientated opposite terminal frame 270*a*. Once the impedance block 272 is in place, a retention block 298 can be molded in place and, as can be appreciated, the retention block 298 helps protect the solder connection used to terminate the conductors to the terminals and can provide strain relief for the cables.

FIGS. 29A-31 illustrate an embodiment of a plug connector 150 that is similar to plug connector 250 but plug connector 150 has a latch fingers 188 that are configured to engage a mating receptacle with friction but does not engage the receptacle in a locking manner and thus provides an embodiment of a plug connector with a passive latch system.

Thus, plug connector 150 has a construction that is similar to the construction of plug connector 250 in that it has a plug shell 155 that is positioned around a plug housing 160 and terminal frame 170*a* includes a frame 171*a* that supports terminal array 171*c* while terminal frame 170*b* includes a frame 171*b* that supports terminal array 171*d*. As in plug connector 250, an impedance block 172 is used to provide the desired tuning while allowing for an overmolding construction. In both plug connectors the overmold construction helps secure the terminals in place, helps provide strain relief and helps provide a compact design. Thus, the use of the impedance block allows for the overmold construction and helps make the rest of the plug connector design more beneficial.

FIGS. 32-38 illustrate features of a receptacle 300 that is configured to provide a vertical alignment with terminals at a 0.5 mm pitch while supporting 8 Gbps and 16 Gbps data rates for each sub channel using NRZ encoding. The receptacle 300 includes a shell 205 with a front edge 306 and a latch aperture 307 that can be engaged by a passive or an active latch. A housing assembly 320 includes a first terminal frame 320*a* and a second terminal frame 320*b*. The first terminal frame 320 includes a tongue 322*a* and supports terminal array 330*a* and the terminal array 330*a* include signal terminals 335*a* that are separated by ground terminals 336*a* when the signal terminals 335*a* are configured to provide a differential pair 335. The second terminal frame 320*b* includes a tongue 322*b* and supports terminal array 330*b*, which includes signal terminals 335*b* and ground terminals 336*b*. As with the terminal array 330*a*, ground terminals 336*b* separate pairs of signal terminals 335*a* when the signal terminals are configured to provide a differential pair 335.

As depicted, to help tune the impedance of the terminals, notches 329 are provided behind the terminals. Impedance notches 325 are also provided at the end of the signal terminals 335 that form the differential pair 335 and the longer ground terminals 336*b* extend along both sides of the impedance notch. It should be noted that the depicted tongue configuration is beneficial to provide the desired impedance tuning but other approaches could also be used and thus the depicted tongue configuration is not intended to be limiting unless otherwise noted.

FIGS. 39-52 illustrate an embodiment of a plug connector 350 that includes a body 357, which can be formed by a two-piece design conductive design having half 357*a* and half 357*b* and could be formed of an insulative material, depending on the desired configuration, and with terminals at a 0.5 mm pitch while supporting 8 Gbps and 16 Gbps data rates for each sub channel using NRZ encoding. The plug connector 350 includes plug shell 355 with a top surface 356 and a front edge 357. The plug shell 355 helps define an engaging port 351 and the plug shell 355 has latch fingers 388 extending through latch aperture 361*b*, the latch aperture 361*b* being at least partially formed in the top surface 356. As can be appreciated, the plug connector 350 includes a plug module 360 and a termination module 370 and the two modules are combined together to form the plug connector 350.

The depicted active latch 380 includes a grip 381, which is optionally configured to be pulled for actuation, and is coupled to legs 382, which in turn are coupled to pull frame 383. Pull frame 383 includes plate 383*a* and plate 383*a* is mechanically coupled to angled portion 384 and in an embodiment both can be formed integrally as a one-piece assembly. When the angled portion 384 is translated, a sliding surface 384*a* presses against angled surface 390 and causes arm 387 to deflect. Deflection of arm 387 causes latch finger 388 to translate and in an embodiment latch finger 388 translates at least 50% farther than the angled surface 390 is translated. Thus, actuation of grip 381 in direction A causes latch finger 388 to translate in direction B. These two directions can be substantially perpendicular to each other and it should be noted that grip 381 could also be pushed instead of pulled (naturally, the orientation of angle portion 384 and angled surface 390 would need to change if the grip was moved in a direction opposite the A direction).

It should be noted that other forms of the active latch can be provided and in an embodiment, the active latch could be replaced with a passive latch such as is used by plug connector 150. It can be appreciated that the depicted active latch system is one embodiment of an active latching system and any other desirable way of actuating the arms of the latch would be suitable if an active latch system is desired. Thus, a grip could also be configured to push straight down on the latch arm.

The plug module 360 includes plug shell 355 and has locking openings 361*a* that are configured to engage and retain ramps 371*a*. A bridge 361*c* bifurcates the latch aperture 361*b* so that a latch finger 388 is provided on both sides of the bridge 361*c*. The arm 387 is supported by base 386, which is in turn supported by bottom plate 389. The bottom plate 389 can be secured to the termination module 370 and thus the arm 387 extends in a cantilevered fashion from the termination module 370.

The termination module includes a housing 371 that has includes the ramps 371*a* and step 371*c*. The housing support a card 372 that includes pads 373*c* that the plug module 360 is configured to engage.

It should be noted that the plug connector designs discussed above avoided the use of paddle cards while providing a design that would work with the terminal spaced at 0.5 mm pitch. A paddle card, however, can be beneficial if it is desirable to add any kind of electronic components. Paddle cards with contacts on both sides are formed by pressing the opposing layers together to form a sandwich of sorts. While it would be ideal for both sides of the paddle card to be perfectly aligned, the process of forming the paddle card causes a location of a set of pads formed on a first side of the paddle card to have a tolerance compared to a location of a second set of pads formed on a second side of the paddle card.

It has been determined that in a convention paddle card design, the tolerances inherent in the design of the paddle card (e.g., to relative distance between the pads on opposite sides of the paddle card), when combined with the tolerances of securing the paddle card in a connector, make it infeasible to provide such a convention paddle card design (such as might be used in an SFP style connector) if the terminals are to be at 0.5 mm pitch. While the location of the terminals in the receptacle can be very accurately controlled due to the fact that they can be formed with insert molding techniques, even if the paddle card is biased to one side in the receptacle the tolerances of the location of pads to the edge of the paddle card and to the pads on the other side of the paddle is sufficiently large such that, when both sides of the paddle card need to mate to terminals at a 0.5 mm pitch, the paddle card design cannot ensure a reliable connection is made.

One way to solve this would be to improve the manufacturing process of the paddle card but there currently is no cost effective way to do so. It has been determined, however, that the tolerance difference between the two sides of the paddle card could be accommodated if no other significant tolerances were introduced. Accordingly, the depicted design uses the location of the pads on a first side of the paddle card as a datum and with vision software, can accurately position a first set of terminals provided in the plug module on the corresponding pads. A position of a second set of terminals provide in the plug module (the opposing terminals) can be carefully controlled with convention manufacturing techniques and can reliably engage a second set of pads on the second side of the paddle card. For example, if the terminals are configured so that the tails of the terminals are about 0.2 mm wide then they can reliable engage a pad that is about 0.3 mm wide.

Figure 45:
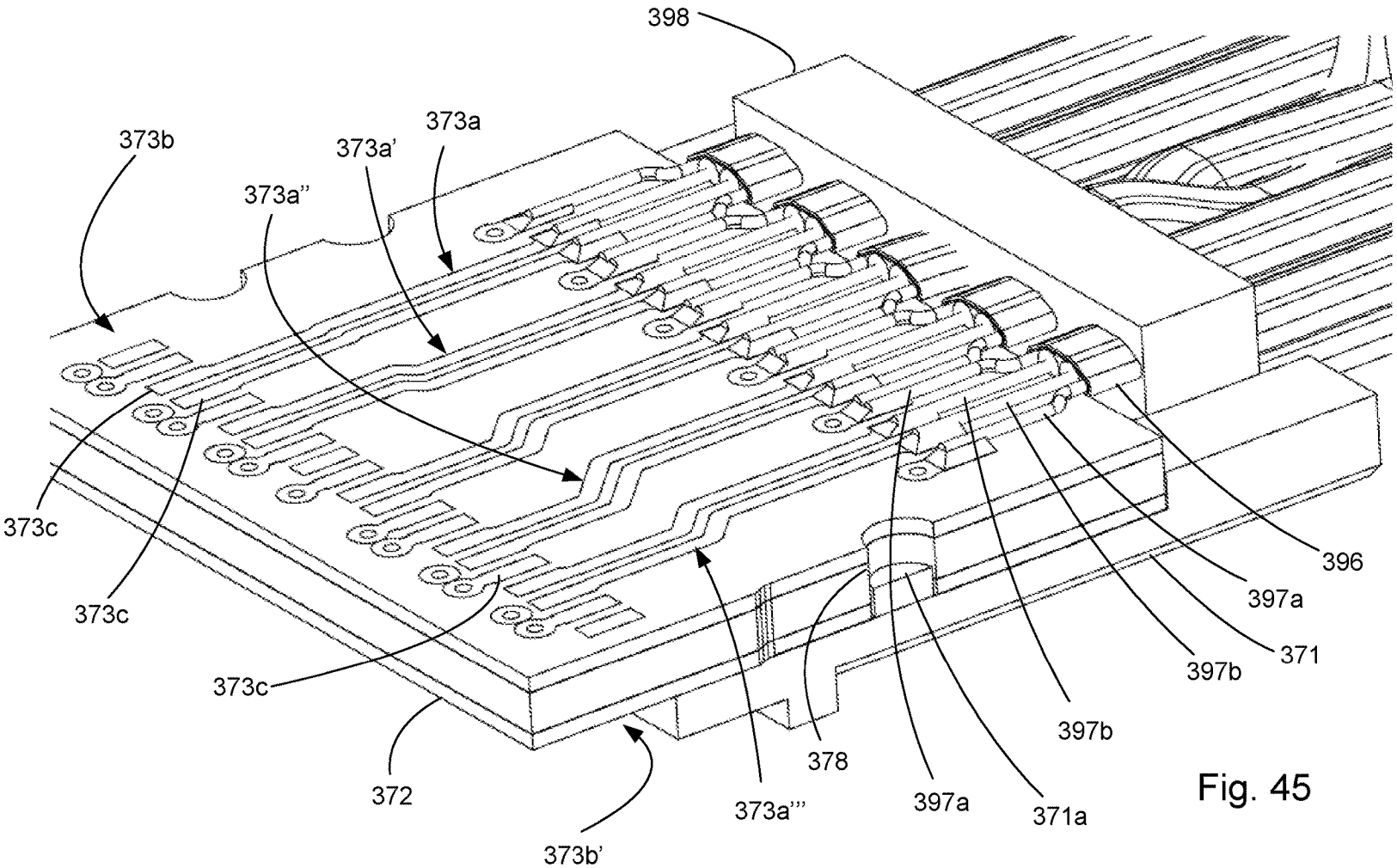
FIG. 45 illustrates a simplified perspective view of the embodiment depicted in FIG. 44.
Figure 46:
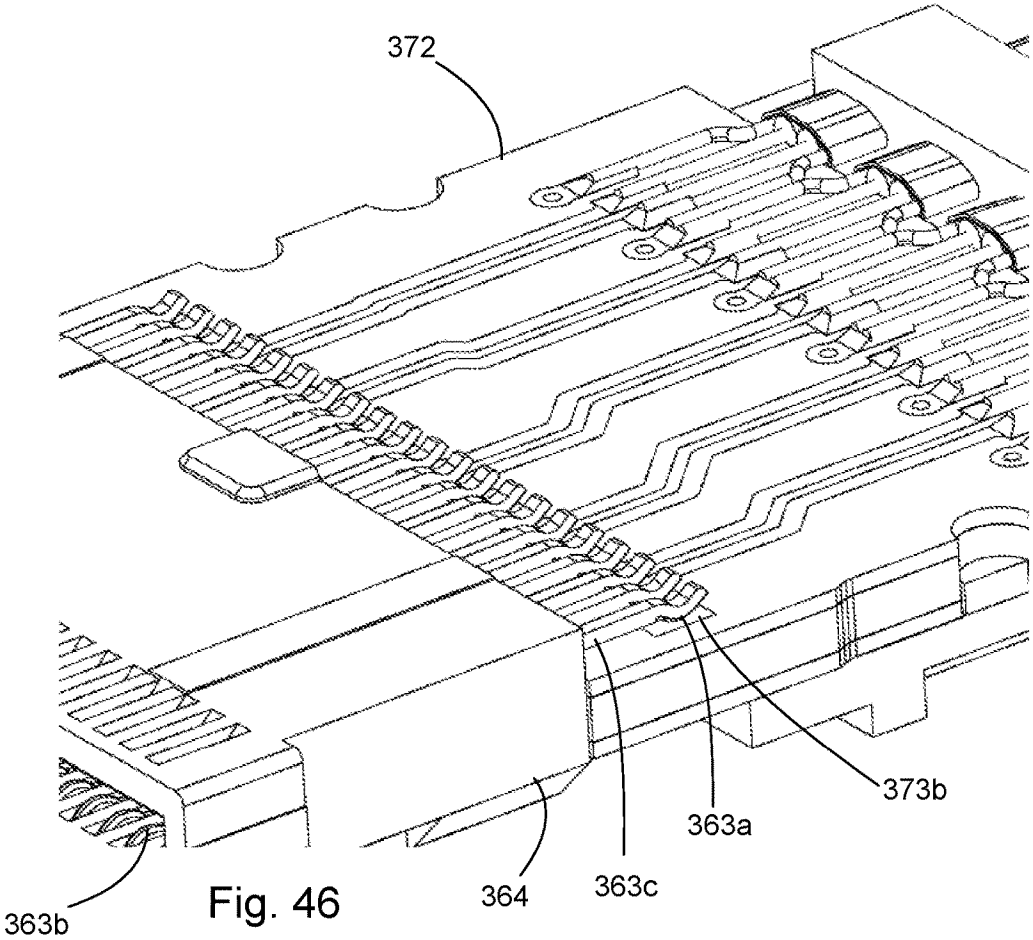
FIG. 46 illustrates a simplified enlarged perspective view of the embodiment depicted in FIG. 42.
Figure 47:
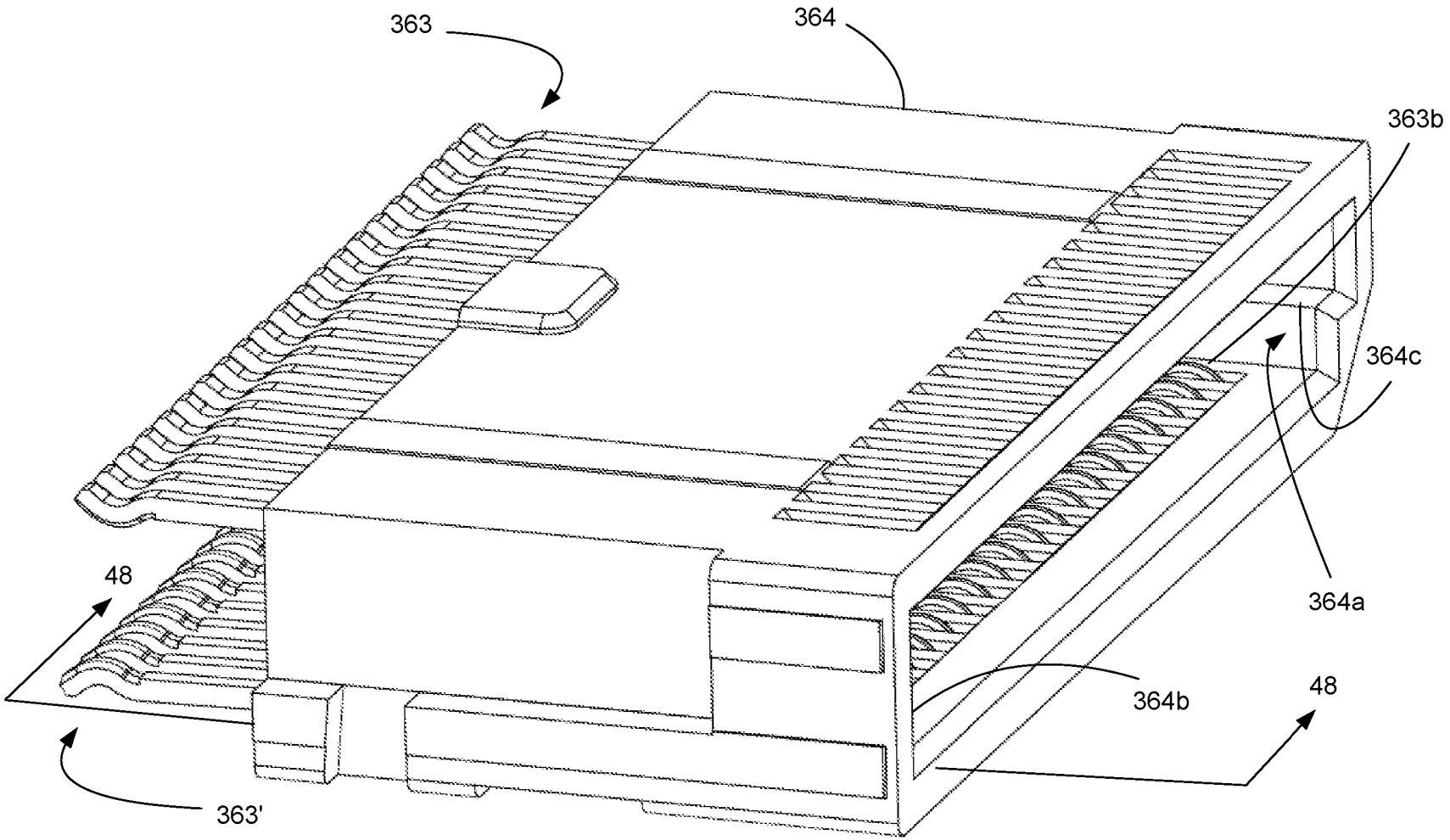
FIG. 47 illustrates a simplified perspective view of an embodiment of a plug nose.
Figure 48:
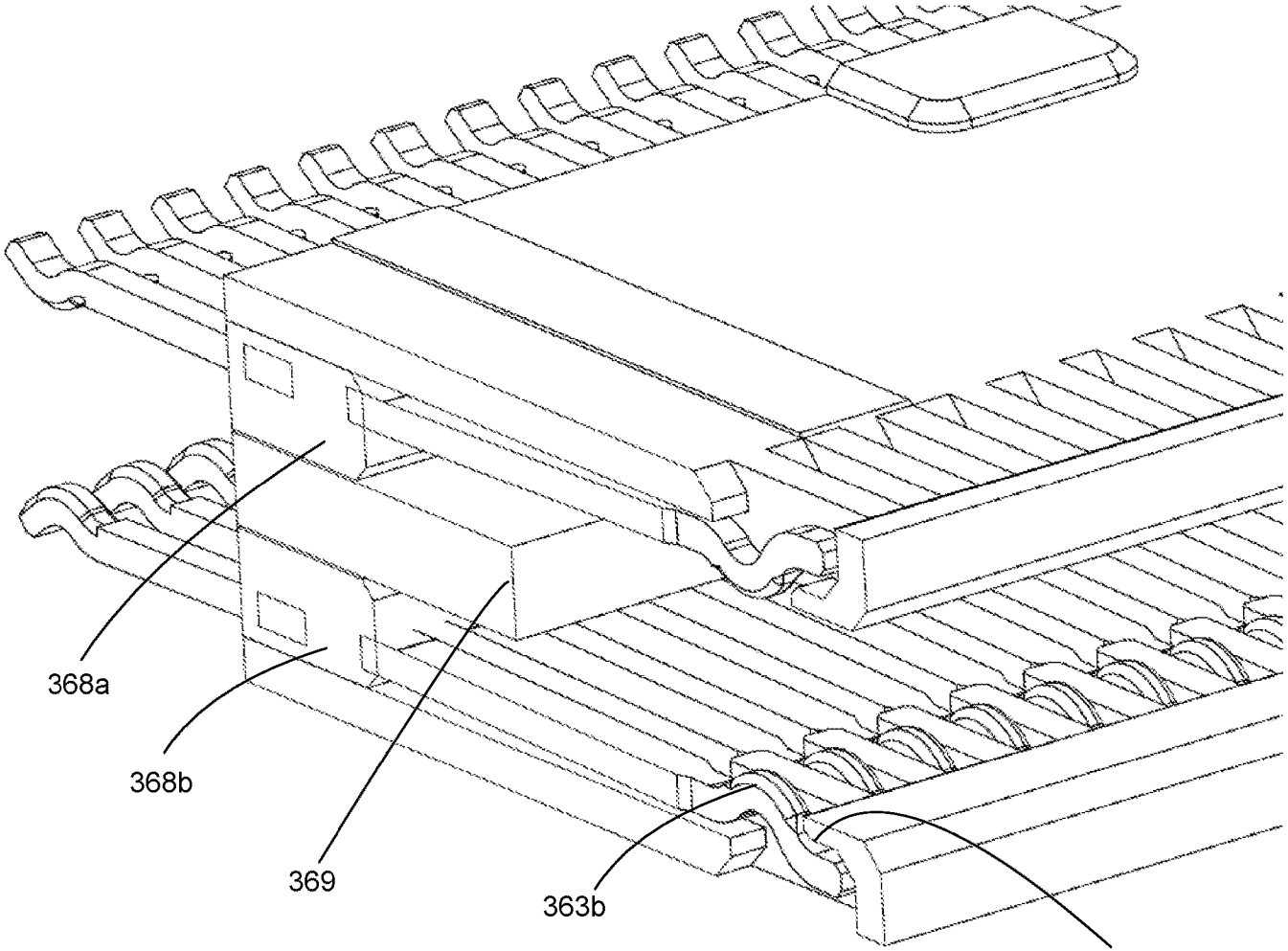
FIG. 48 illustrates a perspective cross-section view taken along line 48-48 in FIG. 47.
Figure 49:
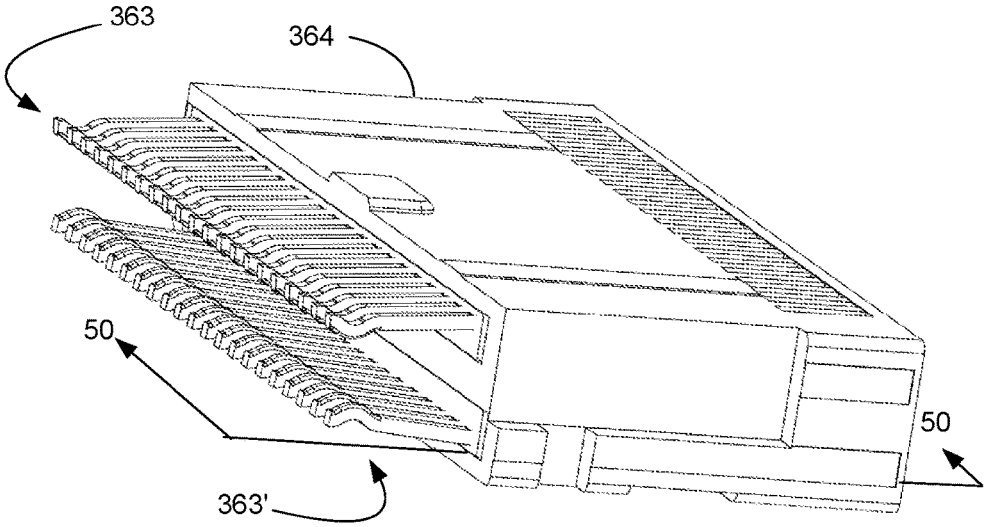
FIG. 49 illustrates another perspective view of the embodiment depicted in FIG. 47.
Figure 50:
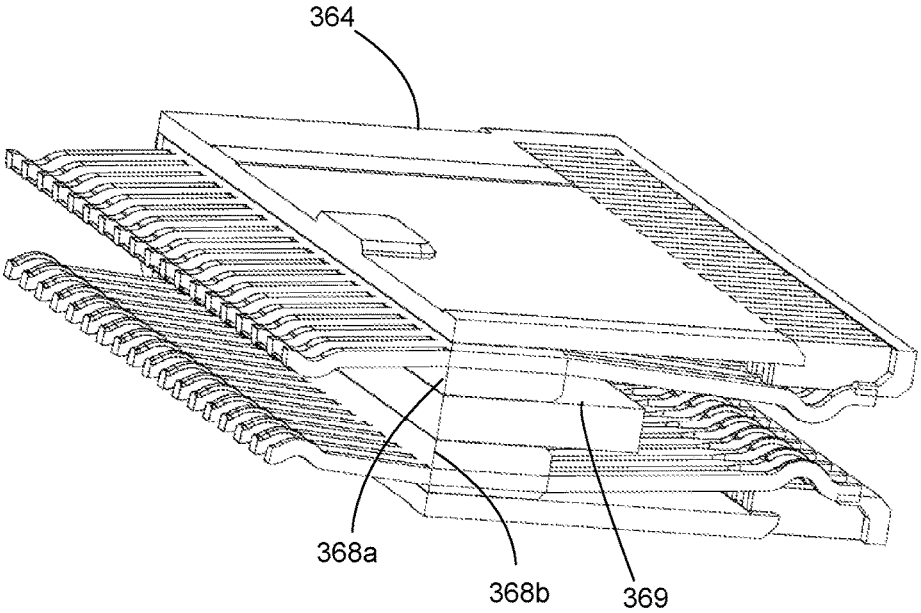
FIG. 50 illustrates a perspective cross-section view taken along line 50-50 in FIG. 49.
Figure 51:
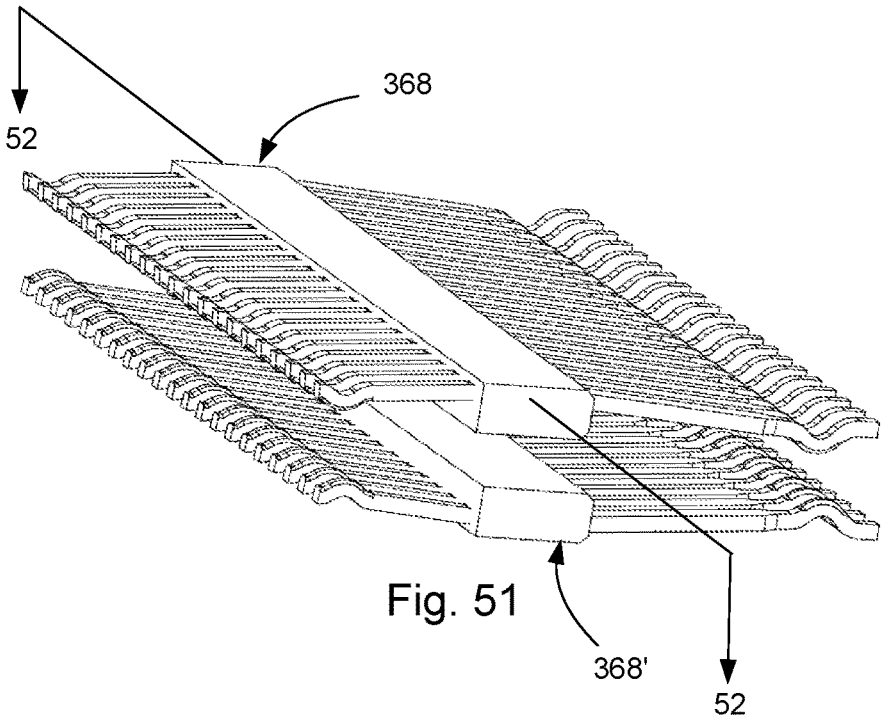
FIG. 51 illustrates a simplified perspective view of an embodiment of two terminal frames.
Figure 52:
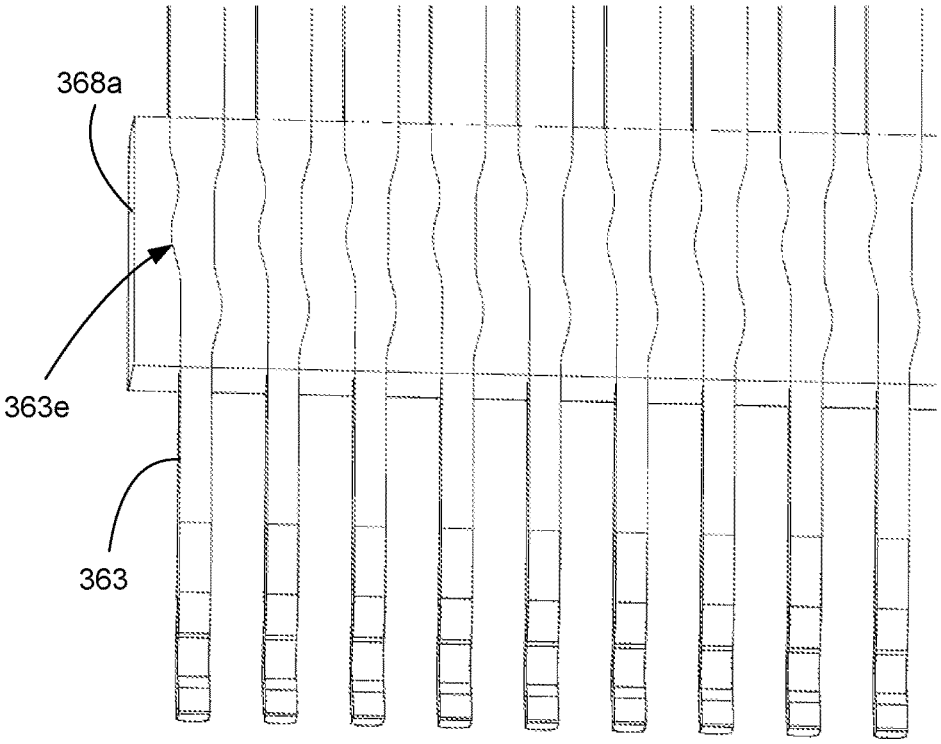
FIG. 52 illustrates a perspective cross-section view taken along line 52-52 in FIG. 51.
Figure 53:
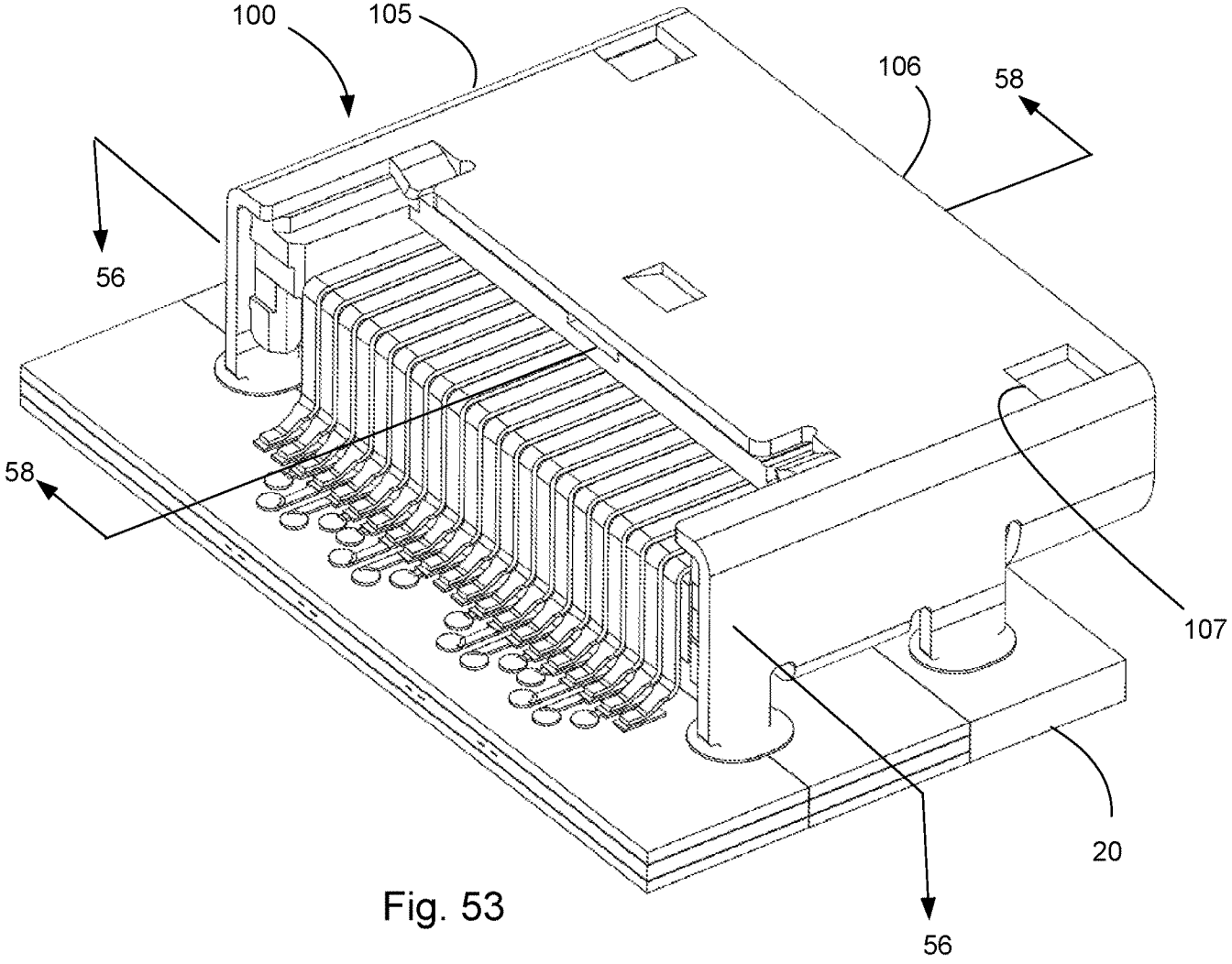
FIG. 53 illustrates a perspective view of an embodiment of a receptacle.
Figure 54:
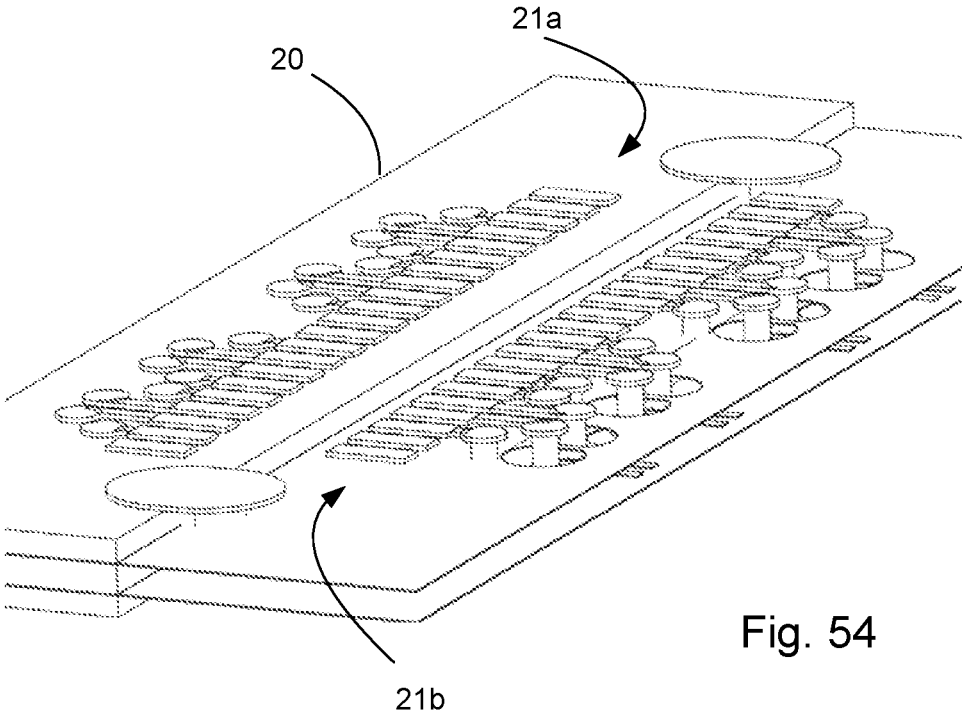
FIG. 54 illustrates a simplified perspective view of an embodiment of a circuit board configured to support the receptacle depicted in FIG. 53.
Figure 55:
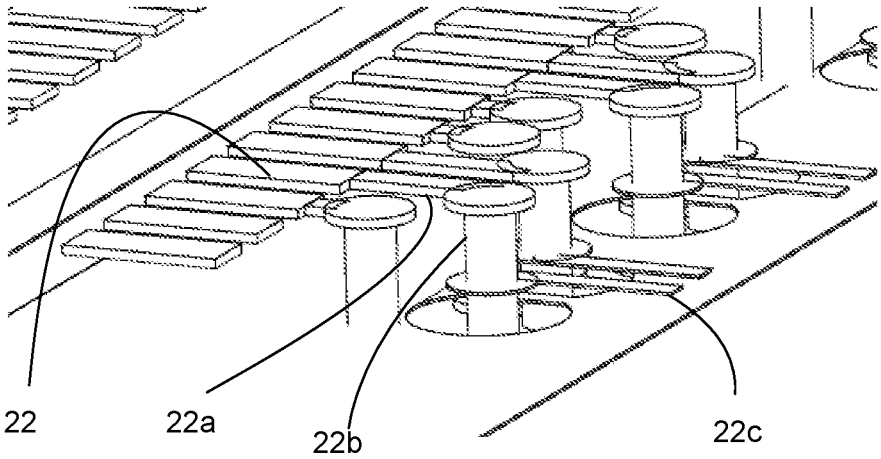
FIG. 55 illustrates a further simplified perspective view of the circuit board depicted in FIG. 54.
Figure 56:
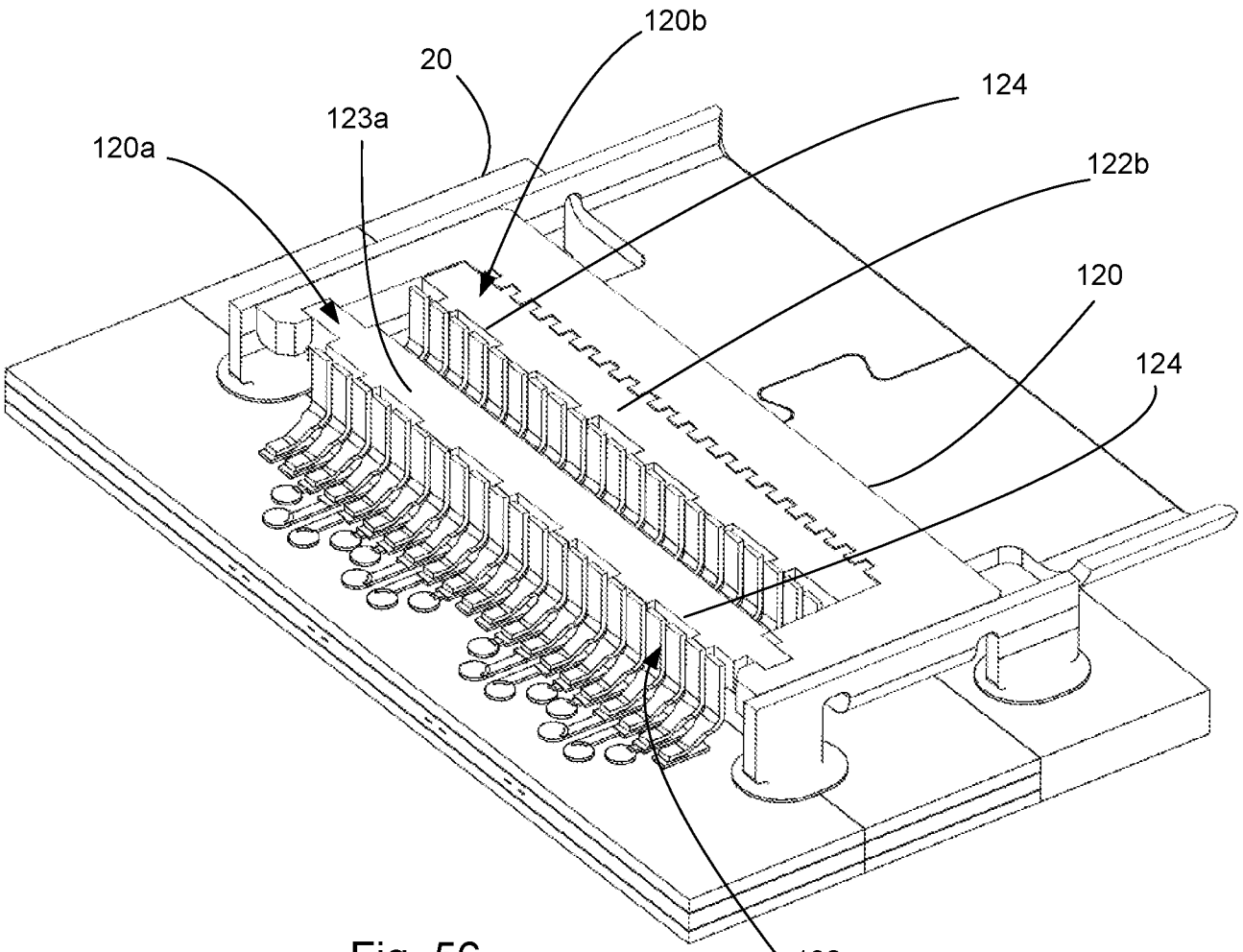
FIG. 56 illustrates a perspective cross-section view taken along line 56-56 in FIG. 53.
Figure 57:
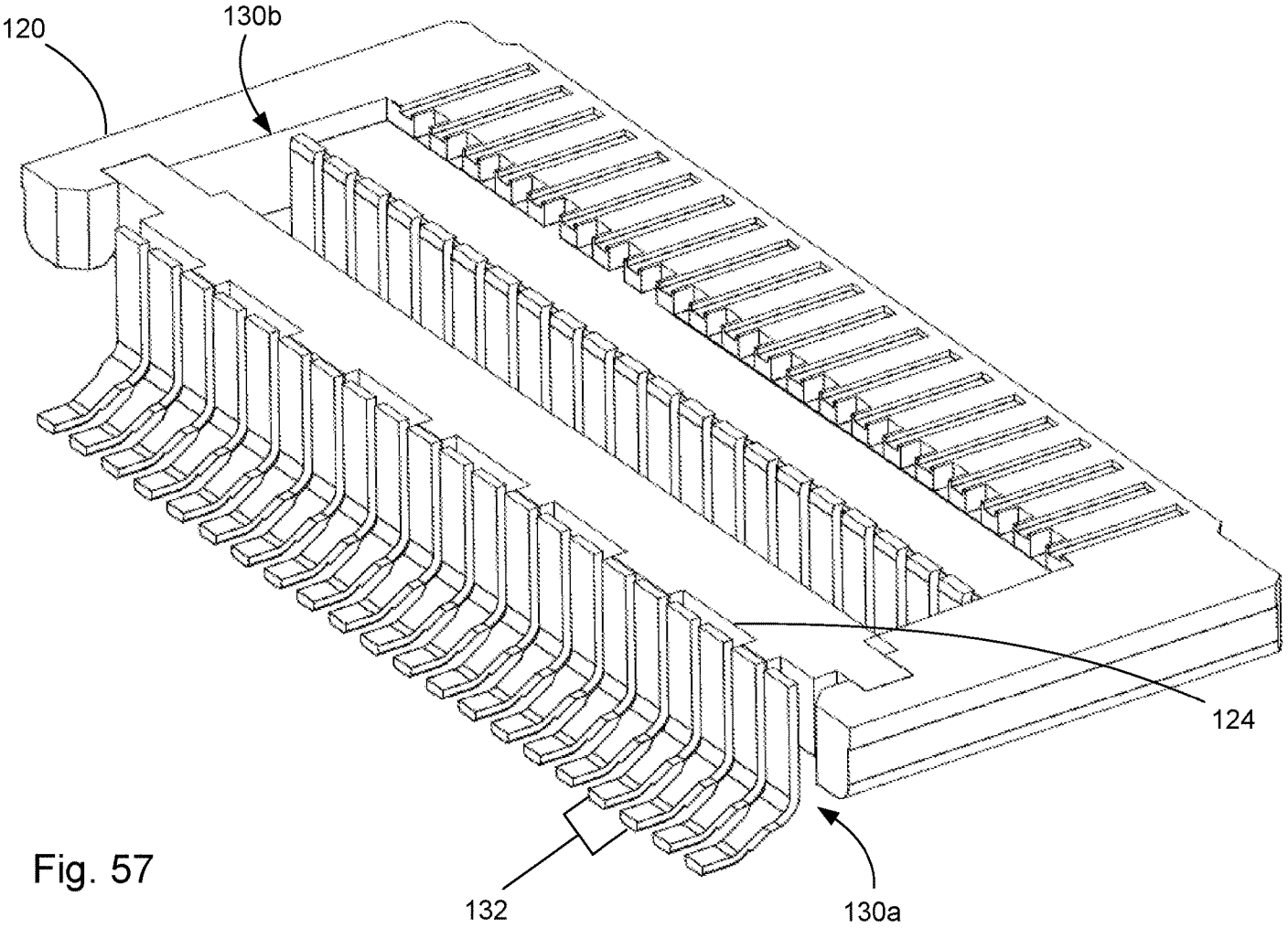
FIG. 57 illustrates a simplified perspective view of the embodiment depicted in FIG. 56.
Figure 58:
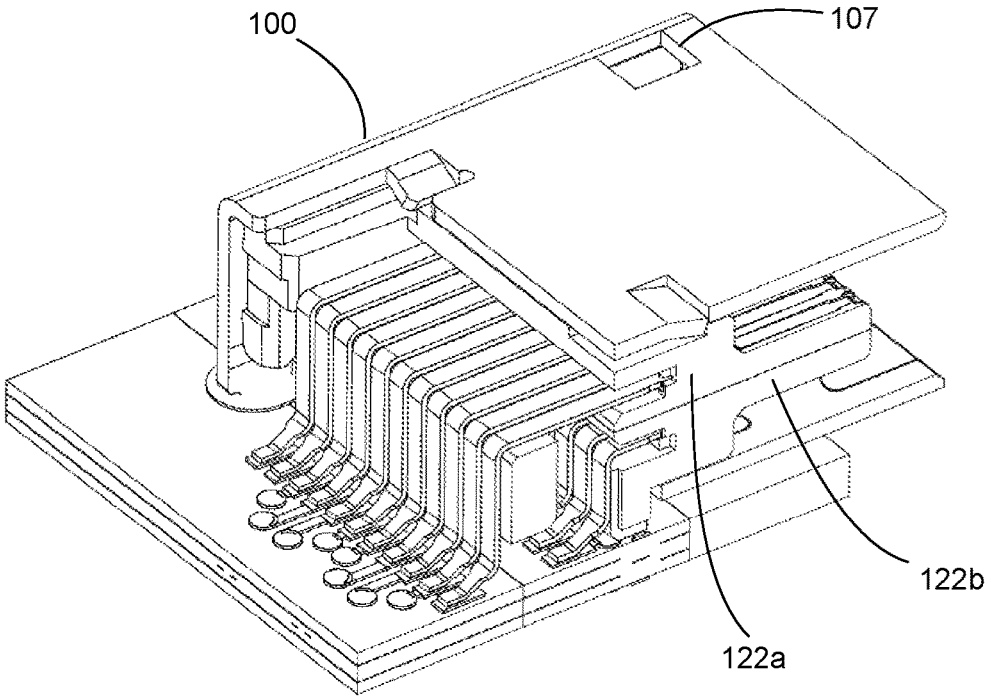
FIG. 58 illustrates a perspective cross-section view taken along line 58-58 in FIG. 53.
Figure 59:
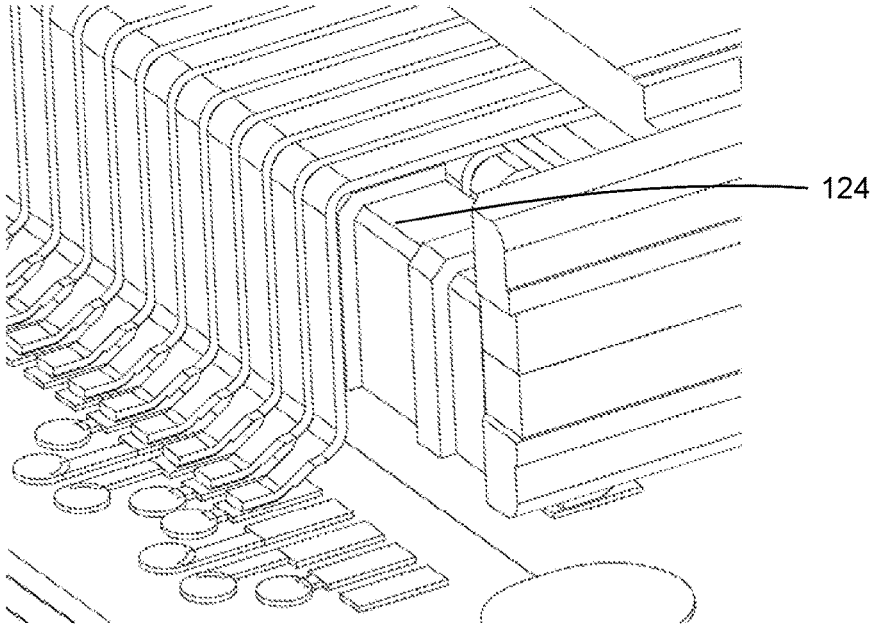
FIG. 59 illustrates a simplified enlarged perspective view of the embodiment depicted in FIG. 53.
Figure 60:
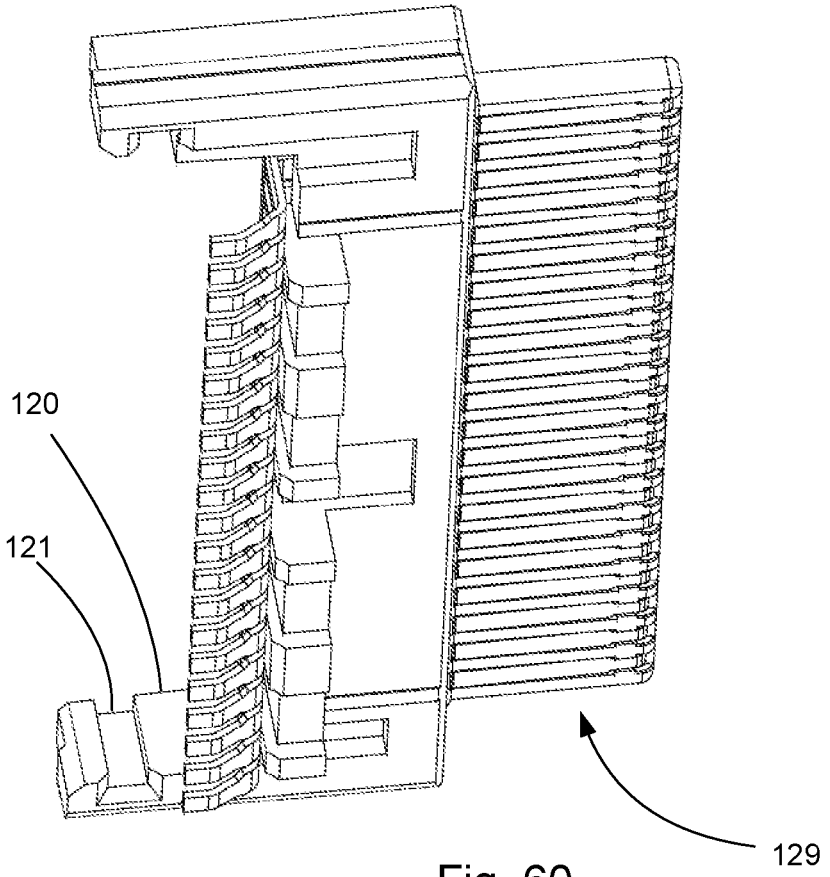
FIG. 60 illustrates a perspective view of an embodiment of a terminal frame.
Figure 61:
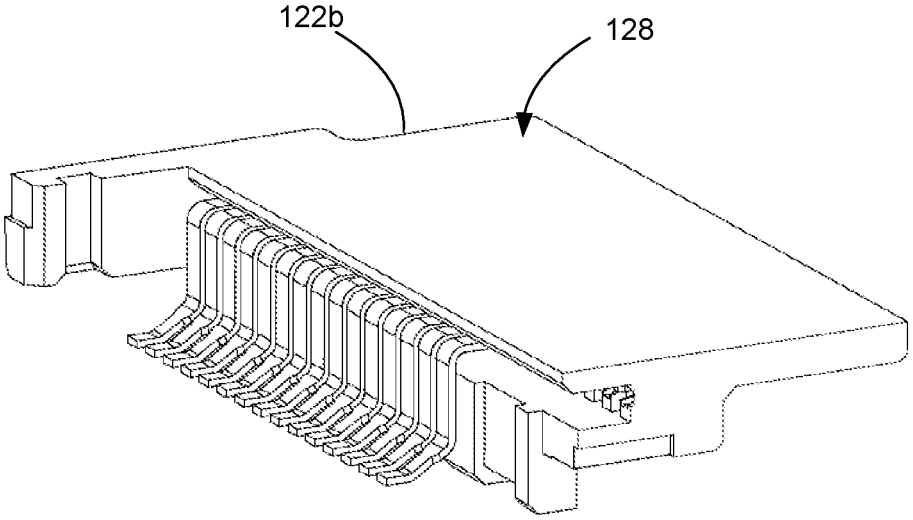
FIG. 61 illustrates another perspective view of the terminal frame depicted in FIG. 60.

FIG. 45 illustrates features of a paddle card 372 that can be used in a termination module 370. The paddle card 372 has rows of pads 373*b* and 373*b*' that are positioned on opposite sides of the paddle card 372. Each pad 373*c* can be electrically coupled a conductor provided by cables 396 and is configured to be mated to a corresponding terminal provided by the plug module 360. Trace pairs 373*a*, 373*a*', 373*a*" and 373*a*"' are coupled to the pads configured to be used a signal pads so as to provide a differential signal paths. Signal conductors 379*b* of the cables 396 are soldered to these trace pairs while drain conductors 379*a* are soldered to the pads that correspond to ground terminals. The paddle card may include a notch 378 that is used to secure the housing 371 to the paddle card.

The plug module 360 is then positioned so that the tails 363*a* line up with the pads 373*b*. As can be appreciated, the orientation of the plug module to the termination module 370 is controlled solely by placing the tails on the pads, thus other tolerances do not interfere with the alignment. Thus, the plug module and the termination module abut one another but physically don't require alignment features as the alignment is based on the location of the terminals, not the location of the housing 364 to the location of the housing 371. Once the tails on one side are sufficiently aligned with the corresponding pads, the tolerances are sufficient such that the tails on the other side can be considered reliably aligned as well and the tails can be soldered to the pads. As can be appreciated, the level of precision required will depend on the tolerance stack-up and can readily be determined by a person of skill in the art and thus will not be further discussed herein.

As can be appreciated, the plug module includes terminals with tails 363*a*, contacts 363*b* and bodies 363*c* that extend therebetween. The tails are provided in rows 363, 363' and the contacts are positioned in the housing 364 with sides 364*a*, 364*b* that help define the engaging port 351. An orientation feature 364*c* can be used to prevent backward insertion of the plug connector 350.

The terminals are supported by a block 368*a*, 368*b*, which are positioned on opposite sides of wall 369 of the housing 364 and the contacts are constrained in position, at least in part, by ledge 364*a*. Thus, terminal frames 368, 368' are provided.

It has been determined that it is beneficial to secure the terminals 363 in the block 368*a* by using an undulating portion 363*e*. Thus, unlike convention designs that use sharp edges, the depicted design can use undulating portion to ensure the terminals are secured in the block while reducing impedance discontinuities and reflections, which is particularly beneficial as data rates increase toward 16 Gbps or 25 Gbps.

It should be noted that in certain embodiments the termination module can be configured to act as an optical module. In such a configuration there would be no cables mounted to one side of the paddle card but instead components would be provided on the paddle card that could convert the electrical signals to optical signals. Such an optical module could vary in construction and is not discussed herein as optical modules are known but it can be appreciated that such a termination module would still include the same pad configuration that allows the paddle card to be mated to the plug module.

FIGS. 53-61 illustrate details of receptacle 100 configured to be mounted on a circuit board 20 with terminals at a 0.5 mm pitch while supporting 8 Gbps and 16 Gbps data rates for each sub channel using NRZ encoding. The receptacle 100 includes a shell 105 with a front edge 106 and latch aperture 107. The circuit board 20 includes two rows of pads 21*a*, 21*b* and each pad 22 in the row is configured to be coupled to a tail in the receptacle 100. The pads that correspond to signal pads are coupled to traces 22*a* that connect to vias 22*b* and then connect to traces 22*c*. The disclosed embodiment has two ground pads positioned between each signal pair, which is beneficial for use in designs that require higher signaling frequencies with low cross talk. Such a configuration, for example, is beneficial and potentially necessary for data rates that are equal to 25 Gbps (using NRZ encoding).

The receptacle 100 includes a housing 120 that supports two terminal frames 120*a*, 120*b*. The terminal frame 120*a* includes a frame 122*a* that supports terminal array 130*a* while terminal frame 120*b* includes a frame 122*b* that supports terminal array 130*b*. The frame 122*a* supports the terminal array 130*a* but it has been determined that a terminal comb 123*a* is useful to control the position of the tails. Differential pairs 132 can be aligned with impedance notches 124 so that the differential pairs are more closely coupled together than they are coupled to adjacent terminals (e.g., they can be preferentially coupled). The impedance notches thus allow for preferential coupling even though the size and pitch of the terminals would make it more difficult to vary the actual spacing or size of the terminals and still provide a mechanically robust design. The frame 122*b*, however can avoid the use of a terminal comb as it is smaller and thus the impedance notches can be provided directly in the frame 122*b*. The terminal comb 123*a* can be positioned in a slot 121 in the housing 120. It should be noted that surfaces of the frames 122*a*, 122*b*, such as surface 128, can be made smooth so that the two frames can slide relative to each other. Thus the two terminal frames 120*a*, 120*b* do not have to be married prior to being inserted into to housing 120. Thus, the result is a row of contacts 129 provided on both terminal frames.

It should be noted that providing the desired return loss and cross-talk performance is considered helpful and for certain applications it may be needed in order to ensure the system performs as desired. Naturally, the connectors are part of entire system and thus providing improved performance from the connector is always helpful. Eventually, however, the additional manufacturing costs required to further improve performance becomes unattractive. A person of skill in the art can appreciate these trade-offs and will select the appropriate performance based on the system requirements and the teachings provided herein.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A plug connector, comprising:

a plug module that defines a port and supports a plurality of terminals arranged so that each of the terminals is in one of two rows, the terminals being less than 0.13 mm thick and each row supporting ground terminals and signal terminals that are arranged in a ground, signal, signal arrangement so as to provide differential signaling via differentially coupled pairs, each of the terminals in each row including a tail and a contact and a body extending therebetween, the contacts positioned in the port in a cantilevered manner and configured to be deflected;

a termination module including pads configured to mate to the tails of the terminals, the plug module and the termination module being aligned via the orientation of the pads and the tails, wherein the tails are soldered to the pads on the termination module; and a body that at least partially encloses the plug module and the termination module, wherein the plug module is configured to support a data rate of 16 Gbps for each differential coupled pair using NRZ encoding in a passive manner.

2. The plug module of claim 1, wherein the contacts are deflectable such that the contacts in the two rows deflect away from each other.

3. The plug module of claim 2, further comprising a plug shell that extends around the plug module and at least a portion of the termination module, the plug shell having a latch aperture positioned adjacent the contacts that are deflectable, wherein a latch finger extends out of the latch aperture.

4. The plug module of claim 3, wherein the plug connector includes 8 sub-channels.

5. The plug connector of claim 3, wherein the latch finger is supported by an arm that is supported in a cantilevered fashion, wherein deflection of the arm causes the latch finger to deflect.

6. The plug connector of claim 5, further comprising a pull frame that is configured to translate in a first direction, the translation of the pull frame configured to cause the arm to deflect.

7. The plug connector of claim 6, wherein the first direction is a horizontal direction.

8. The plug connector of claim 7, further comprising a grip that is mechanically coupled to the pull frame, the grip configured, in operation, to be translated in the first direction by a user.

9. A plug connector, comprising:

a plug module that defines a port and supports a plurality of terminals arranged so that each of the terminals is in one of two rows, the terminals being less than 0.13 mm thick and each row supporting ground terminals and signal terminals that are arranged in a ground, signal, signal arrangement so as to provide differential signaling via differentially coupled pairs, each of the plurality of terminals in each row including a tail and a contact and a body extending therebetween, the contacts positioned in the port in a cantilevered manner and configured to deflect when mated with a mating connector;

a termination module including pads on a first end that are connected to the tails, the termination module having a plurality of conductors terminated to a second end, the plurality of conductors forming a cable that extends from the plug connector;

a plug shell that covers at least a portion of the plug module and the termination module, the plug shell including a latch aperture;

a pull frame supported by the termination module, the pull frame connected via at least one leg to a grip;

a bottom plate supported by the termination module, the bottom plate having an arm that extends therefrom toward the latch aperture; and a latch finger provided on a distal end of the arm, the latch finger positioned in the latch aperture, wherein translation of the grip causes the latch finger to deflect.

10. The plug connector of claim 9, wherein the plug connector is configured to support a data rate of 16 Gbps using NRZ encoding in a passive manner.

11. The plug connector of claim 10, wherein the termination module includes a ramp and the ramp is configured to help retain the plug shell on the termination module.

12. The plug connector of claim 11, wherein terminals in each row are supported by a block that is formed around the terminals.

13. The plug connector of claim 11, further comprising a body that extends at least partially around the plug module and the termination module.

* * * * *